US005163759A

United States Patent [19]

Jambor et al.

[11] Patent Number: 5,163,759

[45] Date of Patent: Nov. 17, 1992

[54] SIGNMAKING MACHINE USING CHARACTER FORMING TOOL FOR OVERLAPPING IMPACTS AND WEB SCORING

[75] Inventors: George F. Jambor, Cedarburg; Gary J. Wirth, Milwaukee, both of Wis.

[73] Assignee: Brady USA, Inc., Milwaukee, Wis.

[21] Appl. No.: 595,080

[22] Filed: Oct. 10, 1990

[51] Int. Cl.[5] ..... B41J 3/28

[52] U.S. Cl. ..... 400/29; 346/139 R; 346/139 D

[58] Field of Search ..... 400/17, 29, 618, 636; 346/29, 139 R, 139 D, 139 B

[56] References Cited

U.S. PATENT DOCUMENTS

| | | | |
|---|---|---|---|
| 3,052,884 | 9/1962 | Moseley et al. | 346/29 |
| 3,196,446 | 7/1965 | Ingerson et al. | 346/29 |
| 3,283,869 | 11/1966 | Hiss | 400/29 |
| 3,380,065 | 4/1968 | Alpert et al. | 346/29 |
| 3,465,627 | 9/1969 | Vigneault | 83/171 |
| 3,490,362 | 1/1970 | Massari | 101/28 |
| 3,556,276 | 12/1970 | Krammer | 400/29 |
| 3,821,612 | 6/1974 | Webb | 317/151 |
| 3,826,167 | 7/1974 | Pelet et al. | 83/171 |
| 4,014,257 | 3/1977 | Bettenhausen | 101/26 |
| 4,367,588 | 1/1983 | Herbert | 33/1 M |
| 4,400,704 | 8/1983 | Brown et al. | 346/29 |
| 4,467,525 | 8/1984 | Logan et al. | 33/18 |
| 4,512,839 | 4/1985 | Gerber | 156/248 |
| 4,536,770 | 8/1985 | Allen et al. | 346/29 |
| 4,604,153 | 8/1986 | Melbye | 156/235 |
| 4,608,891 | 9/1986 | Frisby et al. | 83/56 |
| 4,678,457 | 7/1987 | Slobodkin | 493/355 |
| 4,698,052 | 10/1987 | Slobodkin | 493/355 |
| 4,732,069 | 3/1988 | Wood et al. | 83/881 |
| 4,751,487 | 6/1988 | Green, Jr. | 335/234 |
| 4,794,542 | 12/1988 | Prockter et al. | 364/474.02 |
| 4,818,133 | 4/1989 | Williams et al. | 400/124 |
| 4,835,872 | 6/1989 | Alcantara Perez et al. | 33/18.1 |
| 4,841,822 | 6/1989 | Gerber | 83/174 |
| 4,867,056 | 9/1989 | de Gelder | 101/19 |
| 4,930,911 | 6/1990 | Sampson et al. | 400/29 |
| 5,030,025 | 7/1991 | Mitcham et al. | 400/636 |
| 5,207,133 | 6/1991 | Weiselfish | 400/618 |

OTHER PUBLICATIONS

"Introducing LETREX" News Release, Scott Machine Development Corporation, Oct. 27, 1989, pp. 1-3.

*Primary Examiner*—David A. Wiecking
*Assistant Examiner*—John H. Hilten
*Attorney, Agent, or Firm*—Quarles & Brady

[57] ABSTRACT

A microprocessor controlled signmaking machine (1) including a reciprocating plunger (210) that impacts adhesive sheet material (46, 46*a–d*) to form a sign (48) including one or more characters separable from the sheet material (46, 46*a–d*) that can be adhered to the surface of an object.

30 Claims, 33 Drawing Sheets

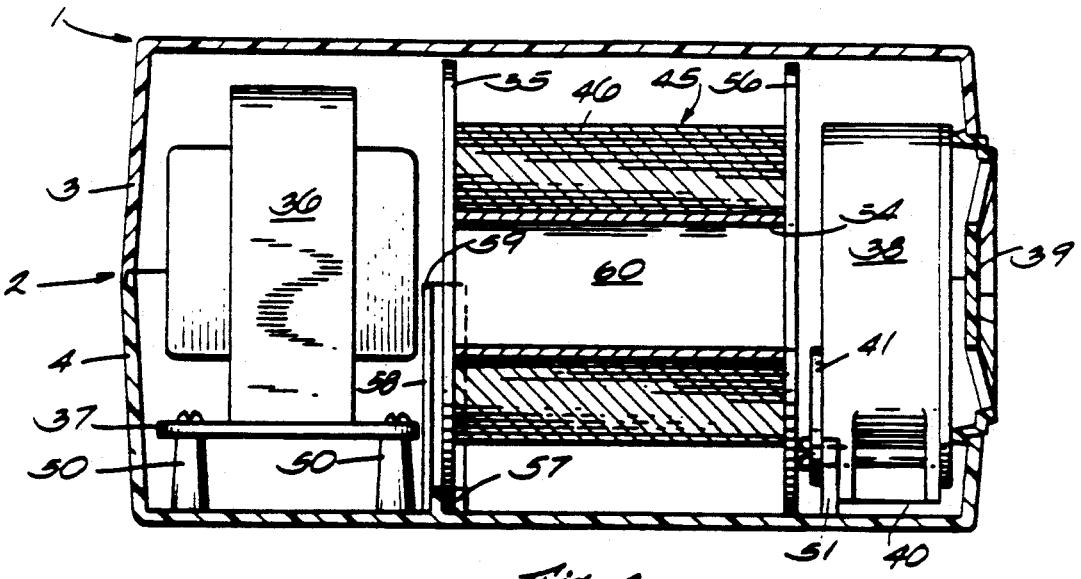
Fig. 4
Fig. 2.
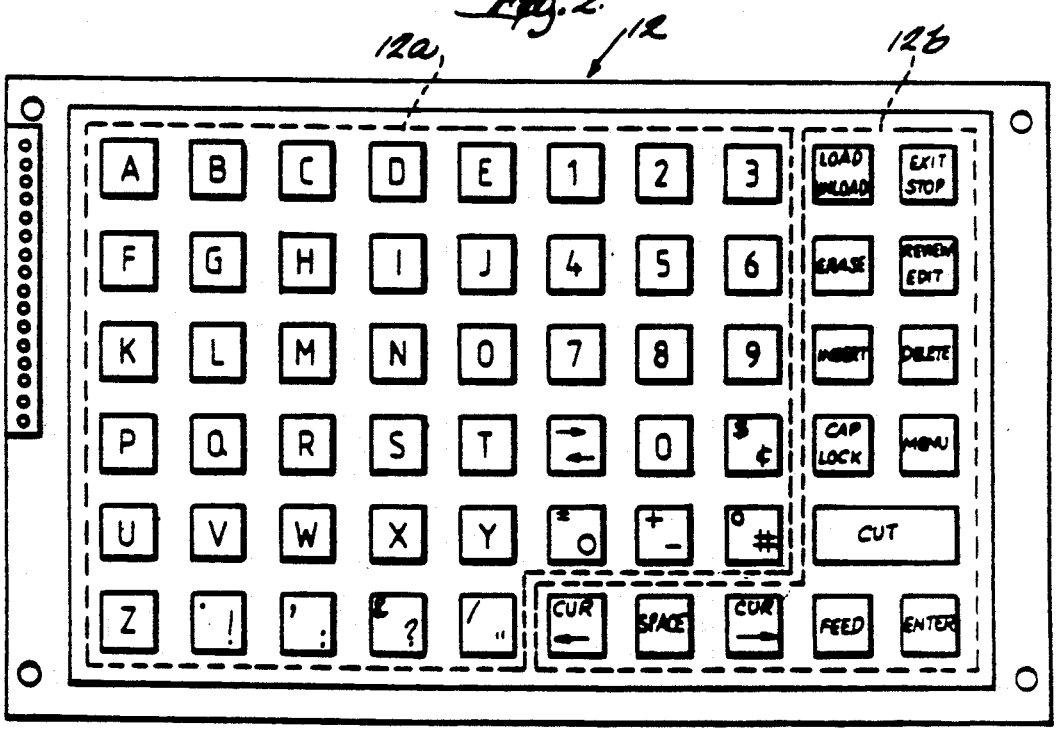

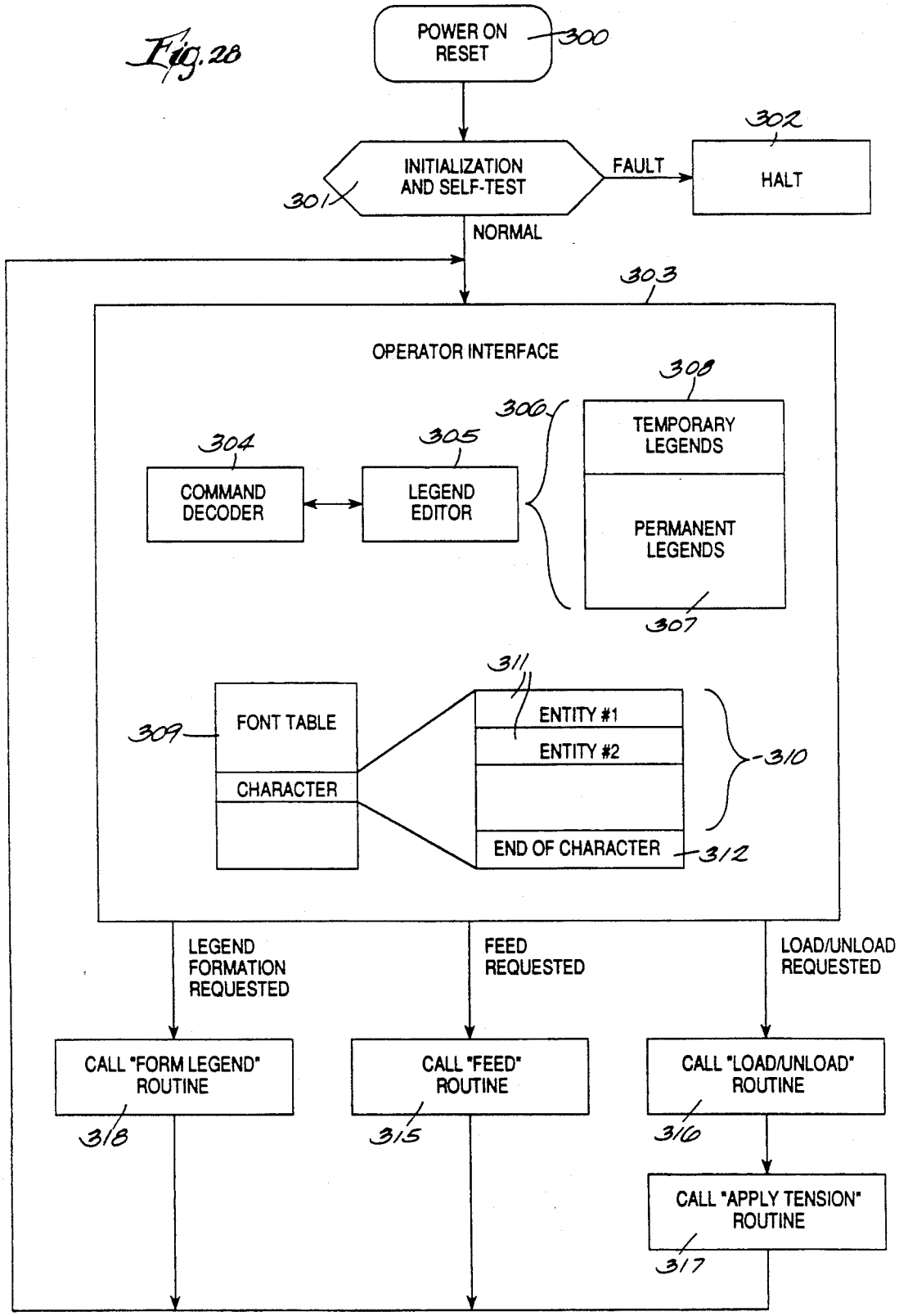
Fig. 28
POWER ON RESET
300
INITIALIZATION AND SELF-TEST
301
FAULT
HALT
302
NORMAL
303
OPERATOR INTERFACE
COMMAND DECODER
304
LEGEND EDITOR
305
306
TEMPORARY LEGENDS
308
PERMANENT LEGENDS
307
FONT TABLE
309
CHARACTER
311
ENTITY #1
ENTITY #2
310
END OF CHARACTER
312
LEGEND FORMATION REQUESTED
FEED REQUESTED
LOAD/UNLOAD REQUESTED
CALL "FORM LEGEND" ROUTINE
318
CALL "FEED" ROUTINE
315
CALL "LOAD/UNLOAD" ROUTINE
316
CALL "APPLY TENSION" ROUTINE
317

LOAD/UNLOAD
340
CALL "HOME" ROUTINE
341

MOVE TO LOAD/UNLOAD POSITION:
MOVE TOOL HOLDER DOWN 1/8 INCH;
MOVE CARRIAGE RIGHT 2 1/4 INCHES;
MOVE TOOL HOLDER UP 1/8 INCH
342
343
DISPLAY OPTIONS; READ AND DECODE KEYBOARD ENTRY
OTHER
"FEED" KEY
"T" KEY
"LOAD/UNLOAD" KEY
344
CALL "HOME" ROUTINE
CALL "PLUNGER DEPTH TEST" ROUTINE
348
EXIT
350
CALL "FEED" ROUTINE
346
MOVE BACK TO LOAD/UNLOAD POSITION
347

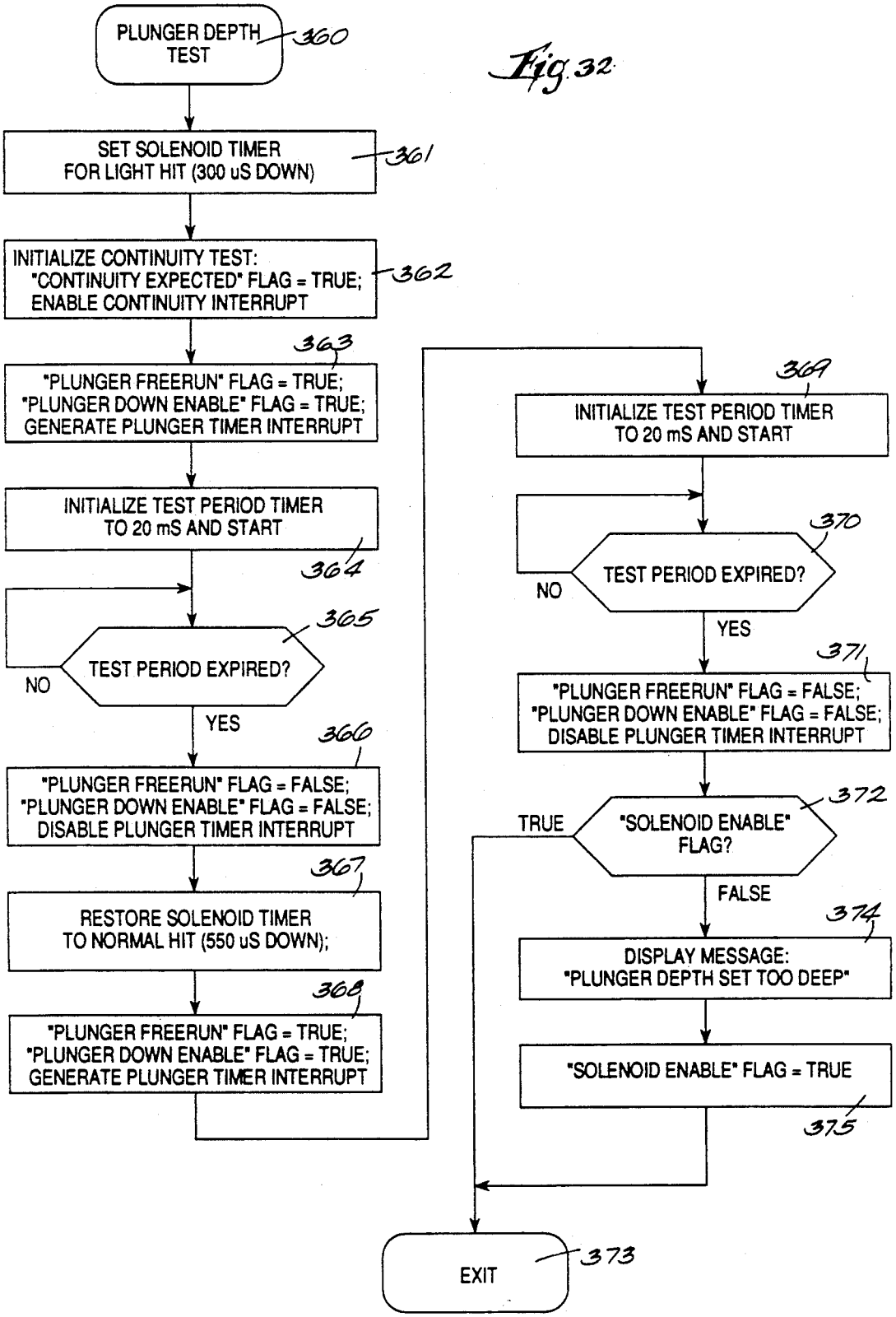
PLUNGER DEPTH TEST
360
Fig. 32
SET SOLENOID TIMER FOR LIGHT HIT (300 uS DOWN)
361
INITIALIZE CONTINUITY TEST: "CONTINUITY EXPECTED" FLAG = TRUE; ENABLE CONTINUITY INTERRUPT
362
363
"PLUNGER FREERUN" FLAG = TRUE; "PLUNGER DOWN ENABLE" FLAG = TRUE; GENERATE PLUNGER TIMER INTERRUPT
INITIALIZE TEST PERIOD TIMER TO 20 mS AND START
364
365
TEST PERIOD EXPIRED?
NO
YES
366
"PLUNGER FREERUN" FLAG = FALSE; "PLUNGER DOWN ENABLE" FLAG = FALSE; DISABLE PLUNGER TIMER INTERRUPT
367
RESTORE SOLENOID TIMER TO NORMAL HIT (550 uS DOWN);
368
"PLUNGER FREERUN" FLAG = TRUE; "PLUNGER DOWN ENABLE" FLAG = TRUE; GENERATE PLUNGER TIMER INTERRUPT
369
INITIALIZE TEST PERIOD TIMER TO 20 mS AND START
370
TEST PERIOD EXPIRED?
NO
YES
371
"PLUNGER FREERUN" FLAG = FALSE; "PLUNGER DOWN ENABLE" FLAG = FALSE; DISABLE PLUNGER TIMER INTERRUPT
372
"SOLENOID ENABLE" FLAG?
TRUE
FALSE
374
DISPLAY MESSAGE: "PLUNGER DEPTH SET TOO DEEP"
"SOLENOID ENABLE" FLAG = TRUE
375
EXIT
373

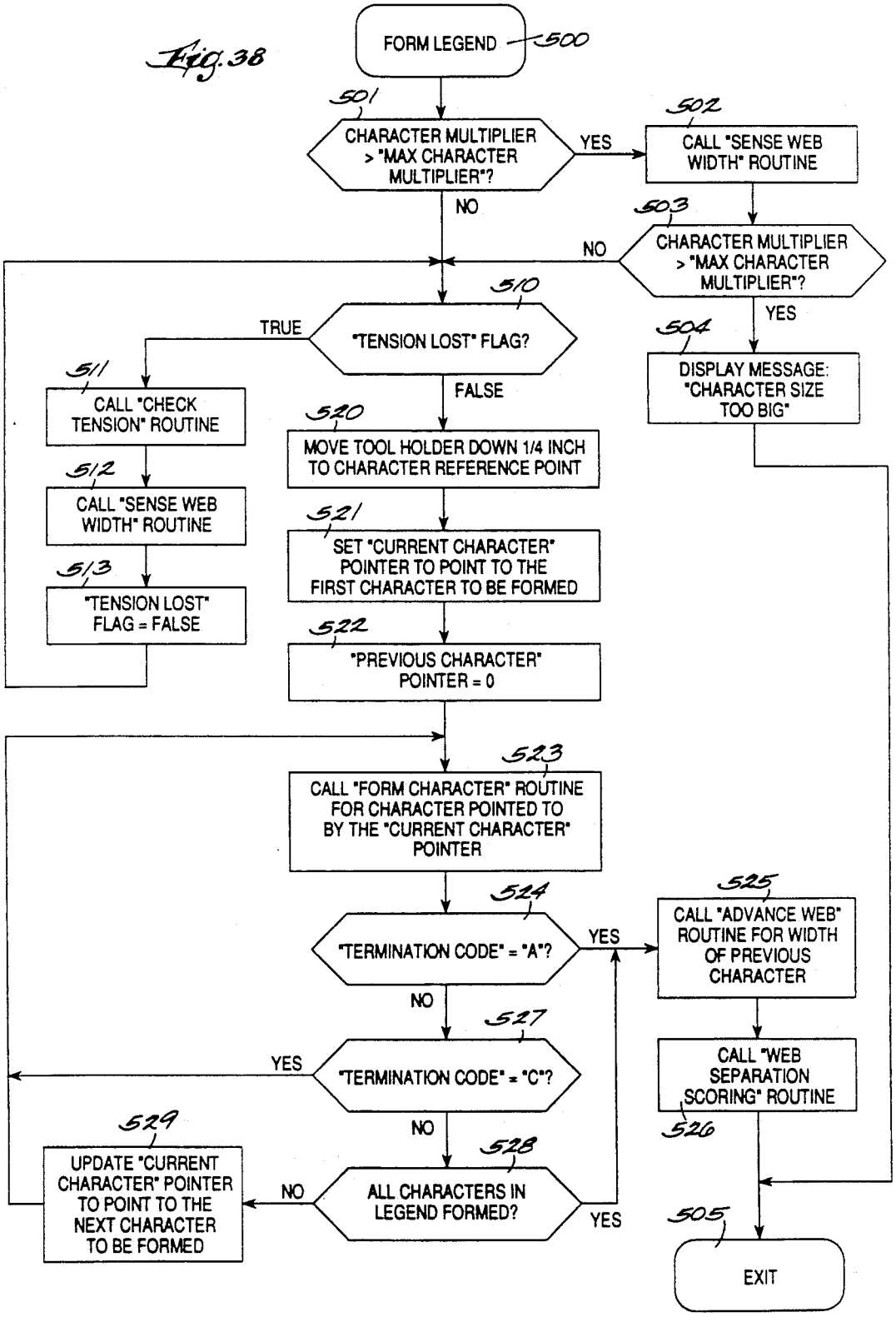
Fig. 38
FORM LEGEND
500
501
CHARACTER MULTIPLIER > "MAX CHARACTER MULTIPLIER"?
YES
NO
502
CALL "SENSE WEB WIDTH" ROUTINE
503
CHARACTER MULTIPLIER > "MAX CHARACTER MULTIPLIER"?
NO
YES
504
DISPLAY MESSAGE: "CHARACTER SIZE TOO BIG"
510
"TENSION LOST" FLAG?
TRUE
FALSE
511
CALL "CHECK TENSION" ROUTINE
512
CALL "SENSE WEB WIDTH" ROUTINE
513
"TENSION LOST" FLAG = FALSE
520
MOVE TOOL HOLDER DOWN 1/4 INCH TO CHARACTER REFERENCE POINT
521
SET "CURRENT CHARACTER" POINTER TO POINT TO THE FIRST CHARACTER TO BE FORMED
522
"PREVIOUS CHARACTER" POINTER = 0
523
CALL "FORM CHARACTER" ROUTINE FOR CHARACTER POINTED TO BY THE "CURRENT CHARACTER" POINTER
524
"TERMINATION CODE" = "A"?
YES
NO
525
CALL "ADVANCE WEB" ROUTINE FOR WIDTH OF PREVIOUS CHARACTER
526
CALL "WEB SEPARATION SCORING" ROUTINE
527
"TERMINATION CODE" = "C"?
YES
NO
528
ALL CHARACTERS IN LEGEND FORMED?
NO
YES
529
UPDATE "CURRENT CHARACTER" POINTER TO POINT TO THE NEXT CHARACTER TO BE FORMED
505
EXIT

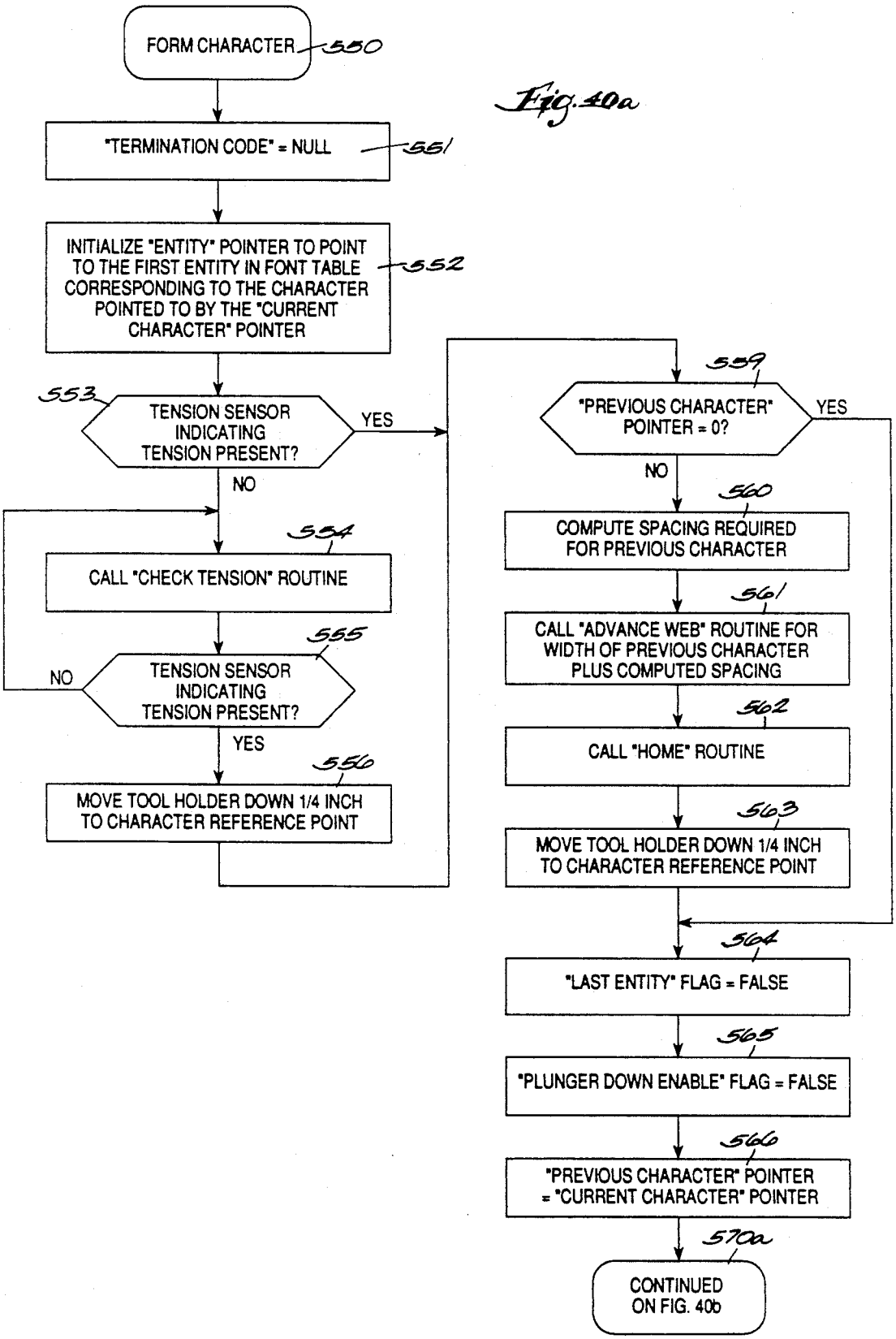
FORM CHARACTER
550
Fig. 40a
"TERMINATION CODE" = NULL
551
INITIALIZE "ENTITY" POINTER TO POINT TO THE FIRST ENTITY IN FONT TABLE CORRESPONDING TO THE CHARACTER POINTED TO BY THE "CURRENT CHARACTER" POINTER
552
553
TENSION SENSOR INDICATING TENSION PRESENT?
YES
NO
554
CALL "CHECK TENSION" ROUTINE
555
TENSION SENSOR INDICATING TENSION PRESENT?
NO
YES
556
MOVE TOOL HOLDER DOWN 1/4 INCH TO CHARACTER REFERENCE POINT
559
"PREVIOUS CHARACTER" POINTER = 0?
YES
NO
560
COMPUTE SPACING REQUIRED FOR PREVIOUS CHARACTER
561
CALL "ADVANCE WEB" ROUTINE FOR WIDTH OF PREVIOUS CHARACTER PLUS COMPUTED SPACING
562
CALL "HOME" ROUTINE
563
MOVE TOOL HOLDER DOWN 1/4 INCH TO CHARACTER REFERENCE POINT
564
"LAST ENTITY" FLAG = FALSE
565
"PLUNGER DOWN ENABLE" FLAG = FALSE
566
"PREVIOUS CHARACTER" POINTER = "CURRENT CHARACTER" POINTER
570a
CONTINUED ON FIG. 40b

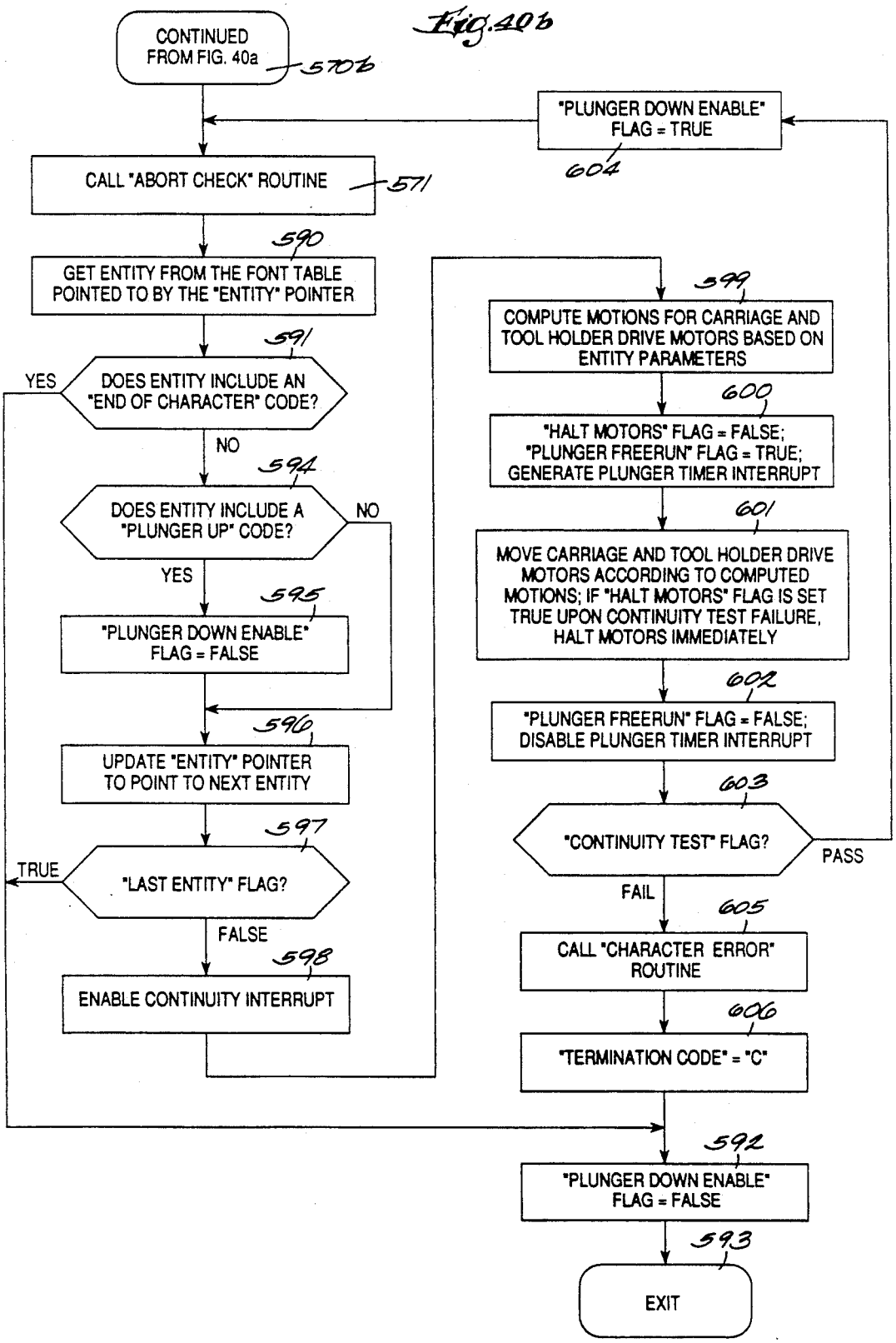
Fig. 40b
CONTINUED FROM FIG. 40a
570b
CALL "ABORT CHECK" ROUTINE
571
590
GET ENTITY FROM THE FONT TABLE POINTED TO BY THE "ENTITY" POINTER
591
DOES ENTITY INCLUDE AN "END OF CHARACTER" CODE?
YES
NO
594
DOES ENTITY INCLUDE A "PLUNGER UP" CODE?
NO
YES
595
"PLUNGER DOWN ENABLE" FLAG = FALSE
596
UPDATE "ENTITY" POINTER TO POINT TO NEXT ENTITY
597
"LAST ENTITY" FLAG?
TRUE
FALSE
598
ENABLE CONTINUITY INTERRUPT
599
COMPUTE MOTIONS FOR CARRIAGE AND TOOL HOLDER DRIVE MOTORS BASED ON ENTITY PARAMETERS
600
"HALT MOTORS" FLAG = FALSE; "PLUNGER FREERUN" FLAG = TRUE; GENERATE PLUNGER TIMER INTERRUPT
601
MOVE CARRIAGE AND TOOL HOLDER DRIVE MOTORS ACCORDING TO COMPUTED MOTIONS; IF "HALT MOTORS" FLAG IS SET TRUE UPON CONTINUITY TEST FAILURE, HALT MOTORS IMMEDIATELY
602
"PLUNGER FREERUN" FLAG = FALSE; DISABLE PLUNGER TIMER INTERRUPT
603
"CONTINUITY TEST" FLAG?
PASS
FAIL
605
CALL "CHARACTER ERROR" ROUTINE
606
"TERMINATION CODE" = "C"
604
"PLUNGER DOWN ENABLE" FLAG = TRUE
592
"PLUNGER DOWN ENABLE" FLAG = FALSE
593
EXIT ABORT CHECK
571
575
EXIT/STOP KEY DEPRESSED?
NO
YES
577
EXIT/STOP KEY RELEASED?
NO
YES
DISPLAY OPTIONS; READ AND DECODE KEYBOARD ENTRY
OTHER
"CUT" KEY
580
"EXIT/STOP" KEY
DISPLAY MESSAGE: "ABORT LEGEND?"
581
582
READ AND DECODE KEYBOARD ENTRY
OTHER
"Y"
"N"
583
"TERMINATION CODE" = "A"
584
"LAST ENTITY" FLAG = TRUE
576
EXIT

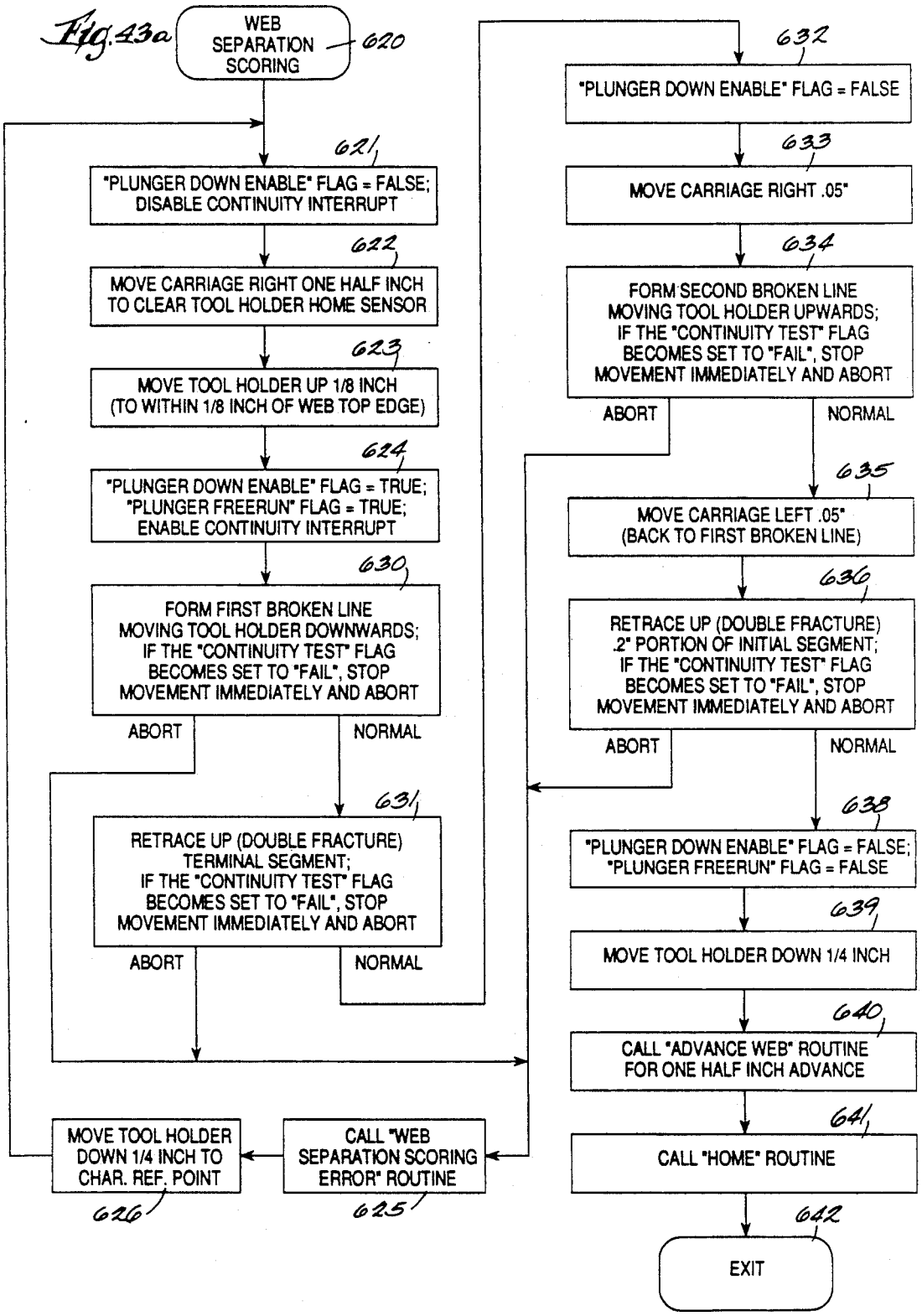
Fig. 43a
WEB SEPARATION SCORING
620
621
"PLUNGER DOWN ENABLE" FLAG = FALSE; DISABLE CONTINUITY INTERRUPT
622
MOVE CARRIAGE RIGHT ONE HALF INCH TO CLEAR TOOL HOLDER HOME SENSOR
623
MOVE TOOL HOLDER UP 1/8 INCH (TO WITHIN 1/8 INCH OF WEB TOP EDGE)
624
"PLUNGER DOWN ENABLE" FLAG = TRUE; "PLUNGER FREERUN" FLAG = TRUE; ENABLE CONTINUITY INTERRUPT
630
FORM FIRST BROKEN LINE MOVING TOOL HOLDER DOWNWARDS; IF THE "CONTINUITY TEST" FLAG BECOMES SET TO "FAIL", STOP MOVEMENT IMMEDIATELY AND ABORT
ABORT
NORMAL
631
RETRACE UP (DOUBLE FRACTURE) TERMINAL SEGMENT; IF THE "CONTINUITY TEST" FLAG BECOMES SET TO "FAIL", STOP MOVEMENT IMMEDIATELY AND ABORT
ABORT
NORMAL
632
"PLUNGER DOWN ENABLE" FLAG = FALSE
633
MOVE CARRIAGE RIGHT .05"
634
FORM SECOND BROKEN LINE MOVING TOOL HOLDER UPWARDS; IF THE "CONTINUITY TEST" FLAG BECOMES SET TO "FAIL", STOP MOVEMENT IMMEDIATELY AND ABORT
ABORT
NORMAL
635
MOVE CARRIAGE LEFT .05" (BACK TO FIRST BROKEN LINE)
636
RETRACE UP (DOUBLE FRACTURE) .2" PORTION OF INITIAL SEGMENT; IF THE "CONTINUITY TEST" FLAG BECOMES SET TO "FAIL", STOP MOVEMENT IMMEDIATELY AND ABORT
ABORT
NORMAL
638
"PLUNGER DOWN ENABLE" FLAG = FALSE; "PLUNGER FREERUN" FLAG = FALSE
639
MOVE TOOL HOLDER DOWN 1/4 INCH
640
CALL "ADVANCE WEB" ROUTINE FOR ONE HALF INCH ADVANCE
641
CALL "HOME" ROUTINE
642
EXIT
CALL "WEB SEPARATION SCORING ERROR" ROUTINE
625
MOVE TOOL HOLDER DOWN 1/4 INCH TO CHAR. REF. POINT
626

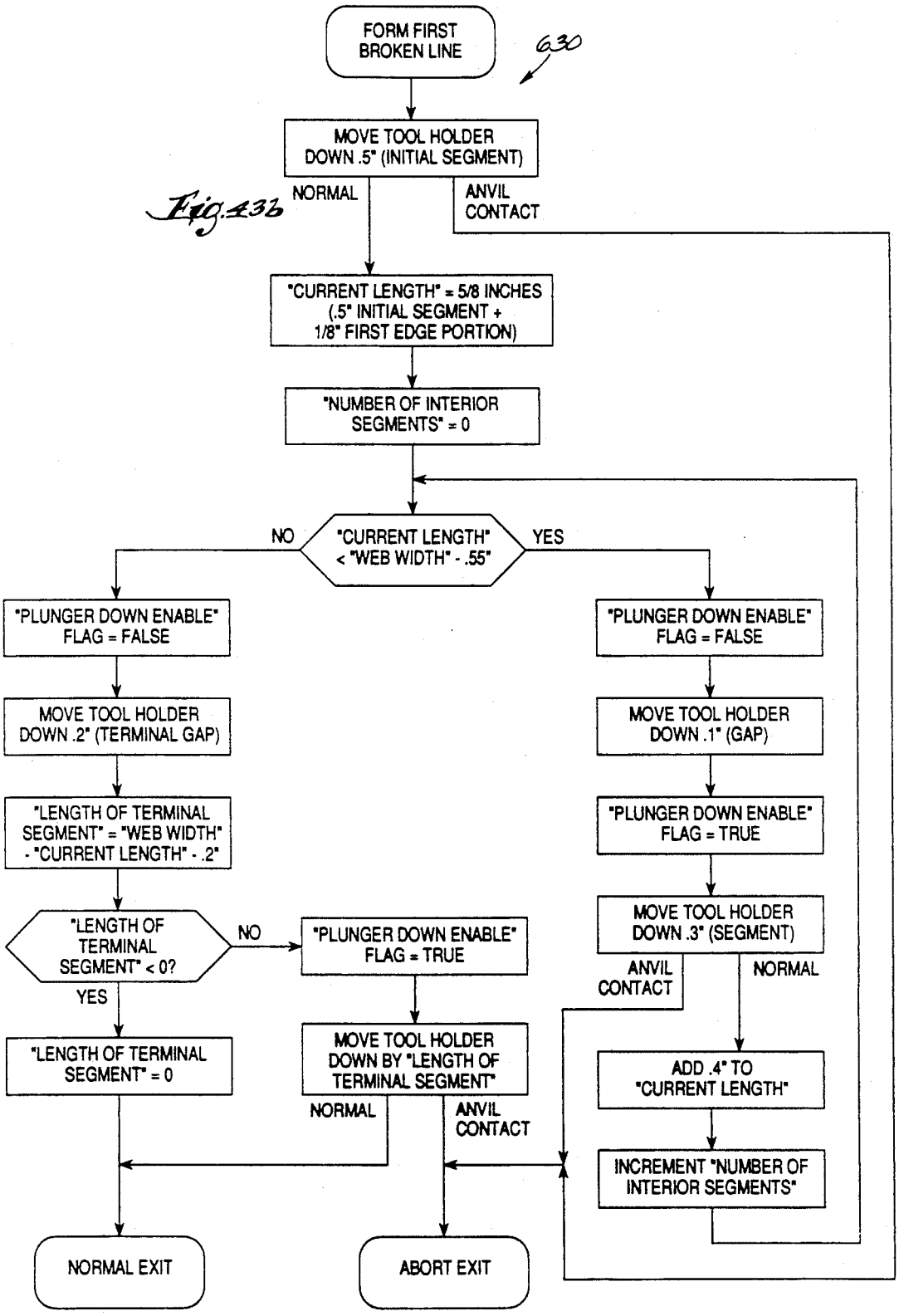
FORM FIRST BROKEN LINE
630
MOVE TOOL HOLDER DOWN .5" (INITIAL SEGMENT)
NORMAL
ANVIL CONTACT
Fig. 43b
"CURRENT LENGTH" = 5/8 INCHES (.5" INITIAL SEGMENT + 1/8" FIRST EDGE PORTION)
"NUMBER OF INTERIOR SEGMENTS" = 0
"CURRENT LENGTH" < "WEB WIDTH" - .55"
NO
YES
"PLUNGER DOWN ENABLE" FLAG = FALSE
MOVE TOOL HOLDER DOWN .2" (TERMINAL GAP)
"LENGTH OF TERMINAL SEGMENT" = "WEB WIDTH" - "CURRENT LENGTH" - .2"
"LENGTH OF TERMINAL SEGMENT" < 0?
NO
YES
"PLUNGER DOWN ENABLE" FLAG = TRUE
"LENGTH OF TERMINAL SEGMENT" = 0
MOVE TOOL HOLDER DOWN BY "LENGTH OF TERMINAL SEGMENT"
NORMAL
ANVIL CONTACT
"PLUNGER DOWN ENABLE" FLAG = FALSE
MOVE TOOL HOLDER DOWN .1" (GAP)
"PLUNGER DOWN ENABLE" FLAG = TRUE
MOVE TOOL HOLDER DOWN .3" (SEGMENT)
ANVIL CONTACT
NORMAL
ADD .4" TO "CURRENT LENGTH"
INCREMENT "NUMBER OF INTERIOR SEGMENTS"
NORMAL EXIT
ABORT EXIT FORM SECOND BROKEN LINE
634
"SEGMENT COUNT" = 0
"SEGMENT COUNT" < "NUMBER OF INTERIOR SEGMENTS" + 1
NO
YES
"PLUNGER DOWN ENABLE" FLAG = TRUE
MOVE TOOL HOLDER UP .3" (SEGMENT)
ANVIL CONTACT
NORMAL
"PLUNGER DOWN ENABLE" FLAG = FALSE
MOVE TOOL HOLDER UP .1" (GAP)
INCREMENT "NUMBER OF INTERIOR SEGMENTS"
NORMAL EXIT
ABORT EXIT

SIGNMAKING MACHINE USING CHARACTER FORMING TOOL FOR OVERLAPPING IMPACTS AND WEB SCORING

TECHNICAL FIELD

The present invention relates to the art of producing signs having one or more characters, such as letters, numbers, symbols, designs, etc., from sheet materials that have a layer of pressure sensitive adhesive by which the finished sign is to be adhered to the surface of an object.

BACKGROUND ART

Various types of sheet materials, such as plastic films, that have a layer of pressure sensitive adhesive on one surface are and have been in widespread use for the manufacture of signs for use in the identification art. The signs may consist of letters, numbers, symbols, or designs, etc., including combinations thereof, as required to convey the desired information. Signs made of pressure sensitive adhesive sheet materials can be divided into two broad categories: the sheet material is printed with the selected characters or the sheet material is configured in the shape of the selected information. The present invention relates to novel signmaking apparatus and methods for producing signs of the latter category from pressure sensitive adhesive sheet materials.

Adhesive sheet materials of the type involved in the present invention are releasably adhered to a liner which serves to cover and protect the adhesive layer during formation of a sign and until application of the sign to an object. Signs are made by cutting the selected characters in the sheet while mounted on the liner and then stripping the waste materials surrounding the legend, following which the sign is ready for application.

There are three categories of cutting systems, or methods, now used to cut characters from adhesive sheet materials in order to produce signs: (1) crush cutting, (2) knife or razor cutting, and (3) shear cutting.

The use of dies having raised cutting edges in the shape of characters or a set of characters for signs is an example of the crush cutting method of sign formation. See for example U.S. Pat. No. 3,465,627 (Vingneault, 1969) and U.S. Pat. 3,826,167 (Pelet et al., 1974). While die cutting can be used to produce signs with a legend having multiple characters, this is not generally practical because of the expense of producing a die for each legend. Therefore, die cutting most often is used to cut individual liner mounted characters, which are later combined or aligned to develop a selected legend for the sign. The dies can be brought into direct contact with the sheet material so that their cutting edges penetrate through the material to the liner upon actuation. Another type of die cutting involves indirect cutting of the sheet material and employs a flexible film over the adhesive sheet material which is to be cut; the die contacts the flexible film and the force is transmitted through the flexible film to cut the underlying sheet material even though the die does not directly contact or penetrate the sheet material. This technique is shown, for example, in U.S. Pat. No. 3,490,362 (Massari, 1970), U.S. Pat. No. 4,014,257 (Bettenhausen, 1977); U.S. Pat. No. 4,604,153 (Melbye, 1986); and U.S. Pat. No. 4,867,056 (Anderson et al., 1989).

U.S. Pat. Nos. 3,826,167, 4,014,257 and 4,867,056 cited above disclose machines for die cutting a sign from pressure sensitive sheet material that have legends formed of a plurality of characters. However, the machines of these patents utilize a separate die for each individual character (e.g. letter) in the sign, one character is die cut at a time, and thereafter a new die must be inserted in the machine to cut the next character. These patents demonstrate the impracticality of die cutting as a method for producing a sign having a plurality of characters from pressure sensitive adhesive sheet materials.

The more recent availability and development of microprocessor controlled X-Y plotters has provided an alternative means for producing signs from pressure sensitive adhesive sheet materials. Plotters for cutting adhesive sheet materials have been sold commercially by a number of companies, including ESAB Automation, Inc., Sign-Tronic USA Inc., Gerber Scientific and Sungraf Automated Systems. This type of machine is also disclosed in a number of patents, a representative listing of which is as follows:

U.S. Pat. No. 4,367,588 (Herbert, 1983),
U.S. Pat. No. 4,467,525 (Logan et al., 1984),
U.S. Pat. No. 4,512,839 (Gerber, 1985)
U.S. Pat. No. 4,608,891 (Frisby et al., 1986),
U.S. Pat. No. 4,732,069 (Wood et al., 1988), and
U.S. Pat. No. 4,794,542 (Procter et al., 1988)

The plotter-type signmaking machines disclosed in the above patents use the knife or razor cutting technique to form signs from adhesive sheet materials. Thus, all of the above patents disclose a knife that cuts through the adhesive sheet material. The knife is supported in a vertical position on a carriage that is driven to travel in the cross machine, or Y-axis, direction. The sheet material generally is advanced in the machine direction, or X-axis, as it is being cut to form the characters of a sign. Also, the knife often is rotatable about a vertical, or $\theta$, axis as the sheet material is being cut. Thus, the prior art machines described in these patents employ a mechanism for moving the cutting knife in the cross machine direction and a second mechanism for driving the sheet material in the machine direction, together with a system for rotating the cutting knife about the $\theta$ axis, while cutting the sheet material in order to develop a sign of the selected configuration.

Other features of the above plotter-type signmaking machines include their use of a stationary anvil in association with the knife for cutting the sheet material. The anvil is a large stationary flat plate with an x-y mechanism in some machines and a rotating shaft in other machines. The prior art machines of the subject type also are generally designed for use with adhesive sheet material that has feed holes along its longitudinal edges and thus incorporate various types of sprocket drive mechanisms for advancing the sheet material through the machines.

The nature of the plotter type signmaking machines as taught by the prior art is such that these machines are generally large machines having various mechanical elements accurately supported in a substantial or heavy frame. For example, the components employed for feeding sheet material through the machines and accurately positioning the various mechanical elements relative to one another result in large bench or floor mounted machines. The cutting mechanisms and other components associated with this type of prior art signmaking machines also have imposed high power requirements. The plotter type signmaking machines taught by the patents listed above and the commercially available machines, therefore, are relatively expensive large machines that are suitable only for use at a fixed location. While some large companies can install such a machine at a fixed location in their plants, small and medium sized companies often must order signs from other companies that have the appropriate equipment and specialize in signmaking.

SUMMARY OF THE INVENTION

Our present invention provides a portable signmaking machine which is adapted to form legends, generally consisting of a plurality of characters or other symbols, from adhesive sheet material. The machine includes a character forming mechanism adapted for transport along an X-axis and Y-axis, means for advancing adhesive sheet material through the machine, memory means storing a program of instructions for reading designated input and controlling the character forming mechanism to form a selected sign in the adhesive sheet material, and microprocessor means responsive to the program of instructions and interfaced to control character formation. Our invention provides a new character forming mechanism in a signmaking machine of the foregoing type comprising a plunger and means for moving and means for reciprocatingly driving the plunger to generate a plurality of overlapping impacts which form continuous cut edges of the characters. In another aspect, the present invention provides a new character forming mechanism of the foregoing type in which the means for driving the plunger comprises a dual-acting solenoid. Other aspects of the invention relate to novel structure for supporting a character forming mechanism in a signmaking machine, a novel stepper motor arrangement for transporting a character forming mechanism and advancing adhesive sheet material, a novel anvil arrangement in a signmaking machine, and a machine structure that is particularly suitable for a portable signmaking machine. These and other new and useful features of the present invention are fully described in the detailed description presented below in this specification.

DESCRIPTION OF THE DRAWINGS

The full and enabling description of the invention that follows is made by reference to the accompanying drawings illustrating our presently-contemplated best mode for carrying out the invention in which:

FIG. 2 is a plan view of the keyboard of the machine;

FIG. 4 is a vertical sectional view along the plane of line 4—4 of FIG. 3;

FIG. 27 is an electrical schematic diagram of the machine of FIG. 1;

FIG. 28 is a flow chart of an "initialization" routine;

FIG. 32 is a flow chart of a "plunger depth test" routine;

FIG. 37 is a flow chart of a "sense web width" routine;

FIG. 38 is a flow chart of a "form legend" routine;

FIG. 40*a* is a flow chart of the first section of a "form character" routine;

FIG. 40*b* is a flow chart of the second section of the "form character" routine;

FIG. 43*a* is a flow chart for the WEB SEPARATION SCORING routine which is called by the FORM LEGEND routine of FIG. 38;

FIG. 43*b* is a flow chart for the FORM FIRST BROKEN LINE routine which forms a part of the WEB SEPARATION SCORING routine of FIG. 43*a*;

DESCRIPTION OF PRESENTLY-PREFERRED EMBODIMENTS

The following detailed description presents a presently-preferred embodiment of a signmaking apparatus of our invention. The description is organized in several sections according to the following outline:

(a) General Machine Description, FIGS. 1–4;
(b) Frame 20, FIGS. 5–11;
(c) Carriage 110, FIGS. 12–18;
(d) Advancement of Sheet Material, FIGS. 19–21;
(e) Character Forming Mechanism, FIGS. 22–26;
(f) Electrical Hardware Description, FIG. 27;
(g) Software Description, FIGS. 28–44;
(h) Sign Formation, FIGS. 45–49; and
(i) Separation of Sign, FIGS. 50–52
(j) Discussion.

(a) GENERAL MACHINE DESCRIPTION, FIGS. 1–4

Figure 1:
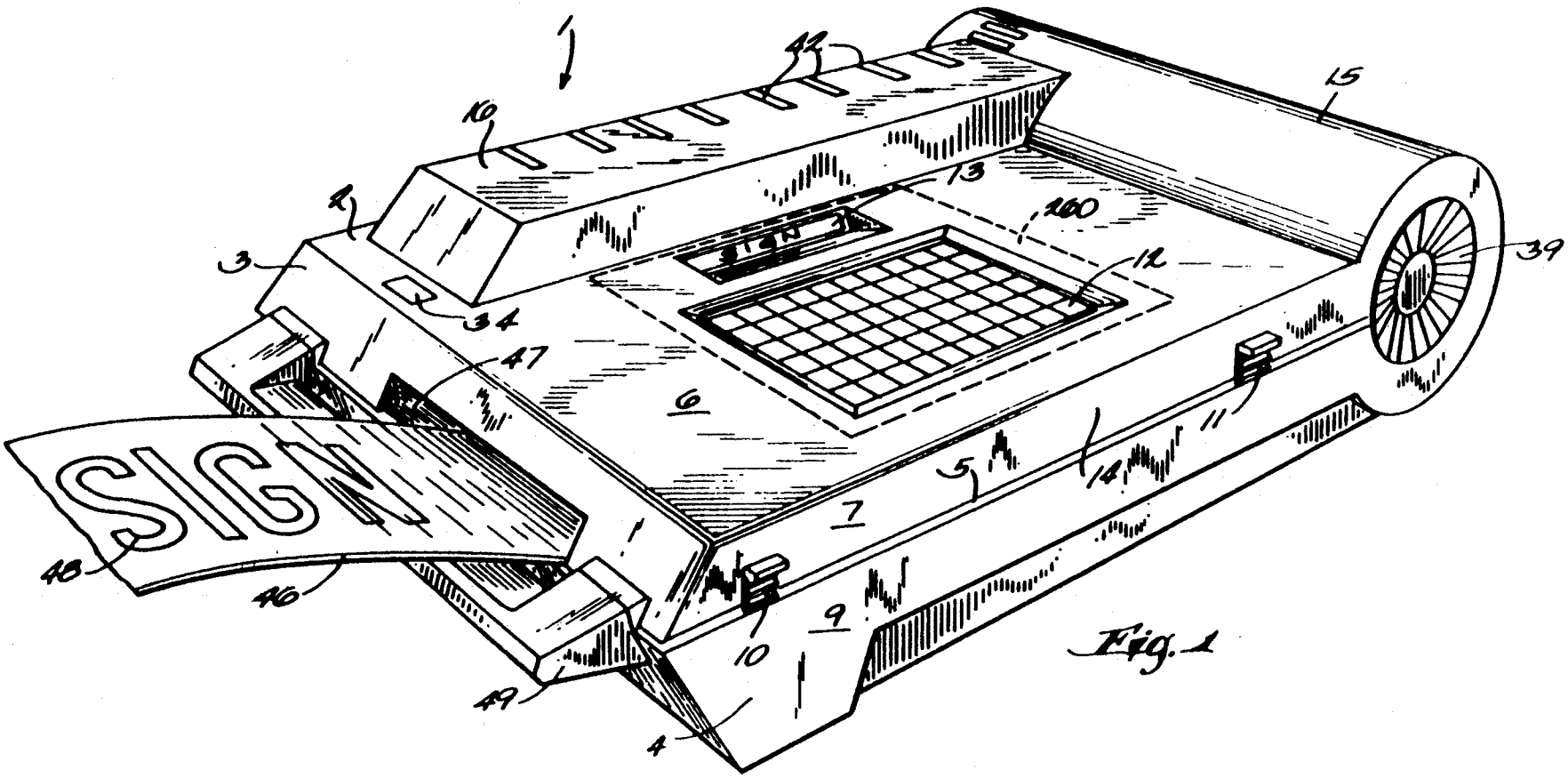
FIG. 1 is a perspective view of a signmaking machine of the invention with its housing closed.

FIG. 1 illustrates an exemplary machine 1 of the present invention comprising a generally rectangular housing 2, made of molded plastic in the preferred embodiment, that houses and supports the various elements of the machine. The housing has a cover or top member 3 hinged along the back of a bottom or base member 4 and the two members separate from one another along a peripheral lip 5. The cover 3 has a top panel 6 surrounded by a side wall 7 and base member 4 has a bottom panel 8 (not visible in FIG. 1, see FIG. 3) surrounded by a side wall 9; the cover 3 and base member 4 are both three dimensional so that selected components can be located in each. Latches 10 and 11 lock the cover and bottom members 3 and 4 together when the housing is closed. The side of the housing on which the latches are located is referred to as the front of the machine 1 in this description. A keyboard 12 and a liquid crystal display 13 (positioned just above the keyboard) are both secured to the interior of top panel 6 of cover 3. As shown in detail in FIG. 2, the keyboard 12 has a set of alphanumeric keys for the letters A–Z and numbers 014 9 and a set of keys with special symbols such as punctuation marks, "$" and "#" and other symbols. These keys are surrounded by dashed line 12*a* and each designates a character or symbol that can be included in a sign made with machine 1; note that some keys can selectively designate two characters. The keyboard also includes a set of function keys which are surrounded by dashed line 12*b* in FIG. 2. An operator programs the content of the signs to be made with the machine 1 by using the keyboard in the manner similar to that employed for other types of microprocessor controlled apparatus. The programming operation is performed on a menu driven basis, such as is well known in the art, whereby the operator is provided instructions in the form of menus or prompts on the display 13 and responds by pressing the appropriate key or keys to choose a menu selection. The function keys are used to assist in programming a selected sign legend. An INSERT key is included to change the editing mode. A DELETE key allows characters at the cursor position to be deleted. A set of cursor arrows including a left arrow and right arrow allow the cursor to be positioned within the display 13. A MENU key is provided to enable the main menu to be called up on the display, and the cursor can be moved to make a specific selection from the menu. An ENTER key is used to enter a legend for a sign in the memory associated with the machine after it has been fully composed. The ENTER key also is used to select menu items. A FEED key advances sheet material into position for the selected legend to be defined in the sheet material, and a CUT key is actuated to form the legend in the material. A REVIEW/EDIT key allows the operator to view a list of sign legends, and the ERASE key is used to remove a legend from a list. An EXIT/STOP key is actuated to exit a menu or stop the cutting of sheet material. The LOAD/UNLOAD key is used to facilitate loading of sheet material in the machine by moving a carriage (described later in this specification) to a selected position in the machine. The CAP LOCK key selects upper case letters when used. Thus, in order to make a sign with the machine 1, the operator actuates selected letter, number and/or symbol keys and function keys as appropriate to thereby program the selected legend in the memory of the machine.

The housing 2 includes three principal inner compartments, a processing compartment 14, a sheet material supply compartment 15 and a motor compartment 16.

Figure 3:
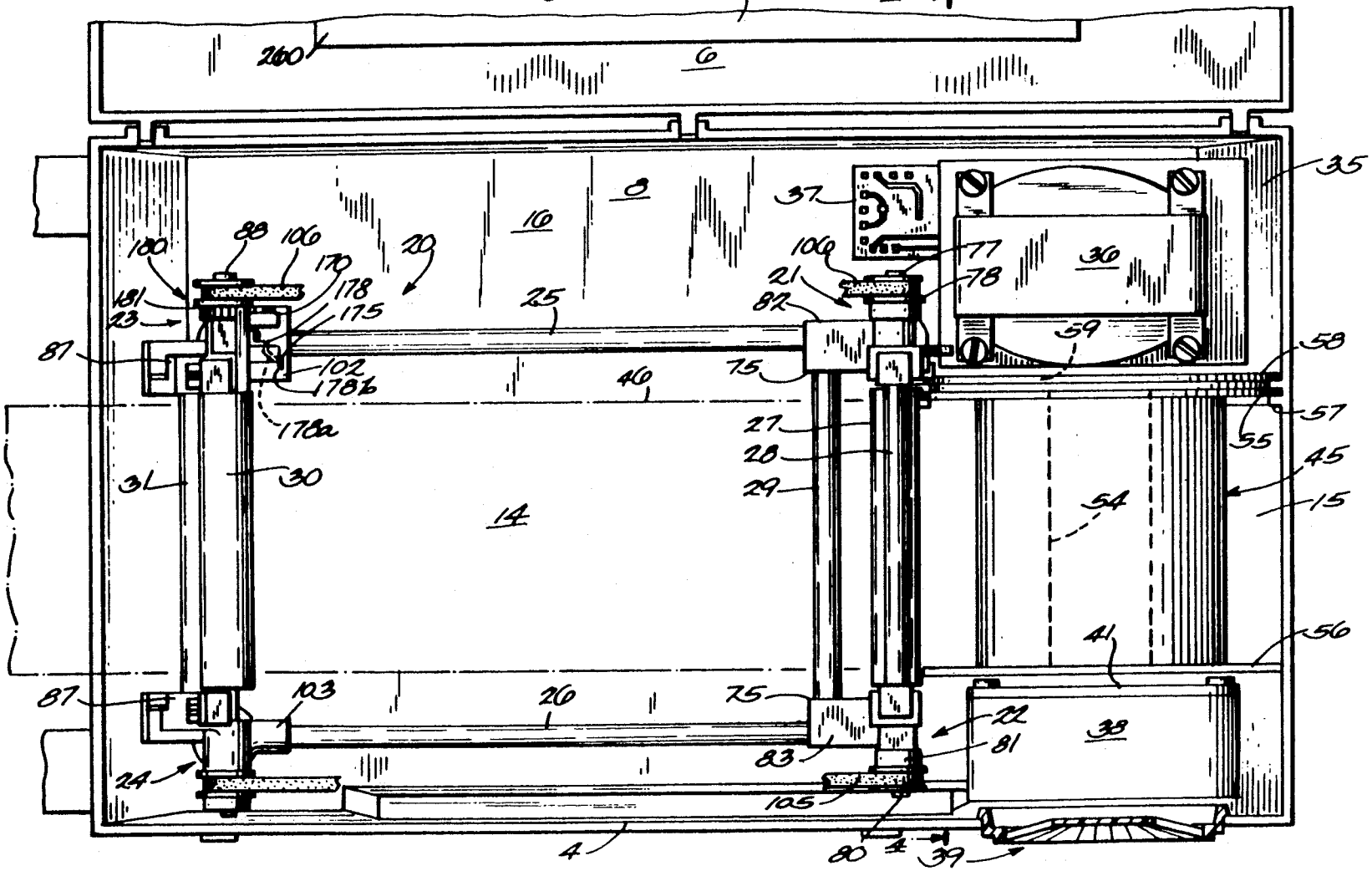
FIG. 3 is a plan view of the base member of the housing of the machine illustrating some of the components located in the base member.

FIG. 3 is a plan view of housing 2 when opened which illustrates some of the components in base member 4 of the housing. A frame 20 is located in the processing compartment 14 of the housing and includes corner posts 21–24 which are attached to bottom panel 8 of the base member, such as with screws, in order to fix the frame in place inside the housing. Frame 20 includes a slide shaft 25 supported between corner posts 21 and 23 and a slide shaft 26 that is supported between corner posts 22 and 24. An infeed roller 27, infeed nip roller 28 and a guide roller 29 are journaled between corner posts 21 and 22; rollers 27 and 28 form a nip through which adhesive sheet material will be fed for processing. An outfeed roller 30 and outfeed nip roller 31 are journaled between corner posts 23 and 24 and form a nip for pulling sheet material through the machine for processing. Frame 20 supports several mechanical and electrical elements that are used to define a sign in adhesive sheet material, all as described in detail later in this description and illustrated in other drawings.

An AC power supply 35 is located at the back of supply compartment 15 and is to be connected to an appropriate source of AC voltage, e.g. 120 volts in the U.S. or 220 volts or other voltage as used in other countries. A power cord, not shown, is connected to the power supply 35 for this purpose, and switch 34 on the top of the machine (FIG. 1) is used to turn the power on and off.

The power supply includes a transformer 36 for stepping down the AC source voltage to reduced AC voltages on a plurality of secondary windings. A circuit board 37 is associated with the power supply that supports components for converting the reduced secondary AC voltages to DC voltages required for operating the machine; also, connections to the various electrically driven components described below are made at the circuit board. A cover, not shown, is secured inside the housing over the power supply and circuit board. Wires connecting the electrically driven components described below to circuit board 37 are not shown in the drawings for clarity of description, but appropriate wiring will be apparent to those conversant with this art.

A fan 38 is in the front of supply compartment 15 for drawing cooling air through opening 39 in the housing (see also FIG. 1) and circulating the air through the interior of the housing. A voltage regulator 40, visible in FIG. 4, is secured to the bottom of the fan to control the output current from the power supply at 24 volts DC, and a heat sink 41 for the voltage regulator is attached to the front of the fan. The machine 1 consumes about 100 watts of power during signmaking operations, hence the necessity for internal cooling. The cooling air exits the housing through vents 42 formed along the top of cover 3 and through slot 47, which are shown in FIG. 1.

A roll 45 of pressure sensitive sheet material 46 is supported in supply compartment 15 between the power supply and the fan. The sheet material is advanced through the processing compartment by elements supported on frame 20 and, refer now to FIG. 1, exits housing 2 through slot 47 in cover member 3 of the housing after a selected sign 48 has been formed in the web of sheet material.

The sectional view of FIG. 4 provides additional details of supply compartment 15 of machine 1 and the relationship between the several components located in the compartment.

Transformer 36 is mounted on circuit board 37, which is secured to vertical posts 50 formed as integral portions of the molded housing 2. Fan 38 is held in place by screws extending through posts 51 which also are molded as part of the housing.

The roll 45 of pressure sensitive sheet material 46 includes a hollow core 54, a flange 55 on one end of the core and flange 56 on the other end of the core. The web of sheet material 46 is wound onto core 54. The lower part of the outer edge of flange 55 fits snugly in a C-shaped arcuate channel 57 molded as part of base member 4 of the housing. The arrangement of flange 55 and channel 57 provides for accurate cross-machine location of the roll 45 in the machine 1 and is a novel use of a single flange of the supply roll to obtain sheet material registration with a minimum of structure and no operating elements that require power. Channel 57 abuts a semicircular wall 58 molded as part of base member 4 that includes a central opening 59. Core 54 is hollow so that cooling air drawn into the housing by fan 38 can flow through axial opening 60 that extends through core 54 and flange 55 and through opening 59 in wall 58 to cool the power supply. This air circulation system achieves efficient cooling with minimum space requirements.

The manner in which the web of sheet material 46 is withdrawn from roll 45 and advanced through the machine for processing is described below in section (d) of this description.

The signmaking machine 1 is a portable machine and includes a handle 49 (FIG. 1) by which the machine can be carried to the site at which a sign is to be made. Another novel feature of a machine according to the present invention is that it can be embodied in a portable, lightweight signmaking machine of compact dimensions. For example, a developmental prototype machine of the invention has dimensions of about 10 inches (25 cm) wide by 18 inches (46 cm) long by about 5 inches (13 cm) high and weighs only about 16 pounds (7 kilograms).

(b) Frame 20, FIGS. 5–11

Structural details of the frame 20 are illustrated in FIGS. 5–11. Corner posts 21–24 are attached to bottom panel 8 of base member 4 of housing 2 and form the support elements for the frame.

Figure 6:
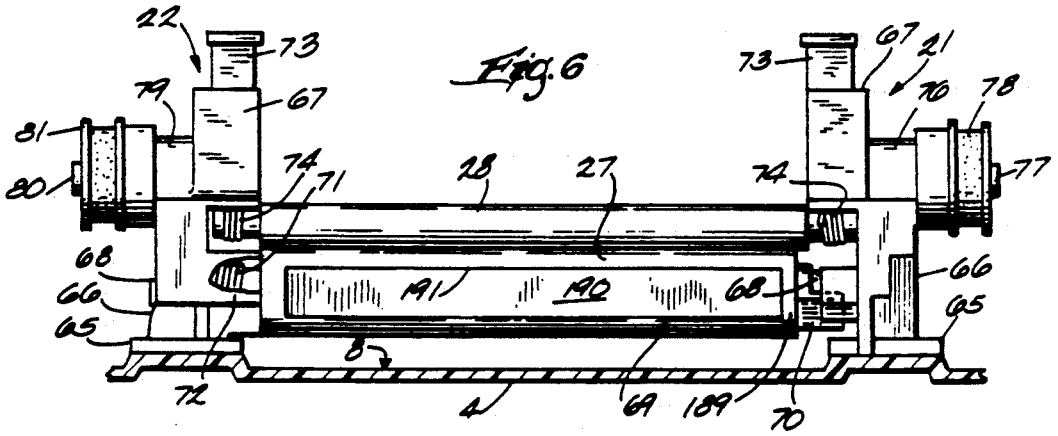
FIG. 6 is an end view of the infeed end of support frame 20.
Figure 8:
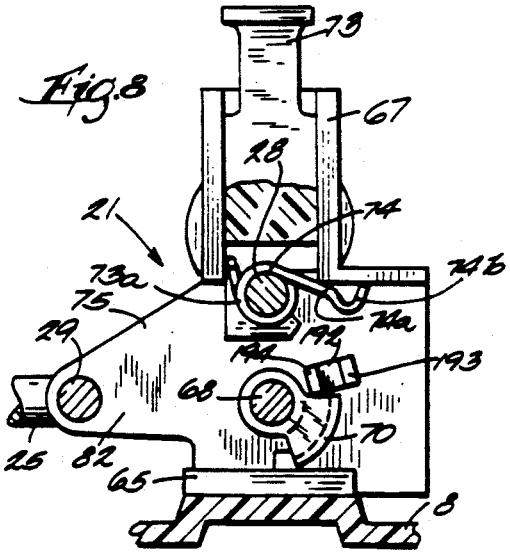
FIG. 8 is a vertical sectional view of corner post 21 of support frame 20.

Turning first to FIGS. 6 and 8, corner posts 21 and 22 each include a round base pad 65 that rests on bottom panel 8 of the housing, a pedestal 66 extending upwardly from pad 65 and a three-sided channel 67 extending vertically from the pedestal. The base pad 65 of each corner post, and corner posts 23 and 24, preferably rest on rubber pads, not shown, for isolating vibrations from housing 2. Infeed roller 27 is journaled between the pedestals of corner posts 21 and 22. Roller 27 includes a short center stub shaft 68 extending from each end of a larger diameter cylindrical central section 69. Roller 27 is a steel roller, and its central section 69 has a knurled or otherwise roughened outer surface to increase frictional contact with adhesive sheet material 46. Infeed roller 27 is journaled in self-aligning bearings in posts 21 and 22, there being a stub shaft 68 of the roller at each corner post, and in such fashion as to rotate about ¼ turn counterclockwise viewed from the front of the machine when a web of sheet material is advanced through the machine as will be explained later in this specification. A back tension spring 71 around stub shaft 68 near corner post 22 is arranged to apply a constant spring force to bias roller 27 in the clockwise direction. One end of spring 71 is anchored along an arm 72 formed as an element of the pedestal of corner post 22 and its other end is anchored to shaft 68. An arcuate position arm 70 is carried on stub shaft 68 of infeed roller 27 near corner post 21 and will form the movable element of an optical sensor system to be described later.

Figure 8A:
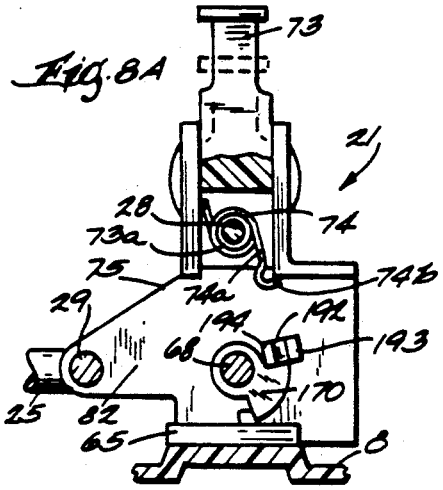
FIG. 8A is a vertical sectional view of corner post 21 with its slider in a raised position.

A vertical slider 73 is positioned in channel 67 of each corner post 21 and 22. Infeed nip roller 28 is journaled between the lower ends of sliders 73. Each end of nip roller 28 is supported in a bushing **73*a* mounted in each slider 73 as shown in FIG. 8 at corner post 21. A helical spring 74 extends about each bushing 73*a* and has one end anchored to a slider 73 and its other end anchored to the bottom of a channel 67 at each corner post. This arrangement is best shown in FIG. 8 with respect to corner post 21; the arrangement at corner post 22 is the same. The springs 74 at each end of nip roller 28 serve to bias the roller towards infeed roller 27 to apply pressure at the nip. Further, both sliders 73 are designed to be raised to lift nip roller 28 away from infeed roller a sufficient distance so as to enable a web of adhesive sheet material to be threaded between rollers 27 and 28. Slider 73 at corner post 21 is shown in its lowered position in FIG. 8 wherein nip roller 28 applies pressure at its line of contact with steel roller 69 of infeed roller 27. Slider 73 is shown in its raised position in FIG. 8A, to which it is raised manually, so as to lift nip roller 28 away from infeed roller and allow threading adhesive sheet material between it and central section 69 of the infeed roller; spring 74 is arranged to also hold nip roller 28 in its raised position until web threading is completed, following which the sliders are pushed downwards so that nip roller 28 again contacts infeed roller 27. With reference to FIG. 8A, arm 74***a* of spring 74 has an L-shaped end portion 74*b* that engages a corner of channel 67 as illustrated to prevent slider 73 from being pulled out of channel 67. Springs 74 are thus configured to perform two functions: biasing nip roller 28 towards infeed roller 27 in order to form a nip therebetween when slider 73 is in its lowered position and also hold slider 73 in its raised position when required.

Figure 5:
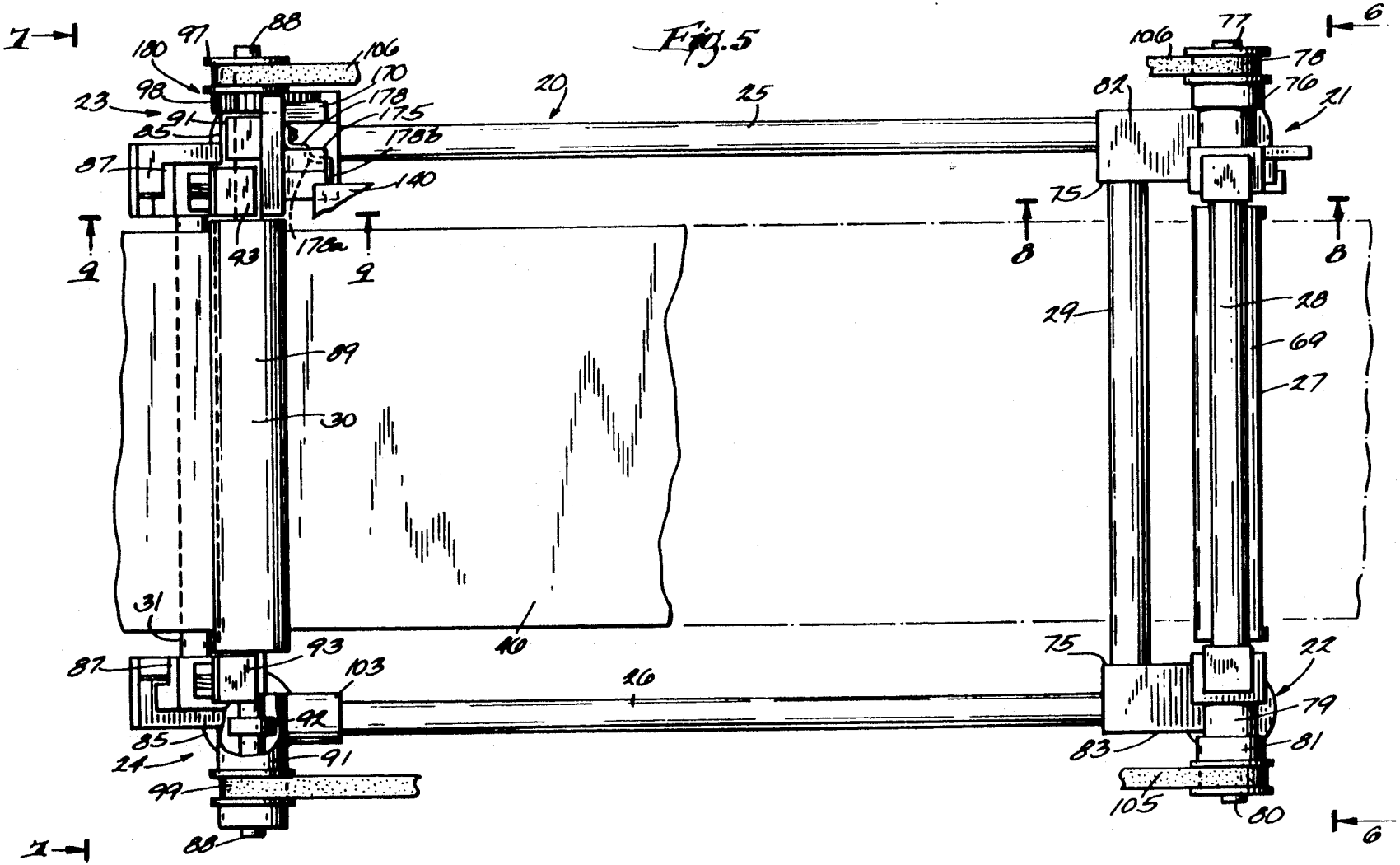
FIG. 5 is a plan view of support frame 20 of the machine, with a portion broken away.

As shown in FIG. 5, a panel 75 extends from corner post 21 and a similar panel 75 extends from corner post 22, both panels 75 extending in the machine direction. Guide roller 29 is journaled between panels 75 of corner posts 21 and 22. FIG. 8 illustrates panel 75 of corner post 21 in elevation; panel 75 of corner post 22 has the same configuration.

Returning to FIG. 6, hub 76 projects in the cross machine direction from channel 67 of corner post 21, and stub shaft 77 extends from the hub. A toothed idler pulley 78 rotates freely on stub shaft 77. In similar fashion, hub 79 projects from channel 67 of corner post 22, stub shaft 80 is fixed in and extends from hub 79, and toothed idler pulley 81 rotates freely on stub shaft 80.

Turning once again to FIG. 5, one end of slide shaft 25 is secured in hub 82 (see also FIG. 8) that projects in the machine direction from pedestal 66 of corner post 21. Similarly, one end of slide shaft 26 is secured in hub 83 that extends from pedestal 66 of corner post 22.

Corner posts 21 and 22 are most usefully made of molded plastic including base pad 65, pedestal 66, channel 67, panel 75, hub 76/79 and hub 82/83 as integral elements of a one piece unit.

Figure 7:
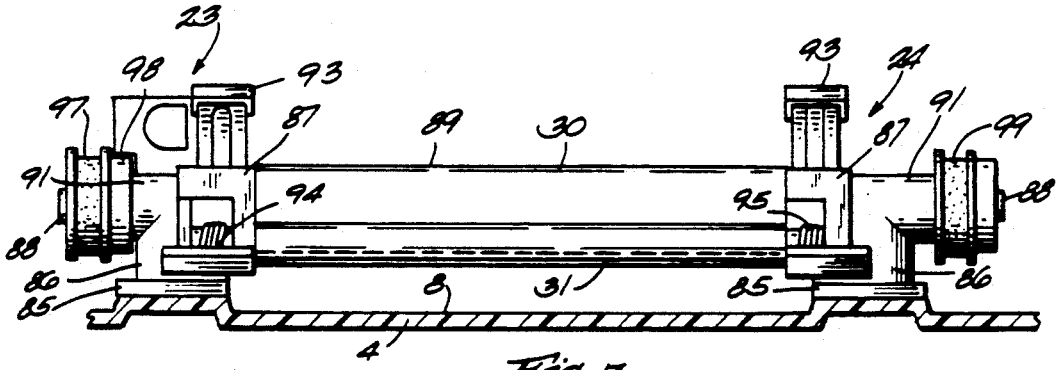
FIG. 7 is an end view of the outfeed end of support frame 20.
Figure 9:
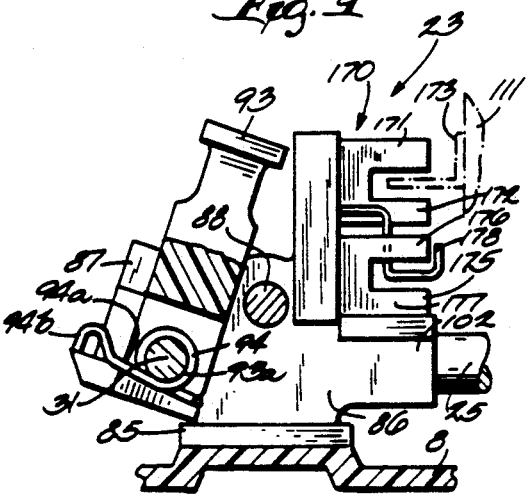
FIG. 9 is a vertical sectional view of corner post 23 of support frame 20.

FIG. 7 illustrates corner posts 23 and 24 in elevation with rollers 30 and 31 supported between the posts and FIG. 9 shows details of corner post 23, post 24 being generally similar in structure.

Figure 10:
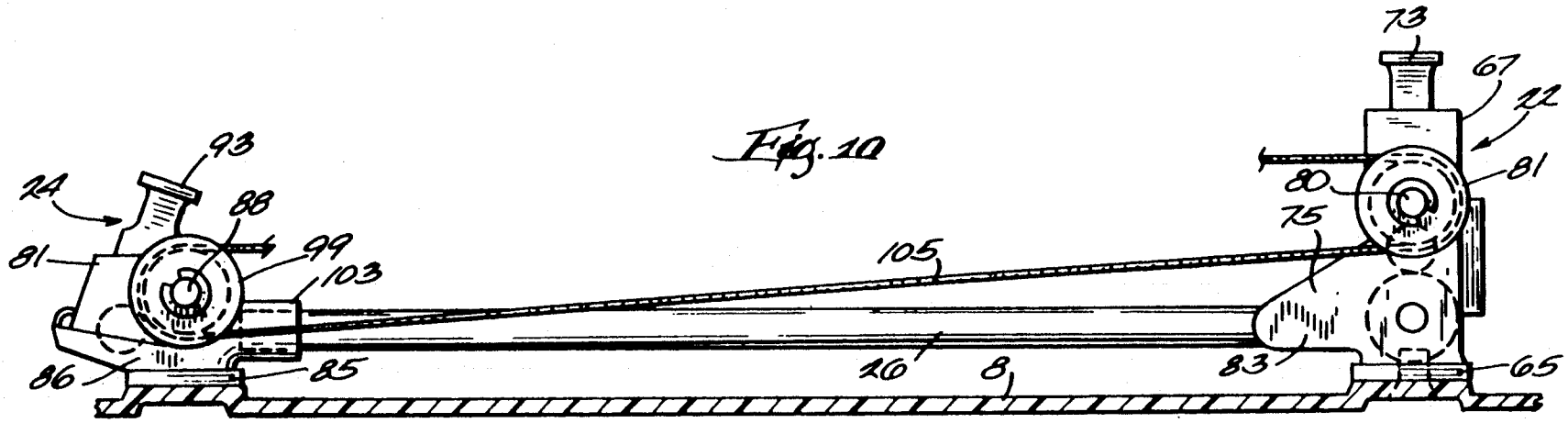
FIG. 10 is a side elevation of support frame 20.
Figure 11:
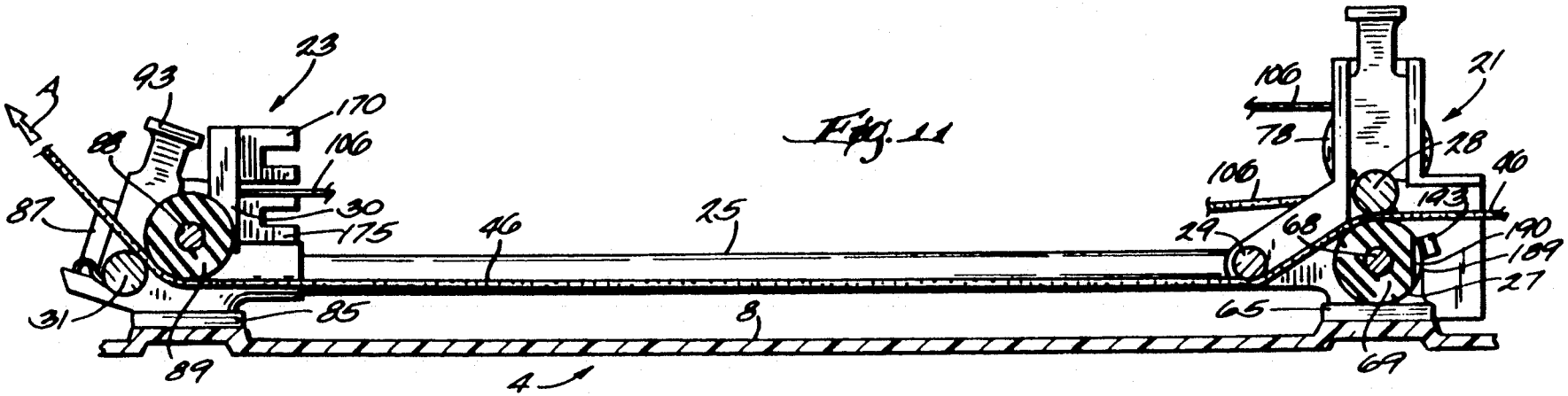
FIG. 11 is a longitudinal sectional view of support frame 20.

Corner posts 23 and 24 each include a round base pad 85 that rests on bottom panel 8 of the housing, a pedestal 86 extending upwardly from pad 85 and an L-shaped channel 87 extending vertically from the pedestal. The channels 87 of posts 23 and 24 are inclined toward the infeed end of frame 20 as best seen in FIGS. 9–11. Outfeed roller 30 is journaled between the pedestals of corner posts 23 and 24, roller 30 comprising a steel center shaft 88 and a rubber roller 89; shaft 88 extends beyond each end of roller 89. Shaft 88 of roller 30 extends through and is journaled in a hub 91 that extends in the cross machine direction at the top of pedestal 86 of each of posts 23 and 24. Shaft 88 extends through a one-way clutch 92 located within hub 91 (see FIG. 5) of corner post 24 adapted to permit the outfeed roller 30 to rotate in only one direction, clockwise as viewed from the front of the machine.

Figure 9A:
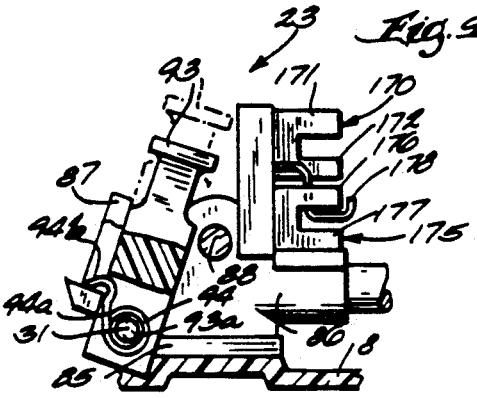
FIG. 9A is a vertical sectional view of corner post 23 with its slider in a lowered position.

A vertical slider 93 is positioned in channel 87 of each corner post 23 and 24. Outfeed nip roller 31 is journaled between the lower ends of sliders 93. Each end of roller 31 is journaled in a bushing 93*a* mounted in each slider 93 as shown in FIG. 9 at post 23. A helical spring 94 extends about each bushing 93*a* and has one end anchored to a slider 93 and its other end anchored t the bottom of a channel 87 at each corner post. This arrangement is best shown in FIG. 9 with respect to corner post 23; the arrangement at corner post 24 is the same. The springs 94 at the ends of nip roller 31 bias the nip roller 31 towards outfeed roller 30. Sliders 93 are also designed to be depressed manually so as to move nip roller 31 out of contact with roller 30 in order to enable a web of adhesive sheet material to be threaded between rollers 30 and 31. When sliders 93 are pressed downwards, the nip roller is lowered relative to the outfeed roller, and the springs 94 are arranged to hold the nip roller in its lowered position until web threading is completed, similar to the action of springs 74 of sliders 73 previously described. FIG. 9A illustrates corner post 23 with slider 93 in its lowered position. Arm 94*a* of spring 94 has an L-shaped end portion 94*b* that engages part of channel 87 to hold slider 93 in its lowered position. The raised position of slider 93 is illustrated by dashed lines in FIG. 9A. Springs 94 thus also have a dual function similar to springs 74, i.e biasing the roller 31 against outfeed roller 30 to form a nip therebetween when slider 93 is raised and also to hold slider 93 in its lowered position to facilitate threading sheet material between the two rollers.

Referring to FIG. 7, a toothed drive pulley 97 is locked to the end of shaft 88 of roller 30 at the portion thereof extending beyond hub 91 of corner post 23. Drive pulley 97 includes a brake drum 98, the purpose and function of which will be described later. Toothed drive pulley 99 is locked to the end of shaft 88 of roller 30 along the portion thereof that extends beyond hub 91 of corner post 24.

Turning once again to FIG. 5, one end of slide shaft 25 is secured in hub 102 (see also FIG. 9) that projects in the machine direction from pedestal 86 of corner post 23. Similarly, one end of slide shaft 26 is secured in hub 103 that extends from pedestal 86 of corner post 24.

Corner posts 23 and 24 also are most usefully made of molded plastic including base pad 85, pedestal 86, channel 87, hub 91 and hub 102 or 103 as integral elements of a one piece unit.

FIG. 10 is a side elevation of frame 20 as viewed from the front of machine 1; slide shaft 26, corner post 22 and corner post 24 are illustrated in this drawing. A flexible toothed front belt 105 is trained about drive pulley 99 of outfeed roller 30 at corner post 24 and idler pulley 81 on stub shaft 80 mounted on corner post 22. Turning to FIG. 5 (see also FIG. 11), a flexible toothed rear belt 106 is trained about drive pulley 97 on outfeed roller 30 at corner post 23 and idler pulley 78 on stub shaft 77 mounted on corner post 21. Belts 105 and 106 have two different operational modes in machine 1: in one mode, the belts will function as drive belts to drive outfeed roller 30 to advance adhesive sheet material 46 through machine 1 for processing and, in the second mode, the belts will be held stationary and function as the rack element of a rack and pinion drive system for a carriage to be driven along slide shafts 25 and 26, all as described in detail in section (c) of this specification.

FIG. 11 illustrates the manner in which adhesive sheet material 46 is arranged relative to the rollers supported on frame 20. At the infeed end of the frame, between corner posts 21 and 22, a web 46 of adhesive sheet material passes through the nip between infeed roller 27 and nip roller 28, and then passes under guide roller 29. At the outfeed end of the frame, between corner posts 23 and 24, web 46 passes through the nip between outfeed roller 30 and nip roller 31. After a sign is defined in web 46, the web exits machine 1 as indicated by arrow A. Infeed roller 27 has central section 69 with a roughened surface and outfeed roller 30 includes a hard rubber roller 89 to provide good frictional contact with web 46 to advance the web through the machine.

(c) Carriage 110, FIGS. 12–18

A carriage 110 is supported on slide shafts 25 and 26 of frame 20; the carriage is adapted to be driven back and forth along the slide shafts and carries stepping motors for driving the carriage, advancing sheet material through the machine and driving a character forming mechanism.

Figure 12:
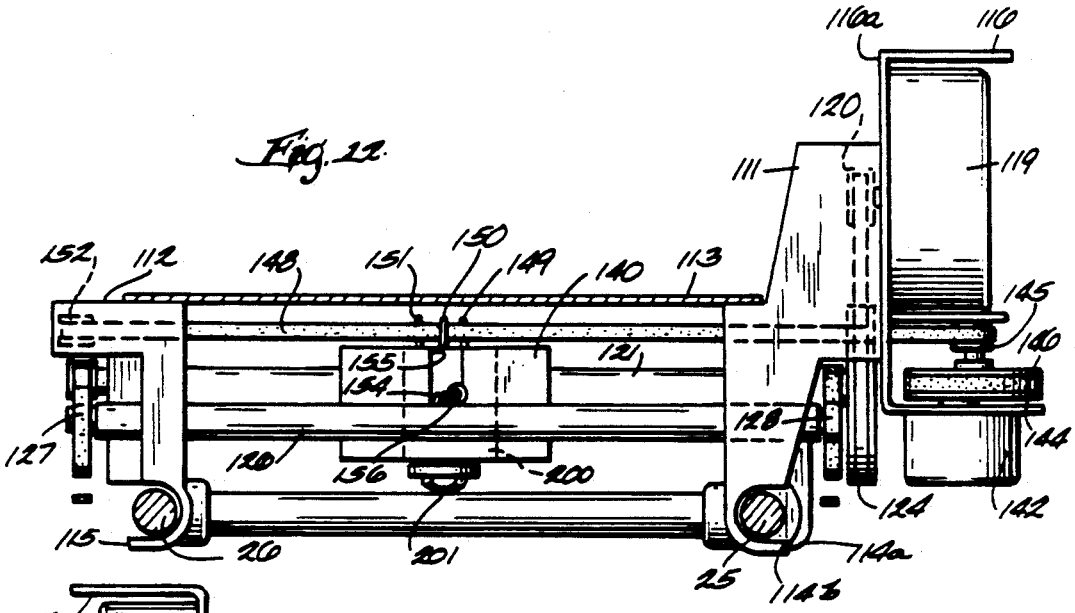
FIG. 12 is an end view of carriage 110 viewed from the infeed end of the machine.
Figure 13:
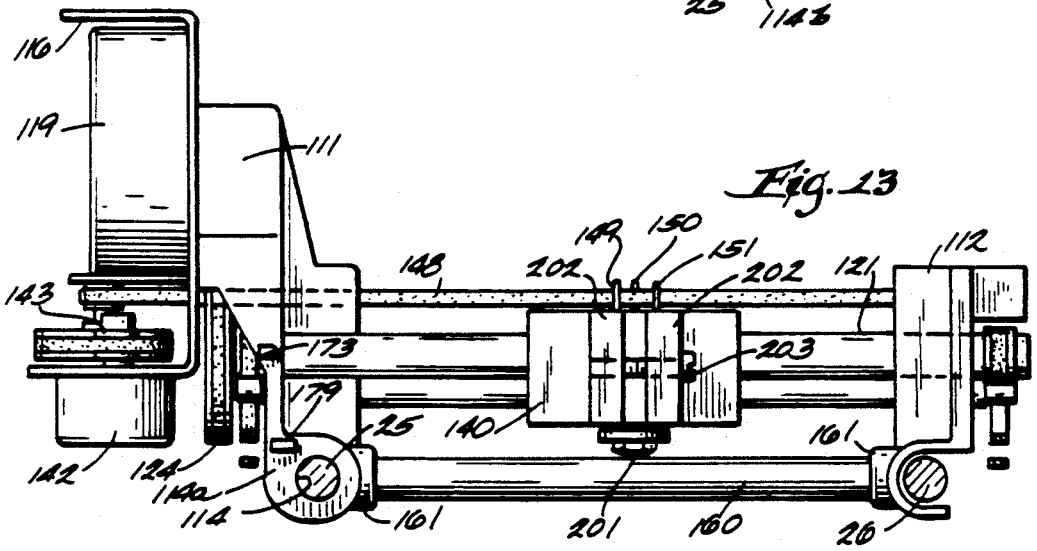
FIG. 13 is an end view of carriage 110 viewed from the outfeed end of the machine.
Figure 14:
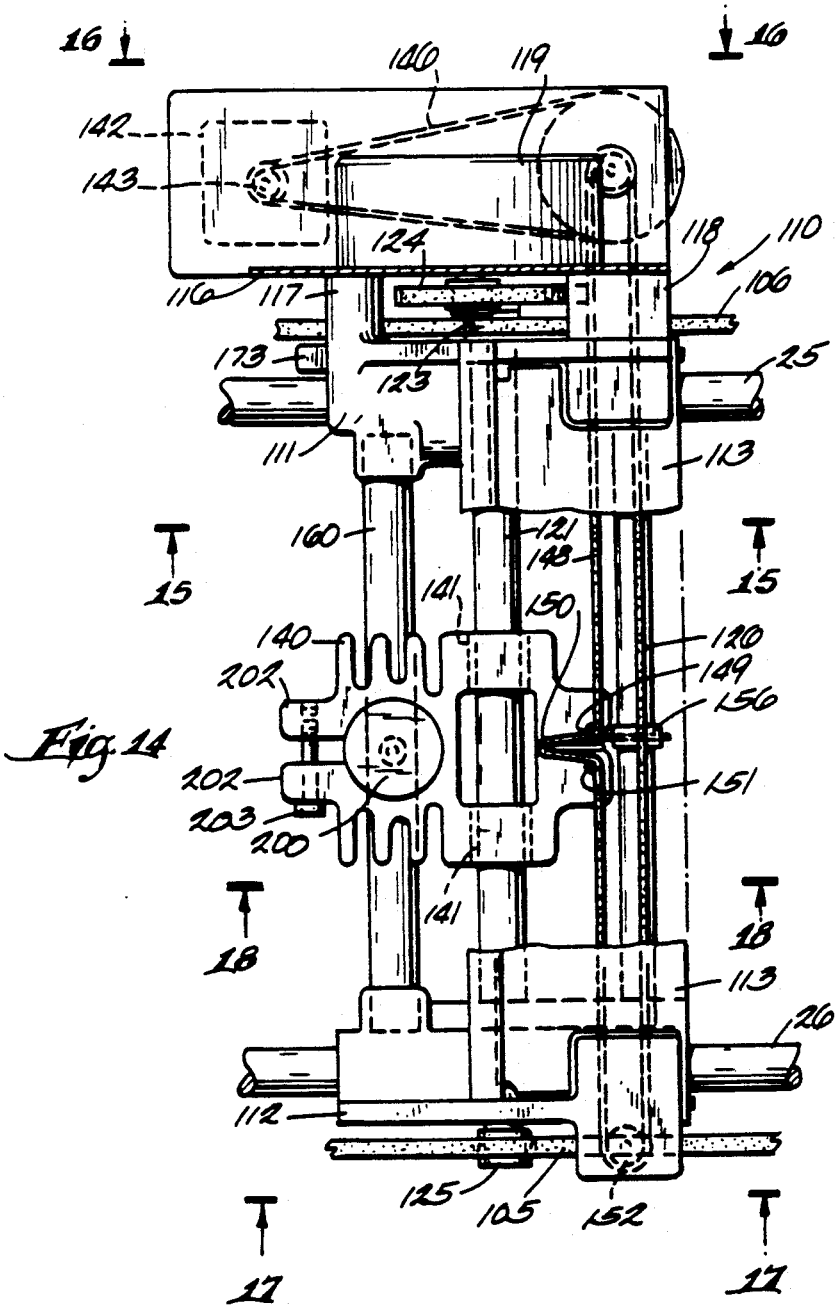
FIG. 14 is a top view of carriage 110.
Figure 17:
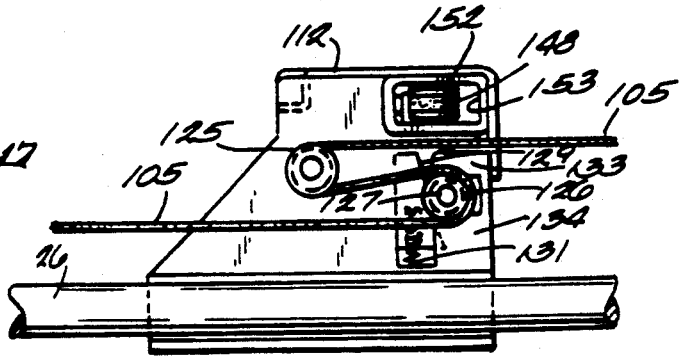
FIG. 17 is a view of the outboard side of the front slide member of carriage 110.
Figure 15:
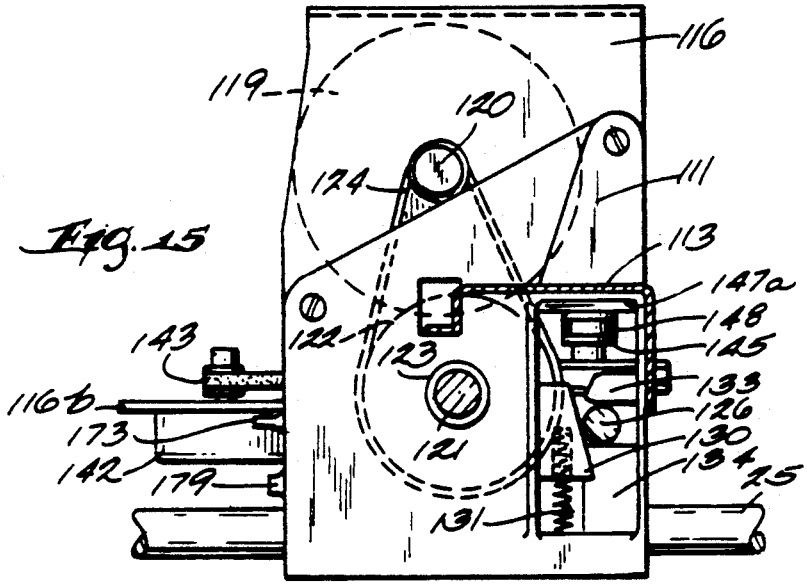
FIG. 15 is a view of the inboard side of the rear slide member of carriage 110.
Figure 16:
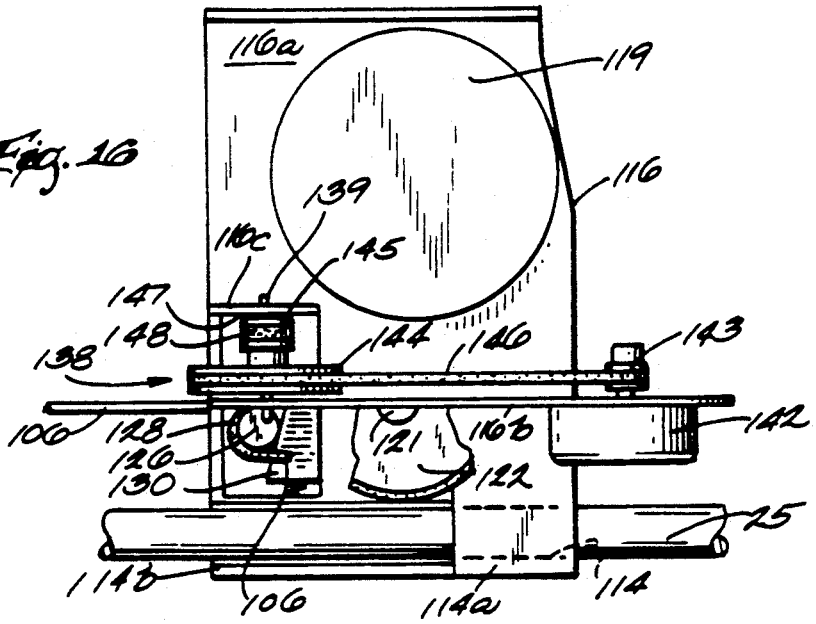
FIG. 16 is a view of the outboard side of the rear slide member of carriage 110.

Starting with FIGS. 12–14, carriage 110 includes an upright rear slide member 111 at the rear of the machine, an upright front slide member 112 at the front of the machine and a metal channel 113 that connects the two slide members together to form a rigid unit. Channel 113 also covers certain operating elements of the carriage to shield them from damage. Slide member 111 has a circular bore 114 (see FIGS. 13 and 16) extending through a cylindrical boss 114*a* at its lower end and slide shaft 25 extends through the bore 114; a C-shaped channel 114*b* extends across the balance of the lower end of slide member 111. The lower end of slide member 112 has a C-shaped channel 115 and slide shaft 26 extends through the channel 115. Slide members 111 and 112 are usefully made of molded plastic configured to include the various elements herein described as integral parts of a one piece unit. The inboard face of rear slide member 111 is shown in FIG. 15 and its outboard face is shown in FIG. 16. The outboard face of front slide member 112 is shown in FIG. 17. Channel 113 is shown in cross section in FIG. 15.

A generally C-shaped plate 116 is attached to spaced bosses 117 and 118 that extend rearwardly from slide member 111. A stepper motor 119 is mounted on vertical panel 116*a* of the plate 116, best seen in FIGS. 12 and 16. The output shaft of stepper motor 119 extends through plate 116, see now FIG. 15, and carries an output pinion 120 along the inboard face of the plate. A drive shaft 121 extends across and is journaled in slide members 111 and 112. One end of drive shaft 121 is positioned between slide member 111 and plate 116 and carries a stepped gear including a drive gear 122 and concentric drive pinion 123. Toothed belt 124 (see FIG. 12) connects output pinion 120 of stepper motor 119 and drive gear 122 on shaft 121. The front end of drive shaft 121 extends through front slide member 112 and carries a drive pinion 125, see especially FIG. 17, that is the same diameter as drive pinion 123.

Returning to FIG. 12, a cross shaft 126 is slidably mounted between members 111 and 112 and has an end portion extending outboard of each slide member. A roller 127 is rotatably mounted on the end portion of shaft 126 outboard of front slide member 112 (see also FIG. 17), and a roller 128 is rotatably mounted on the end portion of shaft 126 outboard of rear slide member 111 (see also FIG. 16). Cross shaft 126 is spring biased towards the infeed end of frame 20 by means of a ramp 129 (FIG. 17) that can move vertically along front slide member 112 and a ramp 130 (FIG. 15) that can move vertically along rear slide member 111. Ramps 129 and 130 each have a slanted wall that bears against cross shaft 126, and a spring 131 biases each ramp to maintain contact between the ramps and the cross shaft. The vertical position of shaft 126 is maintained between upper stop 133 and lower stop 134 formed as integral elements of slide members 111 and 112.

Front belt 105 is an endless toothed belt that, referring now to FIG. 17, is trained about drive pinion 125 on drive shaft 121, roller 127 on cross shaft 126 and then about drive pulley 99 at corner post 24 and idler pulley 81 at corner post 22 as described in section (b) and illustrated in FIG. 10. Rear belt 106 is an endless toothed belt that is trained about drive pinion 123 on drive shaft 121, roller 128 on cross shaft 126, and then, as noted in section (b) and shown in FIG. 5, about drive pulley 97 at corner post 23 and idler pulley 78 at corner post 21. When stepper motor 119 is actuated with outfeed roller 30 braked to prevent rotation, as described below in greater detail, the carriage 110 can be driven bidirectionally along belts 105 and 106, i.e. either to the right or left of the machine, as controlled by the programmed instructions of machine 1. Thus, stepper motor 119 drives carriage 110 in the machine direction, i.e. along the X-axis. Cross shaft 126 functions to maintain appropriate tension in the belts. Ramps 129 and 130 are urged upwards by springs 131 and transmit machine direction force to the cross shaft by reason of the shaft contacting the slanted wall of each ramp. Springs 131 are selected to have the appropriate spring force needed to maintain adequate tension in the belts 105 and 106 to achieve smooth movement of the carriage with a minimum of backlash.

Figure 18:
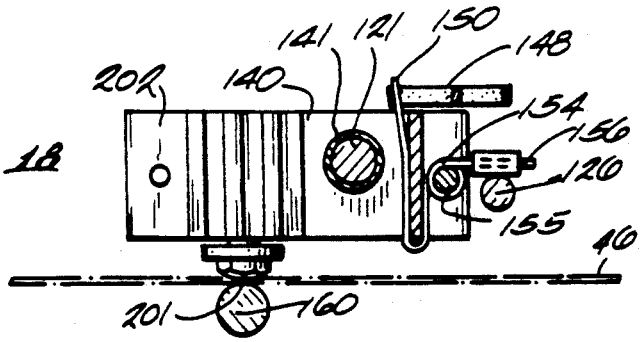
FIG. 18 is a side view, with portions broken away, of the tool holder of the machine.

A tool holder 140 (FIGS. 12–14, 18) is pivotally mounted about drive shaft 121, the drive shaft extending through bushings 141 fixed in place in the tool holder. The tool holder is to be driven in the cross machine direction, or Y-axis, of the machine upon actuation of tool holder drive stepper motor 142 (see also FIG. 16) mounted on a horizontal panel 116*b* of the C-shaped plate 116 that is attached to rear slide member 111. The output shaft of stepper motor 142 extends through panel 116*b* and carries an output pinion 143. A stepped gear 138 including a drive gear 144 and concentric drive pinion 145 is attached to rotatable vertical shaft 139 journaled between short horizontal panel 116*c* of plate 116 and panel 116*b* of the plate. A toothed drive belt 146 is trained about output pinion 143 and drive gear 144. An opening 147 is defined in spaced panels 116*b* and 116*c* of plate 116. A toothed drive belt 148 is trained about drive pulley 145, extends through opening 147 and coaxial opening 147*a* in slide member 111, and is trained about vertical pin 149, vertical arm 150 of a spring 154, and vertical pin 151 on the tool holder 140; further, drive belt 148 is trained about a toothed idler pulley 152 rotatably mounted on front slide member 112 (FIG. 17), the drive belt extending through an opening 153 in slide member 112. Turning to FIG. 18, arm 150 is a slightly bent vertical arm of helical spring 154 that is carried in a vertical slot 155 at the infeed end of tool holder 140 (see also FIG. 12). The coiled portion of spring 154 is wedged in slot 155, and the vertical walls of the slot locate arm 150. Arm 156 of spring 154 bears against the top of cross shaft 126 and arm 150 of spring 154 bears against the rear wall of slot 155, and each arm performs a different function. Arm 150 biases drive belt 148 away from pins 149 and 151 so as to tension the belt 148 to achieve smooth movement of the tool holder 140. Actuation of stepper motor 142 causes tool holder 140 to be driven back and forth along drive shaft 121 as controlled by the programmed instructions of machine 1.

Turning now to FIG. 13, a stationary anvil 160 extends between slide members 111 and 112 at the outfeed end of carriage 110. The anvil 160 is a cylindrical steel shaft fixed in place in a cylindrical boss 161 at the lower end of each slide member. Adhesive sheet material from which a sign is to be formed will pass over anvil 160 and under the character forming mechanism (described later) supported in tool holder 140. Arm 156 of spring 154 (FIG. 18) biases the tool holder towards anvil 160.

Carriage 110 is controlled to move to a home position at the outfeed end of frame 20 after a character or a group of characters has been formed in the sheet material being processed in machine 1 (and at other times, as explained in the software description of section (g) of this specification). Referring to FIGS. 9, 9A and 11, corner post 23 carries a carriage home opto sensor 170 that is a U-shaped element having an LED in its branch 171 and a photoelectric cell in its branch 172. Light from the LED is detected by the photoelectric cell whenever the space between the two arms is not blocked, which is the condition when the carriage is not in its home position. Rear slide member 111 of the carriage has an arm 173 that extends from its outfeed side, see FIG. 15. When the carriage is moved to its home position, arm 173 is positioned between branches 171 and 172 of the opto sensor and blocks the light emitted by the LED to thereby provide the control system of the machine with a signal that the carriage is at its home position; this condition is shown in FIG. 9.

Tool holder 140 also is controlled to move to a home position alongside corner post 23 after a character or group of characters has been formed in the sheet material (and at other times). Corner post 23 carries a tool holder home opto sensor 175 for this purpose. Opto sensor 175 has an LED in its branch 176 and a photoelectric cell in its branch 177. A flexible arm 178 attached to corner post 23 (see especially FIGS. 3 and 5) has a central portion 178*a* that extends between branches 176 and 177 of sensor 175 and an end portion 178*b* projecting outwards from opto element 175. When tool holder 140 reaches its home position, the end of the holder contacts end portion 178*b* of arm 178 and causes its central portion to move slightly to interrupt the light emitted by the LED of sensor 175 and generate a signal for the control system indicating the tool holder is in its home position. FIG. 3 illustrates the position of the central portion 178*a* of arm 178 when the tool holder is not in its home position, and FIG. 5 illustrates the position of the central portion when tool holder 140 (a portion of which is shown in FIG. 5) contacts end portion 178*b* of the arm to move the central portion to a position to interrupt the light beam when tool holder 140 is in its home position.

Figure 19:
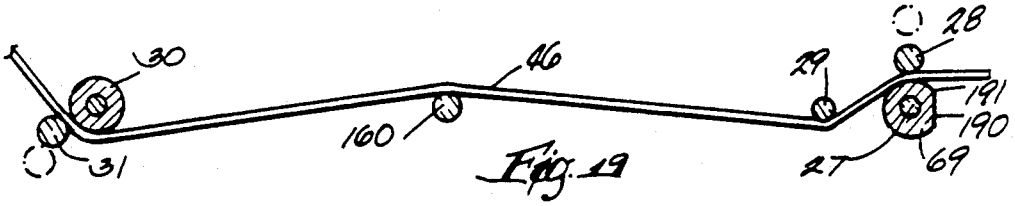
FIG. 19 is a schematic view of a web of sheet material threaded through various rollers of the operating mechanism of the machine.
Figure 20:
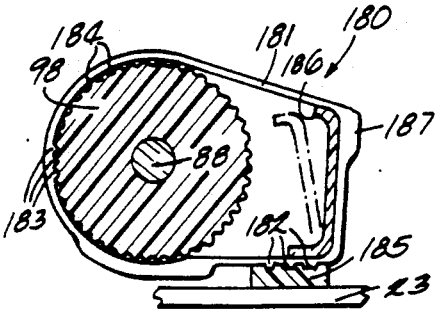
FIG. 20 is a side view of a brake system employed at the outfeed end of the machine.
Figure 21:
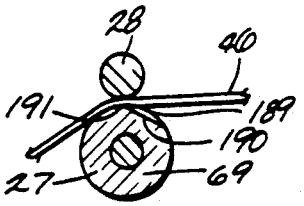
FIG. 21 is a partial view of the infeed roller of the machine.

(d) Advancement of Sheet Material, FIGS. 19-21

Pressure sensitive sheet material 46 to be advanced through machine 1 includes at least one layer in which selected characters are formed in order to define a sign. The term "character" as used in the description and in the claims is defined to mean letters and numerals in English or any language, standard symbols such as punctuation marks and mathematical symbols, and special symbols such as trademarks and designs. The term "sign" as used in the description and in the claims is defined to mean a single character or group of characters.

FIG. 19 is a schematic illustration of the path of sheet material 46 through the machine after it has been withdrawn from supply roll 45. The web of sheet material 46 passes through the nip between central section 69 of infeed roller 27 and nip roller 28, under guide roller 29, over anvil 160 that is supported on carriage 110 and then through the nip between outfeed roller 30 and nip roller 31, following which the web exits the machine.

Threading the web of sheet material over the various rollers is facilitated by lifting sliders 73 of corner posts 21 and 22 to their raised position shown in FIG. 8A as previously described in section (c) and pushing sliders 93 of corner posts 23 and 24 to their lowered position shown in FIG. 9A and previously described in section (c). This moves nip roller 28 to its raised position shown in dashed line in FIG. 19 so that sheet material can be easily threaded between it and infeed roller 27; nip roller 31 is lowered to its dashed line position of FIG. 19 for the same purpose.

After the power cord to machine 1 is plugged in, the operator turns on switch 34 and presses the LOAD-/UNLOAD KEY of keyboard 12 (FIG. 2) if sheet material is not threaded; the programmed instructions in the machine then move carriage 110 to a center position along frame 20 so that it will be out of the way as sheet material is threaded over the several rollers described above. After the sheet material has been properly arranged over the rollers, sliders 73 are pushed to their lowered position and sliders 93 are lifted to their raised position. Next, the operator presses the FEED key of keyboard 12, whereby the software program activates stepper motor 119 to transport the carriage 110 to its home position and activate stepper motor 142 to operate drive belt 146 to transport tool holder 140 to its home position alongside corner post 23. When opto elements 170 and 175 detect that the carriage and tool holder are at their respective home positions, signals are generated to activate stepper motor 142 to move tool holder 140 a few steps away from its home position and then to advance carriage 110 a couple more steps towards corner post 23 until an arm 179 on the rear slide member 111 of the carriage (FIGS. 14 and 15) contacts and releases a strap brake 180 located at corner post 23. The carriage is in a stopped position when arm 179 engages brake 180 and is not further transported upon continued activation of stepper motor 119; instead, continued activation of stepper motor 119 results in advancement of the web of sheet material 46 while the carriage is in its stopped position and brake 180 is released. The position of strap brake 180 at corner post 23 can be seen in FIGS. 3 and 5. Referring now to FIG. 20, strap brake 180 includes a brake band 181, which may be made of molded plastic, that has three exterior teeth 182 extending from a section of its outer surface and three interior teeth 183 extending from a section of its inner surface. Interior teeth 183 mesh with complementary grooves 184 along periphery of brake drum 98 on shaft 88 of outfeed roller 30. A toothed stop 185 extends outboard of corner post 23 or rearwards from the corner post, and is molded as an integral element of the corner post. The exterior teeth 182 of brake band 181 mesh with toothed stop 185. A spring 186 supported on corner post 23 is located inside band 181 and biases the band towards engagement with stop 185. The brake 180 is engaged when spring 186 is in the full line position of FIG. 20, wherein exterior teeth 182 are anchored at stop 185 and interior teeth 183 engage grooves 184, so that band 181 locks tightly about brake drum 98 and prevents clockwise rotation (viewed from the front of the machine) of outfeed roller 30; brake 180 is engaged when characters are being formed in adhesive sheet material. When carriage 110 moves slightly past its home position, arm 179 on the rear slide member 111 of the carriage contacts outer pad 187 of band 181 and deflects spring 186 to its dotted line position illustrated in FIG. 20, wherein the spring is deflected towards the outfeed end of the machine to disengage interior teeth 183 from grooves 184 (while exterior teeth 182 remain meshed with stop 185) whereby brake band 181 becomes loosened about brake drum 98 to allow rotation of the outfeed roller. When the brake is disengaged (and carriage 110 is in its stopped position), outfeed roller 30 is freed to rotate in the clockwise direction only by reason of one way clutch 92 located at corner post 24.

Release of brake mechanism 180 enables outfeed roller 30 to rotate clockwise when stepper motor 119 is activated, which is the direction of rotation of the roller permitted by the one way clutch 92 in hub 91 of corner post 24. In this operating condition, drive shaft 121 is rotated by stepper motor 119 and the reduction gearing described above connecting the motor to the drive shaft; belts 105 and 106 mesh with drive pinions 123 and 125 on each end of the drive shaft 121 and are thereby driven by the drive shaft so as to rotate outfeed roller 30 and advance sheet material 46. In this mode of operation, belts 105 and 106 function as drive belts for advancement of adhesive sheet material through the machine.

The sheet material 46 is held under tension and is stationary when characters are being formed in the material since carriage 110 is out of its home position during this operation so that strap brake 180 is engaged to prevent rotation of outfeed roller 30. The machine 1 includes three features designed to maintain the appropriate tension in the web of sheet material. As shown in FIG. 19, the surface of anvil 160 over which the web travels is slightly above the surfaces of rollers 29 and 30 under which the web travels; this distance was about ¼ inch (6 mm) in a prototype machine. This arrangement of the several rollers assists in keeping the sheet material 46 in a taut condition during character formation. Second, the one-way clutch at corner post 24 prevents outfeed roller 30 from rotating in a direction that would reduce tension in the web, i.e. counterclockwise as viewed from the front of the machine. The third and principal structure for maintaining appropriate tension in sheet material 46, however, is the construction of central section 69 of infeed roller 27 and the action of back tension spring 71 at corner post 22. As seen in plan view in FIG. 6 and in cross section in FIG. 11, section 69 has a rectangular flat zone 190 defined along a section of its circumference. Flat zone 190 extends partway across the roller, and a cylindrical portion 189 of central section 69 is at each end of zone 190. After sheet material 46 is threaded through the machine and nip roller 28 is in its lowered position, flat zone 190 is positioned as illustrated in FIGS. 6 and 11. As the sheet material is advanced and tension is applied to it, infeed roller 27 rotates approximately ¼ turn counterclockwise until leading edge 191 of flat zone 190 is located just under nip roller 28 and roller 28 rides up on section 69 along cylindrical portions 189; this condition, illustrated schematically in FIG. 21, causes the nip between rollers 27 and 28 to open slightly, reduce friction and allow sheet material 46 to slip. The equilibrium between the friction developed between sheet material 46 and section 69 of infeed roller 27 during web advancement and the force exerted by back tension spring 71 serves to hold flat zone 190 in this position. The sheet material 46 is at a tension appropriate for character formation, and position arm 70 on stub shaft 68 of infeed roller 27 near corner post 21 is between the two branches of web tension opto sensor 192 on corner post 21 (see FIG. 8) to block light emitted by the LED branch 193 from reaching the photoelectric cell branch 194 of the sensor; this generates a signal detectable by the control system of the machine indicating that the sheet material 46 is at the appropriate tension. If tension in sheet material 46 is decreased, such as by a break in the web or at the end of the web when the supply roll is exhausted, back tension spring 71 has sufficient force to rotate infeed roller 27 in the clockwise direction; this moves position arm 70 out from between branches 193 and 194 of sensor 192 so as to generate a signal to the control system of the machine that the tension of sheet material 46 is insufficient. This signal will halt operation of the machine until the matter is corrected.

When the tension in the web of sheet material 46 has reached the appropriate level and infeed roller 27 is in the position of FIG. 21, the signal developed by sensor 192 indicates sheet material is present and under tension.

After the operator lifts his or her finger from the FEED key, the programmed instructions move carriage 110 a couple steps away from brake mechanism 180 so that the brake is then effective to halt rotation of outfeed roller 30. The web of sheet material 46 is then stopped and clamped in position for character formation. Further, belts 105 and 106 are locked in position by the brake mechanism 180 and one way clutch 92 so that the toothed belts function as stationary rack elements in this operational mode; actuation of stepper motor 119 when belts 105 and 106 are held stationary causes transport of carriage 110 along belts 105 and 106. Drive pinions 123 and 125 function as the pinion members of a rack and pinion drive system for the carriage, and belts 105 and 106 when held stationary function as the rack elements of the rack and pinion drive system for the carriage. Carriage 110 is transported to the appropriate position to start forming a character in the sheet material. After a selected character or group of characters has been formed in the sheet material, the program of instructions controlling the machine directs stepper motor 119 to transport carriage to its home position and directs stepper motor 142 to transport tool holder 140 to its home position, following which (assuming another letter or another sign is to be formed) brake mechanism 180 is released and stepper motor 119 drives outfeed roller 30 to incrementally advance a selected length of sheet material through the machine to present a new portion of the sheet material for character formation. The cycle of incrementally advancing the web of sheet material, stopping advancement of the web when a selected portion is in position for forming a character or group of characters, transporting the carriage and tool holder to form one or more selected characters in the sheet material, and then returning the carriage and tool holder to their home positions, is repeated as necessary to produce a sign with the selected number of characters.

(e) Character Forming Mechanism, FIGS. 22–26

As described in sections (c) and (d), tool holder 140 is pivotally mounted about drive shaft 121 and transported along the X-axis (machine direction) when stepper motor 119 operates to move carriage 110 along belts 105 and 106 and moved along the Y-axis (cross-machine direction) when stepper motor 142 is actuated to operate drive belt 148.

Tool holder 140 carries a presently-preferred character forming mechanism 199 comprising a dual-acting electromagnetic solenoid 200 that reciprocally drives an impact plunger 201. Solenoid 200 is cylindrical in shape and is clamped between two opposed arms 202 of the tool holder 140 (FIG. 14) and secured in position by means of a threaded fastener 203 so as to locate plunger 201 over anvil 160 (FIGS. 13 and 18).

Figure 22:
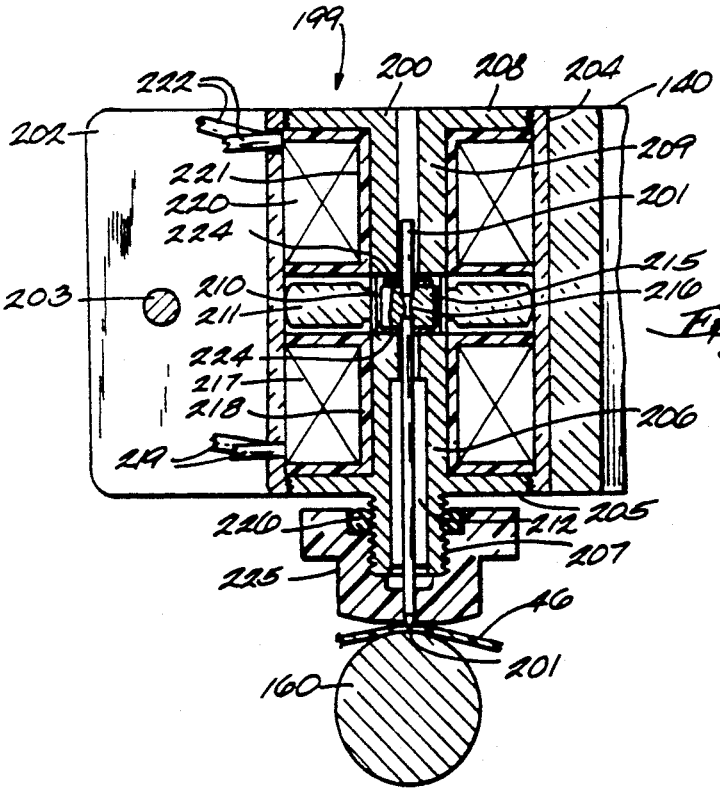
FIG. 22 is a sectional view of the character-forming tool of the machine.

FIG. 22 illustrates the structural details of the character forming mechanism 199. Solenoid 200 includes a hollow cylindrical housing 204 closed at its lower end by a disk 205 threaded into the housing and from which a cylindrical stop 206 extends axially inside the housing and a hub 207 extends axially outside the housing. The top end of the housing is closed by a disk 208 threaded into the housing and from which a cylindrical stop 209 extends axially inside the housing. The inner end of stop 206 is spaced from the inner end of stop 209 a preselected distance established by a non-magnetic stainless steel sleeve 210 joined to a flux washer 211 which contacts the inner surface of housing 204. Stops 206 and 209 bear against the ends of sleeve 210 to locate the sleeve-flux washer assembly in position Flux washer 211 includes a radial slot, not shown, to stop eddy currents. Plunger 201 extends axially through housing 204 within an axial bore in stop 209 and a sleeve bearing 212 mounted in stop 206 and hub 207 of disk 205.

A round driver 215 is attached, such as by swaging, to a groove 216 formed in a section of plunger 201 within sleeve 210. Sleeve 210 is longer axially than driver 215 to provide an air space allowing limited free axial movement of the driver and plunger 201.

A coil 217 wound on bobbin 218 is mounted on stop 206 and has external leads 219 that extend through the housing 204 for connection to circuit board 37. An identical coil 220 wound on bobbin 221 is mounted on stop 209 and has leads 222 that extend through housing 204 for connection to the circuit board 37.

Housing 204, stops 206 and 209, flux washer 211 and plunger 215 are preferably made of silicon iron "A" FM grade annealed, or other suitable material, for carrying magnetic flux. When coil 217 is energized, a magnetic flux circuit is established through housing 204, disk 205 and stop 206, driver 215, and flux washer 211 back to housing 204 which thereby pulls impact plunger 201 downwards as viewed in FIG. 22; similarly, when coil 220 is energized, a magnetic flux circuit is established through housing 204, disk 208 and stop 209, driver 215, flux washer 211 and back to housing 204 so as to pull plunger 201 upwards as viewed in FIG. 22.

Hub 207 that extends from disk 205 exterior of housing 204 is threaded, and a plastic nut 225 is threaded onto the hub. O-ring 226 is inserted in a groove at the top of nut 225 to apply an anti-rotation force against the nut; the O-ring normally bears against hub 207. Nut 225 includes a central axial opening through which plunger 201 extends so that the bottom end of the plunger projects below the nut. As will be explained in greater detail in sections (g) and (h) of this specification, the bottom of nut 225 rides along the surface of adhesive sheet material 46 to be processed by the machine. Nut 225 provides a means to easily adjust the length of plunger 201 that extends beyond the nut; nut 225 is threaded towards disk 205 to increase the length of plunger 201 outside of the nut and threaded away from disk 205 to decrease the length of plunger 201 outside of the nut.

Forming characters in sheet material is accomplished by alternately energizing coils 217 and 220 at a high rate, so as to reciprocate plunger 201 at the same rate. Anti-residual pads, or bumpers, 224 of non-magnetic resilient plastic film are inserted on plunger 201 along each end of driver 215 to absorb the impact of the driver against stops 206 and 209, to "kick off" the driver in the reverse direction by reason of their resiliency, and provide the equivalent of an air gap between the driver and the stops to speed decay of the magnetic field. Solenoid 200 is described and claimed in the co-pending, commonly-assigned in part, U.S. patent application Ser. No. 07/595,144, entitled "High Speed Solenoid," Stone and Jambor, filed Oct. 10, 1990, the disclosure of which is incorporated herein by reference.

Figure 23:
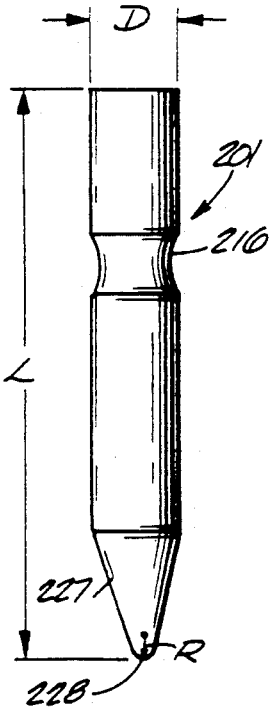
FIG. 23 is an enlarged side view, with a portion broken away, of the character-forming plunger of the tool of FIG. 22.

The presently-preferred geometry of the character-forming end of plunger 201 is shown in FIG. 23 as comprising a rounded, non-sharpened end that impacts and fractures sheet material to form a character, unlike a needle with a sharp point that pierces the sheet material. As a specific example, a plunger 201 with length "L" of about 35 mm and a diameter "D" of about 1 mm was formed with a conical end portion 227 having a rounded end 228 with a radius "R" of about 0.13 mm. A plunger with these specific dimensions was employed to form characters in adhesive sheet materials as described in section (h) of this specification and found to provide excellent results. Plunger 201 of the configuration shown in the drawing is thought to impact sheet material to form a letter or other sign element, unlike a needle which is intended to pierce the sheet material.

As described in section (c) of this specification, stepper motor 119 and its associated belts and gearing comprises the means for transporting the tool holder 140 (which carries the character forming mechanism) along the X-axis and stepper motor 140 and its associated belts and gearing comprises the means for transporting the tool holder along the Y-axis. Both transporting means are appropriately geared so as to advance the tool holder in such fashion to provide overlapping impacts of the plunger along the adhesive sheet material during character formation. With a plunger 201 of the specific dimensions described in the preceding paragraph having a rounded end 228 with a radius of 0.13 mm, the effective diameter of the rounded end is 0.26 mm. Stepper motors 119 and 140 were geared to advance the tool holder ½ step, or 0.06 mm, after an impact. This provides for each impact of the plunger with the adhesive sheet material to overlap a preceding impact by about 77%. Transporting the character forming mechanism to move the plunger to form overlapping impacts along the sheet material has been found to provide excellent character formation so that the characters have well-formed edges with minimal scalloping. Our development work to date indicates there should be about 50 to 80% overlap between successive plunger impacts to provide optimum character edge generation.

Figure 24:
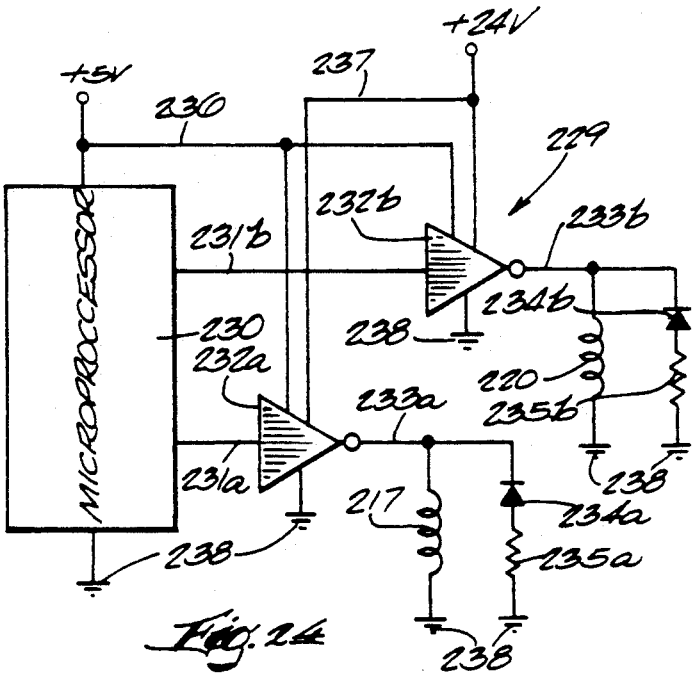
FIG. 24 is a diagram of a microprocessor-controlled circuit for operating the tool of FIG. 22.

FIG. 24 illustrates a microprocessor-controlled circuit 229 for actuating solenoid 200 to reciprocatingly drive plunger 201 at a high number of cycles per second.

A microprocessor 230 is used to generate logic command signals 231*a* and 231*b* for alternately energizing the down coil 217 and up coil 220. The logic command signals 231*a* and 231*b* are amplified by buffer amplifiers 232*a* and 232*b* on lines 233*a* and 233*b* to the down coil 217 and up coil 220, respectively. Diodes 234*a* and 234*b* are connected in series with resistors 235*a* and 235*b* to form snubber networks for the inductive reverse voltage spikes produced when the coils 217 and 220 are switched off. Specifically, the series combination of diode 234*a* and resistor 235*a* is connected in parallel with down coil 217, while the series combination of diode 234*b* and resistor 235*b* is connected in parallel with up coil 220.

The buffer amplifiers 232*a* and 232*b* provide both current gain and voltage level translation. The logic command input signals 231*a* and 231*b* have a relatively low current drive capability, and have a zero to five volt switching range. Conversely, the coils 217 and 220 require a large current drive capability at a higher voltage, or approximately 24 volts in this embodiment. Consequently, each buffer amplifier 232*a* and 232*b* is connected to a +5 volt supply on line 236 and a +24 volt supply on line 237. The +5 and +24 volt supplies are both referenced to a common ground 238, which is also connected to each of the buffer amplifiers 232*a* and 232*b*. The +5 volt supply 236 and ground 238 are also connected to the microprocessor 230 to supply its operating power.

Figure 25:
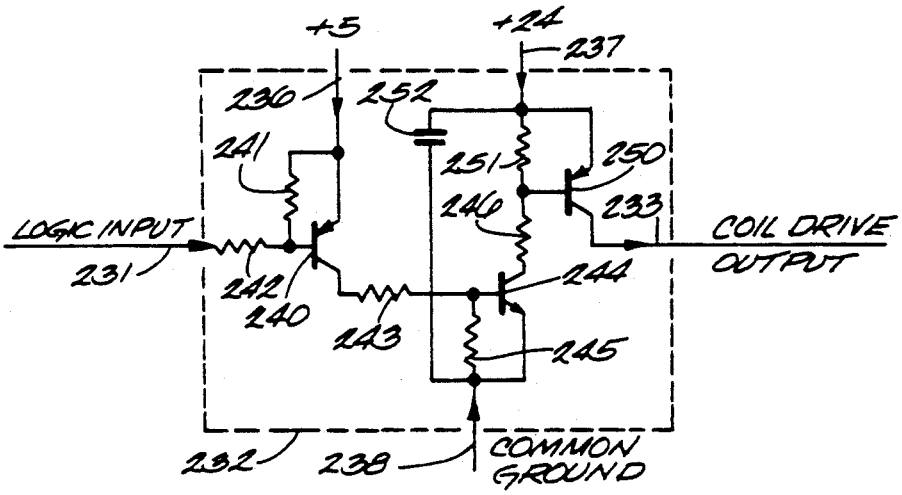
FIG. 25 is a diagram of the circuit for a buffer amplifier included in the circuit of FIG. 24.

Referring to FIG. 25, each buffer amplifier 232 includes an input stage formed by transistor 240 and bias resistors 241 and 242. Resistor 241 provides a pull-up for the base of transistor 240, while the logic input on line 231 is coupled through resistor 242 to the base of transistor 240. The emitter of transistor 240 is referenced to the +5 volt supply on line 236. The collector of transistor 240 is connected through coupling resistor 243 to the base of a second stage transistor 244. Bias resistor 245 provides a pull-down for the base of transistor 244 to the common ground on line 238. The emitter of second stage transistor 244 is also connected to ground 238. The collector of second stage transistor 244 is coupled through resistor 246 of the base of a third, or output transistor 250. The emitter of output transistor 250 is referenced to the +24 volt supply on line 237, and a pull-up resistor 251 is connected between the base of transistor 250 and the +24 volt supply 237. A by-pass capacitor 252 is connected between the +24 volt supply 237 and ground 238 to suppress current transients during switching. The collector of output transistor 250 is connected as the output 233 of a buffer amplifier 232.

In a quiescent state with the logic input 231 "high", i.e. near +5 volts, all three transistors 240, 244 and 250 will be biased "off" by their respective pull-up or pull-down resistors, as the case may be. In this condition, the current drive on an output 233 is likewise "off". When a logic input signal 231 is low, i.e. near zero volts, base current is provided to input transistor 240 through coupling resistor 241. Transistor 240 is then biased "on", and collector current from the transistor is coupled through resistor 243 to supply base current to second stage transistor 244, thereby turning transistor 244 "on" also. With transistor 244 "on", current flows from the collector of the transistor, through resistor 246, and into the base of output transistor 250, biasing it "on" as well. With output transistor 250 thus switched on, the full +24 volt supply is applied to output 233. Note that the input voltage swing is from zero to five volts to provide compatibility with the logic input signal 231, while the output range is from 24 volts to the negative voltage breakdown rating of the output transistor 250, thereby providing the required voltage translation from logic voltage levels to the voltages needed for driving the coils 217 and 220. Resistors 242 and 243 are selected for approximately unity current gain through first stage transistor 240, while resistor 246 is selected for a maximum current gain of approximately 31 through second stage transistor 244. Output transistor 250 is a high gain darlington type, having a current gain of over 200, such that the overall current gain of the buffer amplifier 232 is on the order of 6,400, to thereby provide the current gain required to drive the relatively large current required for the coils 217 and 220 (approximately 6 amps) from a logic input 231 having a low current drive capability (less than one milliamp.)

Figure 26:
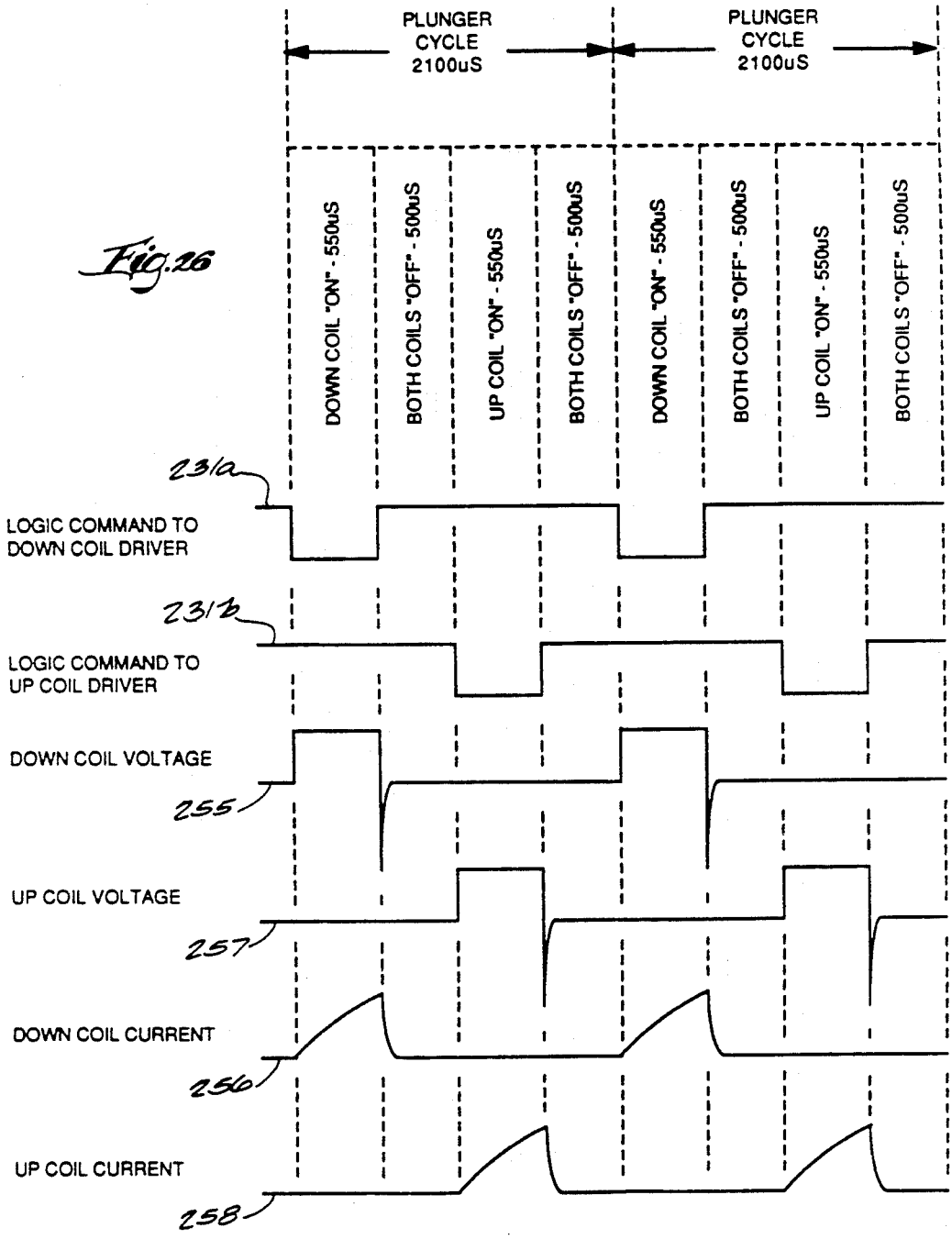
FIG. 26 is a timing diagram for the circuit of FIG. 24.
Figure 21:
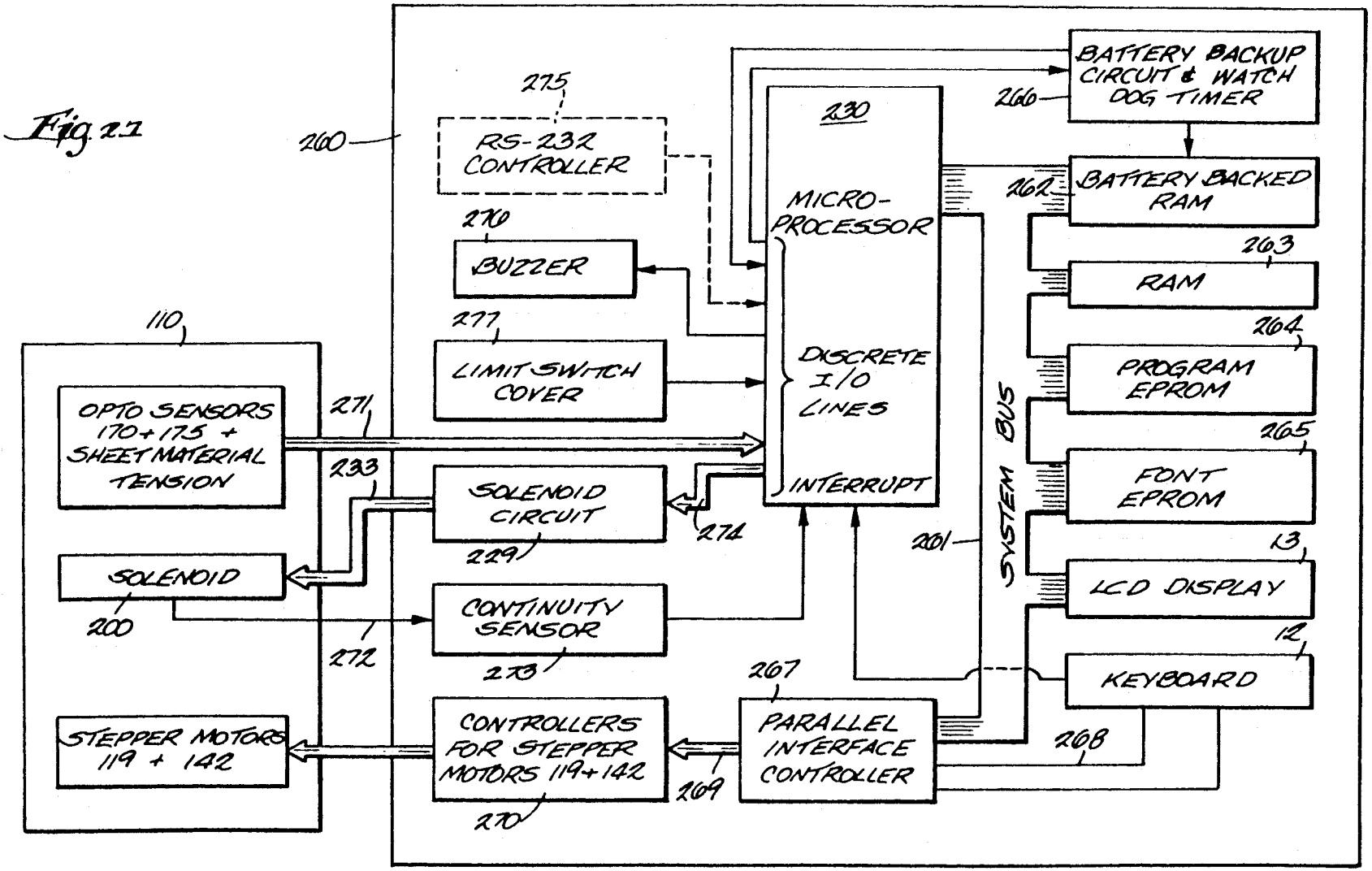

Turning to FIG. 26, the logic command signals 231*a* and 231*b* are generated in an interleaved fashion by the microprocessor 230 to alternately drive the plunger 201 down and then back up, respectively, on a cyclical basis. In the exemplary description to follow, the normal cycle used to "vibrate" the plunger 201 for fracturing the web 46 is described. In that normal case, each plunger cycle lasts approximately 2100 microseconds (uS). The software description in section (g) below gives a more detailed account of the solenoid cycle timing, including some variations in the normal cycle to accommodate, for example, testing the depth of penetration for plunger 201 or holding the plunger 201 up without fracturing the web 46 during transit of the tool holder 140 and carriage 110. Each plunger cycle consists of four separate periods. During the first period, the logic command 231*a* for the down coil 217 is made true (i.e. low logic voltage) for approximately 550 μs. The voltage applied to the down coil 217 then becomes high, near +24 volts as shown by trace 255. The current in the coil 217 as shown by trace 256 has a relatively slow rise time due to the self-inductance of the coil 217, reaching a peak current of approximately 6 amps at the end of the 550 μs period. At the end of the first 550 μs period, the logic command 231*a* is returned to "false", i.e. "high", and a second period is started in which both coils 217 and 220 are "off" for approximately 500 μs. As the coil 217 is switched off at the beginning of the second period, a negative voltage spike (trace 255) is produced due to the rapid decay of the current in coil 217 (trace 256). during a third period, also lasting 550 μs. The up coil 220 is energized by the microprocessor 230 setting the logic command signal 231*b* "true", i.e. low logic voltage. During the third period, voltage and current waveforms are produced in the down coil 220 as shown by traces 257 and 258 which are similar, but displaced in time, to the corresponding traces 255 and 256 for the coil 217, respectively. At the end of the third period, a fourth and final period is begun in which both coils 217 and 220 again remain de-energized. The fourth period completes the 2100 μs plunger cycle. Another plunger cycle may be initiated immediately thereafter if a continuous line is to be formed in the sheet material 46 as determined by the microprocessor 230. However, if a continuous line is not to be formed, subsequent plunger cycles can be delayed as necessary until the plunger is in the correct transverse position as determined by the microprocessor 230.

Solenoid 200 when actuated with a circuit such as circuit 229 can be operated to drive plunger 201 at a high rate or frequency. For example, rates in the range of about 400 to 1,000 cycles per second have been achieved in prototype testing, although the solenoid also can be operated at speeds above and below this range. The specific plunger rate of reciprocation should be selected for a particular machine based upon the character forming speed desired. In a prototype signmaking machine 1 in which stepper motors 119 and 142 were geared to advance at ½ step, or 0.0025" (0.06 mm), per cycle, the solenoid was actuated in accordance with the timing diagram of FIG. 26 to drive the plunger at 476 cycles per second to provide a character forming speed of 1.2 inches per second (about 30 mm/ sec).

The dual-acting solenoid described above as a presently-preferred means for reciprocally driving the plunger has proved to be particularly useful as an element of a character forming mechanism in our development work to date. Also, however, a mechanical system can be used as part of the character forming mechanism in lieu of the solenoid. A crank and eccentric mechanism or a cam and follower mechanism are examples of mechanical systems that can be employed as the means for reciprocally driving the plunger 201 in a signmaking machine of the invention. The character forming mechanism is to define characters in one or more layers of the adhesive sheet material that are to be separable from the sheet material to provide a sign which can be adhered to a selected surface, as described in detail later in this specification.

(f) Electrical Hardware Description, FIG. 27

Microprocessor 230 and other electrical hardware associated therewith are mounted on circuit board 260 which is illustrated diagrammatically in FIG. 27. Circuit board 260 is mounted along the interior of cover 3 of housing 1 of the machine underneath keyboard 12, as shown by dashed line in FIG. 1; a portion of circuit board 260 also is visible in FIG. 3.

Operation of machine 1 is based upon microprocessor 230; the presently-preferred microprocessor is a type 80C32, although various types can be used. As shown in FIG. 27, the microprocessor interfaces through a system bus 261 to a battery backed random access memory (RAM) 262, a random access memory (RAM) 263, a "Program" erasable/programmable read only memory (EPROM) 264, a "Font" erasable/programmable read only memory (EPROM) 265, the liquid crystal display 13 and a parallel interface controller 267. The microprocessor 230 and the peripheral circuits listed above are all of the Complementary/Symmetry Metal Oxide Semiconductor (CMOS) variety in order to minimize power drain. Microprocessor 230 includes two built-in programmable timers which are used by the programs described below to implement timed functions.

RAM 262 is an 8 bit CMOS device available from multiple sources, and is powered through a battery back up circuit 266 to maintain a minimum voltage required for retention of data. The battery back up circuit normally channels power from either the battery or an external AC source to the RAM to keep a minimum memory retention voltage on the RAM. RAM 262 is therefore essentially non-volatile, so that legends, lists of legends, and other control variables stored therein are retained indefinitely.

RAM 263 is an 8 bit CMOS volatile memory device that is used for temporary storage only. Program EPROM 264 is a 64K by 8 bit CMOS device, and is used to store the operating programs for the microprocessor. Font EPROM 265 is a 32K by 8 bit CMOS device and is used to store the font information relating to the styles of characters to be formed by the machine; the machine can, if desired, be programmed to form several styles and/or sizes of fonts in either upper or lower case, or both. Language files for display screens and tables for kerning also may be stored in EPROM 265. Components suitable for RAM 263 and EPROMs 264 and 265 are commercially-available from many sources.

Display 13 is a type HD44780 manufactured by Hitachi Co., and includes an integral controller (not shown) for accepting character and command information from the system bus 261 in well known fashion The display medium is of the liquid crystal type and contains an area of two character lines by 24 characters per line. Other types of displays and LCD displays from other sources also can be used.

Parallel interface controller 267 is a type 82C55, and provides three banks of Input/Output (I/0) lines with eight I/O lines per bank. The parallel interface controller interfaces to the system bus in well known fashion to allow the microprocessor to configure and address all I/O lines. Two banks of I/O lines 268 connect controller 267 to the keyboard 12; the keyboard comprises a standard switch matrix which is scanned using the I/O lines in well known fashion. The third bank 269 of I/O lines from the parallel interface controller 267 is connected to controllers 270 for stepper motors 119 and 142. These controllers control direction, half or full step, stepping frequency and park or full torque modes of the stepper motors.

Microprocessor 230 interfaces to the carriage 110 via a set of discrete I/O lines 271 and an interrupt input line 272. The I/O lines 271 connect to opto sensors 170 and 175 that determine if carriage 110 and tool holder 140 are in their respective X and Y home positions. A sheet material tension I/O line of set 271 senses if sheet material 46 is present and a predetermined amount of tension is on the material. The interrupt input line 272 is connected to anvil 160 through continuity sensor 273 and toggles if the plunger 201 strikes the anvil. Microprocessor 230 also interfaces to solenoid 200 through solenoid circuit 229 via a set of discrete I/O lines 274.

The battery back-up circuit 266 includes a watchdog circuit. If the microprocessor does not toggle the bit within 100 msec., the system resets. An optional RS-232 controller chip 275 can be installed to allow for serial communications between the chip and another computer.

Microprocessor 230 also interfaces to a piezoelectric buzzer 276 to provide audio feedback to the operator and to a mercury limit switch 277 to allow the system to know if cover 3 of housing 2 is open.

(g) Software Description, FIGS. 28–44

The software for controlling the operation of the machine 1 is contained in program EPROM 264 and executed by the microprocessor 230. Referring to FIG. 28, when operating power is first applied to the microprocessor 230, a power on/reset routine is entered at block 300, and at block 301 an initialization and self-test routine is performed to verify proper operation and configuration of the hardware components, and to set up the various timers and variables used in the subsequent processing described below. In the event that a hardware failure is detected in the initialize and self-test block 301, the microprocessor is halted at block 302. Alternatively, if the initialization and self-test in block 301, an operator interface routine 303 is entered. The operator interface routine 303 utilizes LCD display 13 to display operator options, instructions, information and error messages, while keyboard 12 is used for operator input. Received operator commands are processed by a command decoder 304 to carry out the desired operation. The execution of some commands involves the control of novel aspects of the machine 1, as described in detail below. Other commands are also included for performing functions which are well known in the art. For example, a legend editor 305 is included for creating and editing strings of characters which are to be formed on the sheet material, or web, 46. Such character strings are referred to herein as "legends" 306. As is generally known in the art, the legends may include "special" characters such as, for example, "serialized" characters which automatically change value in a predetermined sequence for multiple formations of the same legend. A facility is provided for storing a set of permanent legends 307 on a nonvolatile basis in the battery backed RAM 262. The permanent legends 307 may be recalled and edited, and new legends can be created and added to the permanent legend area 307. A temporary legend storage area 308 is also provided for working with one or more legends on a temporary basis. The temporary legend 308 so created may also be formed on the web 46.

A font table 309 is contained in font EPROM 265 and defines the geometric shapes corresponding to the individual characters to be formed on the web 46. The formation of each character is assumed to start at a fixed point referred to in the description below as a "character reference point". All motions needed to form an individual character, starting from the character reference point, are represented in the font table 309 by a sequence of entities 310, with each individual entity 311 describing one elementary motion to be used in forming the corresponding character. For example, individual entities 311 may define either straight line or curvilinear motion (e.g. an arc or segment of a circle) for a portion of the character, and whether or not the web 46 is to be fractured by the plunger 201 during that motion, since some characters require motions without fracturing the web 46, e.g. characters like "O" with inner portions, or like "C" which require transit to a starting point other than the character reference point. At the end of each sequence of entities 310 for each particular character, an end of character marker 312 is provided to indicate that there are no more entities 311 in the defined character. A complete description of the use of the entities 310 in forming characters on the web 46 is provided later.

Three specific operations of the machine 1 which utilize novel aspects thereof are now described, namely the "FEED", "LOAD/UNLOAD" and "FORM LEGEND" functions. Each of these functions can be invoked by depression of an appropriate dedicated key on the keyboard 12 and/or through a menu selection process. In addition, the FEED and LOAD/UNLOAD functions can be initiated by calls from other routines to be described below. From the operator interface routine 303, the FEED function is requested by depression of the "FEED" key, and is carried out by a call at block 315 to a FEED routine. As the name implies, the FEED routine results in feeding of the web 46 through the machine 1, for example, during loading, to clear a jam, or etc. The LOAD/UNLOAD function may be requested from the operator interface 303 by depression of the "LOAD/UNLOAD" key. In response to a load/unload request, a LOAD/UNLOAD routine is called at block 316. The LOAD/UNLOAD routine is provided to facilitate handling of the web 46. Due to the unique nature of the character forming mechanism according to the invention, e.g. with the character forming mechanism moving over a web 46 held stationary and under tension, threading of the web 46 into the machine may be difficult for example, if the carriage 110 is in the vicinity of either the infeed or outfeed rollers 27 and 30, respectively. The LOAD/UNLOAD routine facilitates handling of the web 46 by moving the carriage 110 to a position approximately midway between the infeed and outfeed rollers 27 and 30, respectively, thereby preventing interference with manipulation of the web 46 near the rollers. The LOAD/UNLOAD routine also provides other functions which may be useful during web loading. For example, a "feed" capability is provided directly from the LOAD/UNLOAD routine for advancing the web 46 without returning to the operator interface 303, and the LOAD/UNLOAD routine provides a facility for testing and adjusting the depth of penetration of plunger 201 into the web 46. The depth of penetration adjustment is important, as described in detail below, to obtain optimum character formation without excessive wear on the plunger 201 or anvil 160. Upon completion of the LOAD/UNLOAD routine at block 316, an APPLY TENSION routine is called at block 317 for placing the web 46 under tension before returning to the operator interface 303.

Having properly tensioned the web 46, the machine 1 is ready to begin forming characters. After the operator has either composed a temporary legend 308, or has recalled one of the permanent legends 307, the operator requests the formation of a sign based on the selected legend either by depression of the "cut" key or through the selection of a cut option from an interactive menu not shown). When such a request is made, a call is made at block 318 to a FORM LEGEND routine, which is described fully below, to control formation of characters on the web 46. Upon completion of any of the above described function requests, control is returned to the operator interface 303 for accepting further operator commands.

In the following descriptions of FIGS. 29–44, the motions made by the tool holder 140 and carriage 110 are described in detail for the various operations performed by the machine 1. In those descriptions, the directions of movement for the carriage 110 will be referred to as "right" and "left", where movement right is understood to mean that the carriage 110 is moving parallel to the long axis of the web 46 toward the infeed roller 27, and leftward motion is the reverse, i.e. towards outfeed roller 30. For the tool holder 140, motions are referred to as "up" and "down", where movement up is understood to mean that the tool holder 140 is moving transversely across the web 46 towards the rear of the machine 1 (e.g. "up" as viewed from the top of machine 1), and downward motion is the reverse, i.e. towards the front of the machine 1.

Another general comment that will aid in the understanding of the description below concerns the establishment of a reference, or "home" position for the tool holder 140 and carriage 110. Because of the unique mechanism utilized in this invention, the stepper motor 119 both moves the carriage 110 while the web 46 is stationary if the brake mechanism 180 is engaged, and moves the web 46 while the carriage 110 is stationary if the brake mechanism 180 is released. As a result, an absolute position for the carriage 110 cannot be maintained simply by counting the number of steps executed by the stepper motor 119. Further, both the carriage 110 and tool holder 140 are subject to inadvertent movement, for example due to a jam or forced movement by the operator, in which case the number of steps executed by the respective motors 119 and 142 again can not be relied upon for positioning information. It is therefore preferred to periodically establish a known reference position, referred to herein as the "home" position. The home position is defined as the combined position for the tool holder 140 and the carriage 110 which is reached when the carriage 110 first interrupts the carriage home sensor 170 during leftward movement of the carriage 110, and when the tool holder 140 first causes the flexible arm 178 to interrupt the tool holder home sensor 175 during upward movement of the tool holder 140. The "home" position therefore refers to the above defined reference positions for both the carriage 110 and tool holder 140. Similarly, a "carriage only" home position (also referred to as "carriage home") is defined as the position which is reached when the carriage 110 first interrupts the carriage home sensor 170, regardless of the position of the tool holder 140. Note that a corresponding definition for a "tool holder only" home position is not appropriate, since the carriage 110 must first be at or near the carriage home position before the tool holder 140 is in a position to deflect the flexible arm 178.

Based on the foregoing, there are two observations which can be made regarding the home position. Firstly, the home position can only be approached with the carriage 110 to the right of the carriage home position and with the tool holder 140 downward of the flexible arm 178. Therefore, when seeking the home position, the tool holder 140 is normally moved down by a small amount to insure that it is below the flexible arm 178, and the carriage 110 is moved to the right by a small amount to insure that it is to the right of its home position. The reverse motions can then be made to "seek" the home position. Secondly, it should be noted that when in the home position, the tool holder 140 is in contact with the flexible arm 178. Movements away from the home position should be made by first moving the tool holder 140 down by a small amount to be clear of the flexible arm 178. If movement of the carriage 110 is attempted with the tool holder 140 in contact with the flexible arm 178, the tool holder would scrape across the end of the flexible arm, which may cause undue wear or possible damage to the flexible arm 178. In the same way, the home position must be established by first moving the carriage 110 to its home position while the tool holder 140 is clear of the flexible arm 178, and then moving the tool holder upward. If the tool holder 140 were to be forced into the flexible arm longitudinally, i.e. by right to left motion of the carriage 110, the flexible arm 178 may be damaged. Preferably, any movement of the carriage 110 to reach home is preceded by a small downward movement of the tool holder 140 to insure that the latter is clear of any potential interference with the flexible arm 178.

Figure 29:
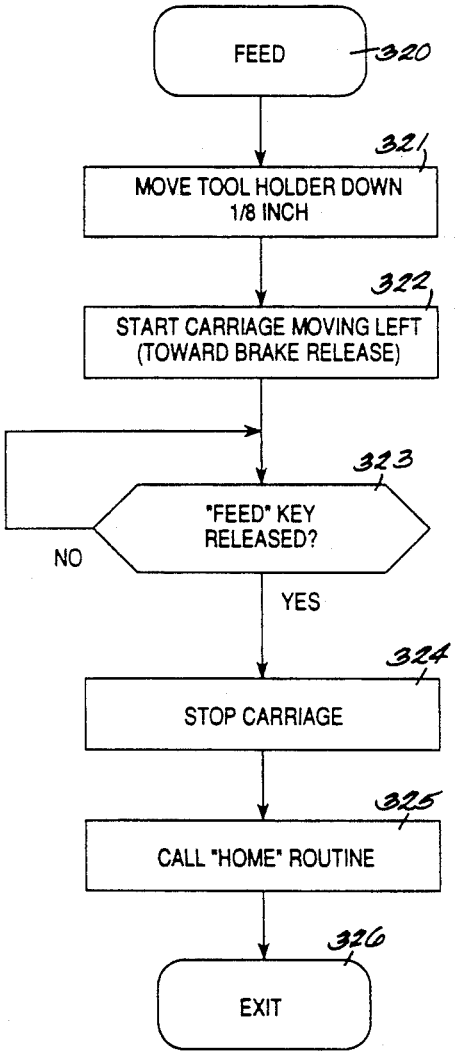
FIG. 29 is a flow chart of a "feed" routine.

Referring to FIG. 29, the FEED routine enters at block 320 and proceeds to block 321. At block 321 appropriate commands are issued to the tool holder drive motor 142 to move the tool holder 140 down a distance of approximately ⅛ inch (about 3 mm) in order to clear the flexible arm 178 as described above. Then at block 322, stepper motor 119 is commanded to begin leftward movement. A loop is entered at block 323 to keep stepper motor 119 energized for as long as the FEED key is held down. Note that while stepper motor 119 continues to run in a "leftward" direction, the carriage 110 actually moves to the left only until contact is made with the brake release mechanism. Once the carriage 110 contacts the brake release mechanism 180, a small amount of over travel is required to actually release the brake, after which the rotation of stepper motor 119 causes rotation of the outfeed roller 30, while the carriage 110 remains stationary. The rotation of outfeed roller 30 draws the web 46, under tension, through the machine 1 and discharges it out through the slot 47. When the FEED key is released, processing continues at block 324, where the stepper motor 119 is stopped. At this point, the brake 180 is still released, but the outfeed roller 30 is prevented from releasing tension on the web 46 by the action of the one way clutch 92. Then at block 325, a call is made to a HOME routine, which returns the tool holder 140 and carriage 110 to the home position. In moving back to the home position, the carriage 110 is moved away from the brake release mechanism 180, thereby engaging the brake. The FEED routine finally exits at block 326.

Figure 30:
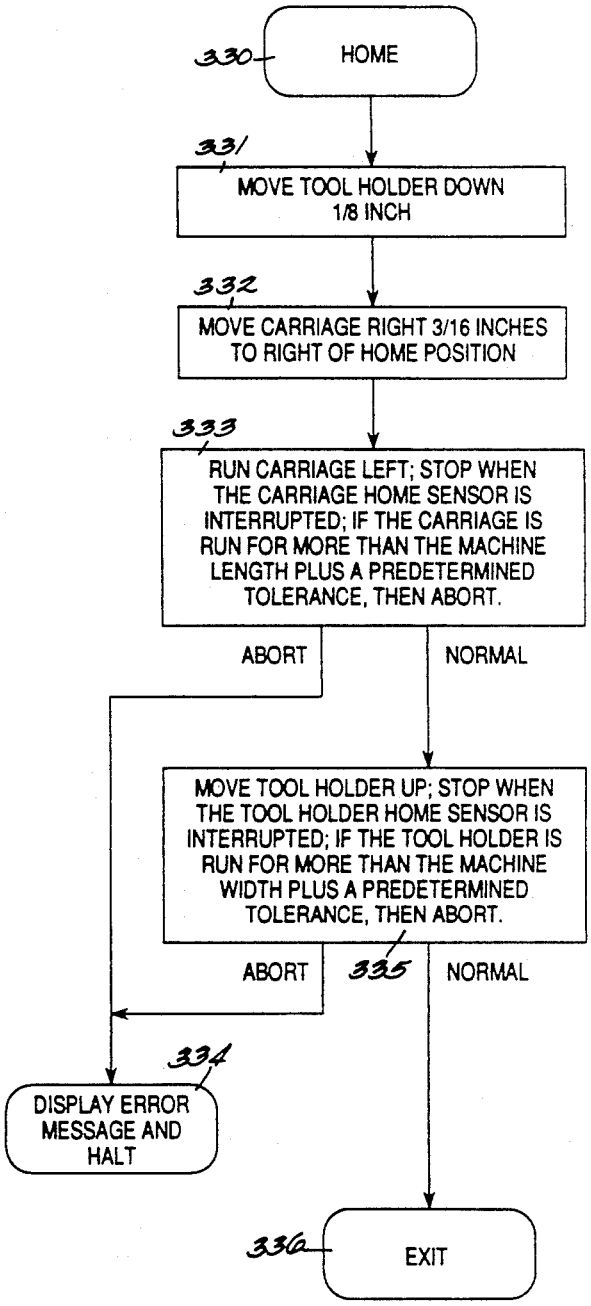
FIG. 30 is a flow chart of a "home" routine.

Referring to FIG. 30, the HOME routine enters at block 330 and proceeds to move the tool holder down ⅛ inch (about 3 mm) at block 331, and to move the carriage right 3/16 inches (about 5 mm) at block 332. These motions insure that the carriage 110 will be to the right of its home position, and the tool holder 140 will be downward of its home position, even if the carriage 110 and tool holder 140 were already home prior to those respective motions. Further, the downward motion of the tool holder 140 also insures that the subsequent leftward movement of the carriage 110 will not result in an impact between the tool holder 140 and the flexible arm 178, as mentioned above. At block 333, the carriage 110 is moved leftward until the carriage home sensor 170 is interrupted, at which time the carriage 110 is at its home position and is stopped. While the carriage 110 is moving left seeking the home position, the number of steps taken by the stepper motor 119, which corresponds to the distance moved by the carriage 110, is maintained. If the carriage 110 is moved a distance greater than the maximum possible travel of the carriage 110 across the slide shafts 25 and 26, then it is assumed that motion of the carriage 110 is being obstructed, in which case an ABORT exit is taken from block 333 to block 334. In block 334, an appropriate error message is displayed, and a halt, or terminal loop is entered to prevent any further processing until the obstruction is cleared. Machine operation may then be restored by turning the power back on after the obstruction has been removed. If the carriage 110 is homed normally at block 333, processing proceeds to block 335, where the tool holder 140 is moved upwards until contact is made with the flexible arm 178, forcing the flexible arm 178 to deflect and interrupt the tool holder home sensor 175. Upon detecting the interruption of the tool holder home sensor 175, motion of the tool holder 140 is stopped. The distance traveled by the tool holder 140 in seeking the home position is also monitored, and if it is found to exceed the maximum possible travel across the carriage 110, then an ABORT exit is taken from block 335 to the error block 334. However, if the tool holder 140 is homed normally at block 335, then the home position has been established, and the HOME routine exits at block 336.

Figure 31:
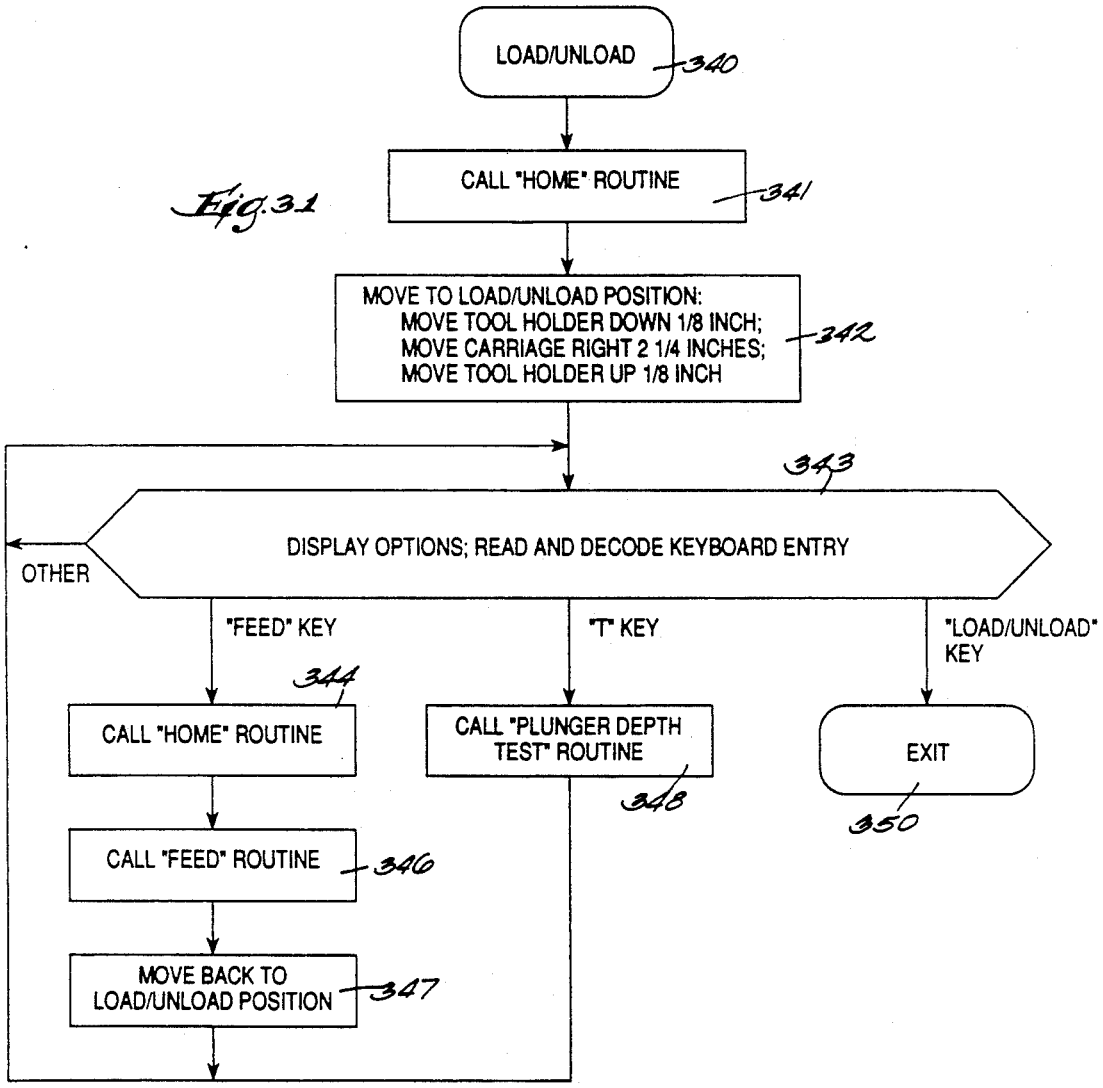
FIG. 31 is a flow chart of a "load/unload" routine.

Referring to FIG. 31, the LOAD/UNLOAD routine is entered at block 340. Since the LOAD/UNLOAD routine is called by several routines to be described below, in some cases in response to an error condition such as the loss of tension on the web 46, the position of the tool holder 140 and carriage 110 can not be assured. Therefore a call is made to the HOME routine at block 341 to place the tool holder 140 and the carriage 110 at their respective home positions. From the home position, the tool holder 140 and carriage 110 are moved to their respective "load/unload" positions at block 342. As usual, the tool holder 140 is first moved down ⅛ inch (about 3 mm) to clear the flexible arm 178. Then the carriage 110 is moved 2¼ inches (about 57 mm) right, to a position approximately midway between the infeed and outfeed rollers 27 and 30, respectively. Upon placing the carriage 110 at the midway position, the tool holder 40, now well clear of corner post 23, is moved back up ⅛ inch (about 3 mm) to its original transverse position. The transverse positioning of the web 46 is such that with the tool holder 140 in this position, the plunger 201 used to fracture the web 46 is positioned just off the rearward edge of the web 46. This transverse position is used for testing and setting the depth of penetration for the plunger 201 according to a procedure described below. The preferred position just off the edge of web 46 is used so that a portion of nut 225 is on the web 46, holding the nut 225 at a distance from the anvil 160 corresponding to the thickness of the web 46, while the plunger 201, being just off the edge of the web 46, is free to contact the anvil 160 (i.e. unobstructed by the web material), if adjusted too deeply.

Once in the load/unload position, block 343 is entered where a set of options are displayed to the operator, and the operator's response is read and decoded. The permissible options from the load/unload position are to feed the web 46 (blocks 344–347), selected by depression of the FEED key, to test the depth of penetration for the plunger 201 (block 348), selected by depression of the key for the letter "T" (for "Test"), and to exit the LOAD/UNLOAD routine (block 350), selected by depression of the LOAD/UNLOAD key. Note that in some cases, the LOAD/UNLOAD routine is entered in response to a first depression of the LOAD/UNLOAD key, so that subsequent exit from the LOAD/UNLOAD routine is effected by a second LOAD/UNLOAD key depression. Depression of any key other than those mentioned above results in a branch back to block 343.

If a feed is selected from block 343, a branch is taken to block 344, where a call is made to the HOME routine, moving the tool holder 140 and carriage 110 from the load/unload position to the home position. The FEED routine is then called at block 346, advancing the web 46 as described above. When the FEED key is released, the FEED routine returns to block 347, where the tool holder 140 and carriage 110 are moved back to the load/unload position via the same movements made in block 342. Upon completion of the feed operation, a return is made to block 343 to process further operator commands.

If the "T" key is depressed while in block 343, a call is made at block 348 to a PLUNGER DEPTH TEST routine. The depth of penetration for the plunger 201 is important for proper operation of the machine 1, and should be periodically adjusted, by rotation of nut 225 as described above, for optimum performance. If the plunger 201 is set too shallow, it will not impact the web 46 enough to achieve the desired fracturing thereof. Alternately, if the plunger 201 is set too deep, the plunger 201 will contact the anvil 160, causing excessive wear to both the plunger 201 and anvil 160, and possible damage to the plunger 201. For best performance, it is therefore preferred to adjust the length of plunger 201 extending beyond nut 225 so that it nearly makes contact with the anvil 160 without actually doing so. Prevention of excessive contact between the plunger 201 and anvil 160 while at the same time assuring sufficient fracturing of the web 46 is important to the successful operation and longevity of the machine 1. As described above, the plunger 201 is electrically isolated from the anvil 160 so that continuity therebetween can be detected, as represented by sensor 273. The PLUNGER DEPTH TEST routine cycles plunger 201 for a predetermined time, approximately 40 milliseconds in this embodiment, and takes appropriate action, as described below in relation to FIG. 32, in the event that a continuity fault is detected. In the PLUNGER DEPTH TEST routine, if continuity is detected between the plunger 201 and anvil 160, then the plunger 201 is set too deep, and a message is displayed informing the operator of the error condition. Normally, the depth of plunger 201 is adjusted by repeatedly depressing the "T" key and observing the results on the display 13. If the test is passed, the nut 225 is incrementally adjusted deeper until the test fails. Then the nut 225 is "backed off" by a small amount, for example 1/16 to ⅛ turn, leaving the plunger depth near, but not quite, making contact with the anvil 160. Therefore, the PLUNGER DEPTH TEST routine is used to measure the depth of penetration of plunger 201 for the purpose of adjusting the depth for optimum performance.

Referring to FIG. 32, the PLUNGER DEPTH TEST is entered at block 360 and continues at block 361, where the "down" time for the solenoid 200 is set to 300 uS instead of the normal 550 uS. During plunger depth testing, the plunger 201 is just off the edge of the web 46, so that less of a downward impulse is needed on the plunger 201 since the plunger 201 does not need to penetrate the web 46. Also, since contact between the plunger 201 and anvil 160 is possible during the depth testing, it is preferable to decrease the downward impulse of plunger 201 so as to result in a "light" hit which should not damage the plunger 201 in contacting the anvil 160. At block 362, a CONTINUITY EXPECTED flag is set to a "true" value. In general, the CONTINUITY EXPECTED flag is used to tell the CONTINUITY INTERRUPT routine (FIG. 33) that continuity is possible, and if any continuity is detected, all motion and solenoid operation should be stopped, without any other error processing. If continuity is not expected, the CONTINUITY EXPECTED flag is set false, and the CONTINUITY INTERRUPT routine instead performs a "smart" continuity test, also shown in FIG. 33, which determines, on the average, how many continuity events are occurring with respect to plunger cycles which do not result in a continuity event, and in the case of a failure of the smart test, additional error processing is performed. The continuity "smart" test is described in detail below. Finally at block 362, the continuity interrupt is enabled so that a continuity event will be vectored to the CONTINUITY INTERRUPT routine.

Figure 34:
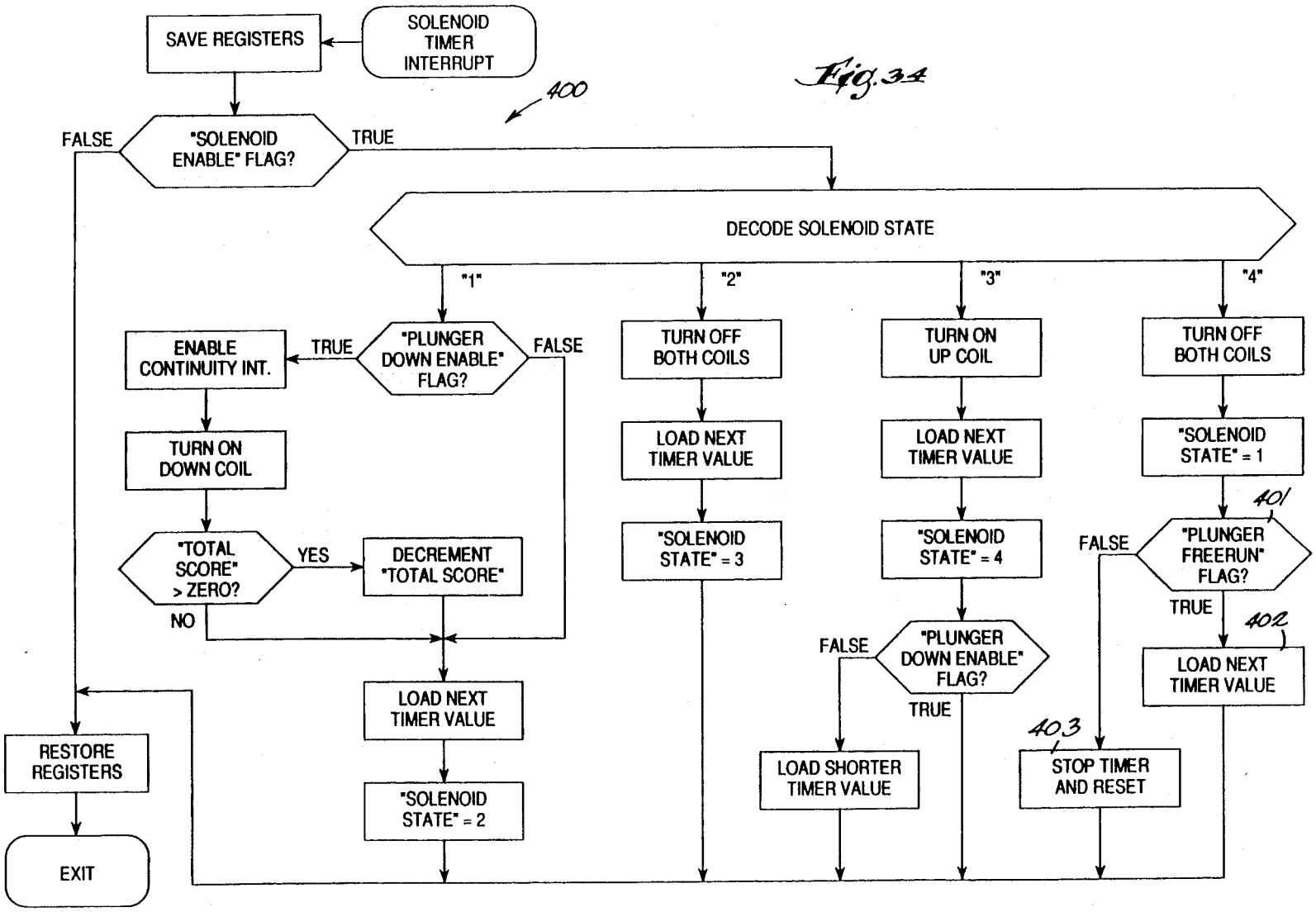
FIG. 34 is a flow chart of a "solenoid timer interrupt" routine.

At block 363, a set of flags are set which will result in a free running vibration of the plunger 201. The plunger 201 is set to vibrate at a fixed rate. A PLUNGER FREERUN flag is used by a SOLENOID TIMER INTERRUPT routine, shown in detail in FIG. 34, to control the desired operation of the plunger 201. Another flag, namely the PLUNGER DOWN ENABLE flag, is used to enable the energizing of the down coil 217 during solenoid cycles. As also shown in FIG. 34, the SOLENOID TIMER INTERRUPT routine may selectively bypass the "down" stroke of plunger 201, even though the solenoid continues to be cycled with a shorter duration "up" stroke. The latter mode is used for motions of the carriage 110 and tool holder 140 in which impacting of the web 46 is not desired, in which case the periodic, short duration "up" pulses hold the plunger 201 up, and off the web 46 to avoid scraping plunger 201 across it during the motion. It should be understood that the short duration "up" pulses are preferably applied to the up coil 217 for all movements of the tool holder 140 or carriage 110 during which impact is not desired, either by the above referenced free running cycle, or alternately for example, by delivering one such short duration "up" pulse per step of either the tool holder or carriage drive stepper motors. For clarity of illustration, the "up" pulses synchronized to the motor steps during nonimpact movement are not shown in detail, as their inclusion should be apparent to those skilled in the art. However, at block 363 in the PLUNGER DEPTH TEST routine, the down stroke of the plunger 201 is in fact desired, and the PLUNGER DOWN ENABLE flag is therefore set true. Finally at block 363, a software interrupt is generated to start the PLUNGER TIMER INTERRUPT routine, with subsequent interrupts being generated by the timer settings established within the PLUNGER TIMER INTERRUPT routine.

Having initialized the continuity test and started the plunger 201 vibrating, at block 364 a timer is programmed with a predetermined interval of approximately 20 milliseconds for a first segment of the plunger depth test, and a wait is performed at block 365 until the test period has expired. At block 366, the plunger control flags are reset to stop the vibrating of plunger 201, and at block 367 the solenoid "down" time is restored to the normal value of 550 uS. Then at blocks 368-371, a second segment of the plunger depth test is performed, similar to that described above in relation to blocks 363-366, except that the "down" pulse for the second segment is the longer, normal down time of 550 uS. This dual segment test approach is used to further protect the plunger 201 from excessive wear or damage. By first using "light" hits in the first test segment, the potential for damaging impact between the plunger 201 and anvil 160 is reduced, even if the nut 225 is grossly maladjusted. Whenever continuity is detected, the CONTINUITY INTERRUPT routine (FIG. 33) forces a SOLENOID ENABLE flag "false", which in turn prohibits the SOLENOID TIMER INTERRUPT routine (FIG. 34) from further cycling of the solenoid. If any continuity fault is detected durin the first test segment, the SOLENOID ENABLE flag prevents operation of the solenoid for the remainder of the first test segment and for the entire second test segment. Otherwise, if the first segment is completed without detecting a continuity fault, then the solenoid will continue to operate for the second, full down force test segment. At block 372, the SOLENOID ENABLE flag is tested to determine if both test segments were completed without a continuity fault, i.e. with the SOLENOID ENABLE flag still being "true". In that case, a branch is taken to exit block 373, completing the PLUNGER DEPTH TEST routine. However, if the SOLENOID ENABLE flag is found to be "false" at block 372, then the plunger depth test has failed, i.e. a continuity fault was detected, and a branch is taken to block 374 where an appropriate error message is displayed. Then at block 375, the SOLENOID ENABLE flag is restored to a "true" state to enable subsequent operation of the solenoid before exiting back to the LOAD/UNLOAD routine via exit block 373.

Figure 33:
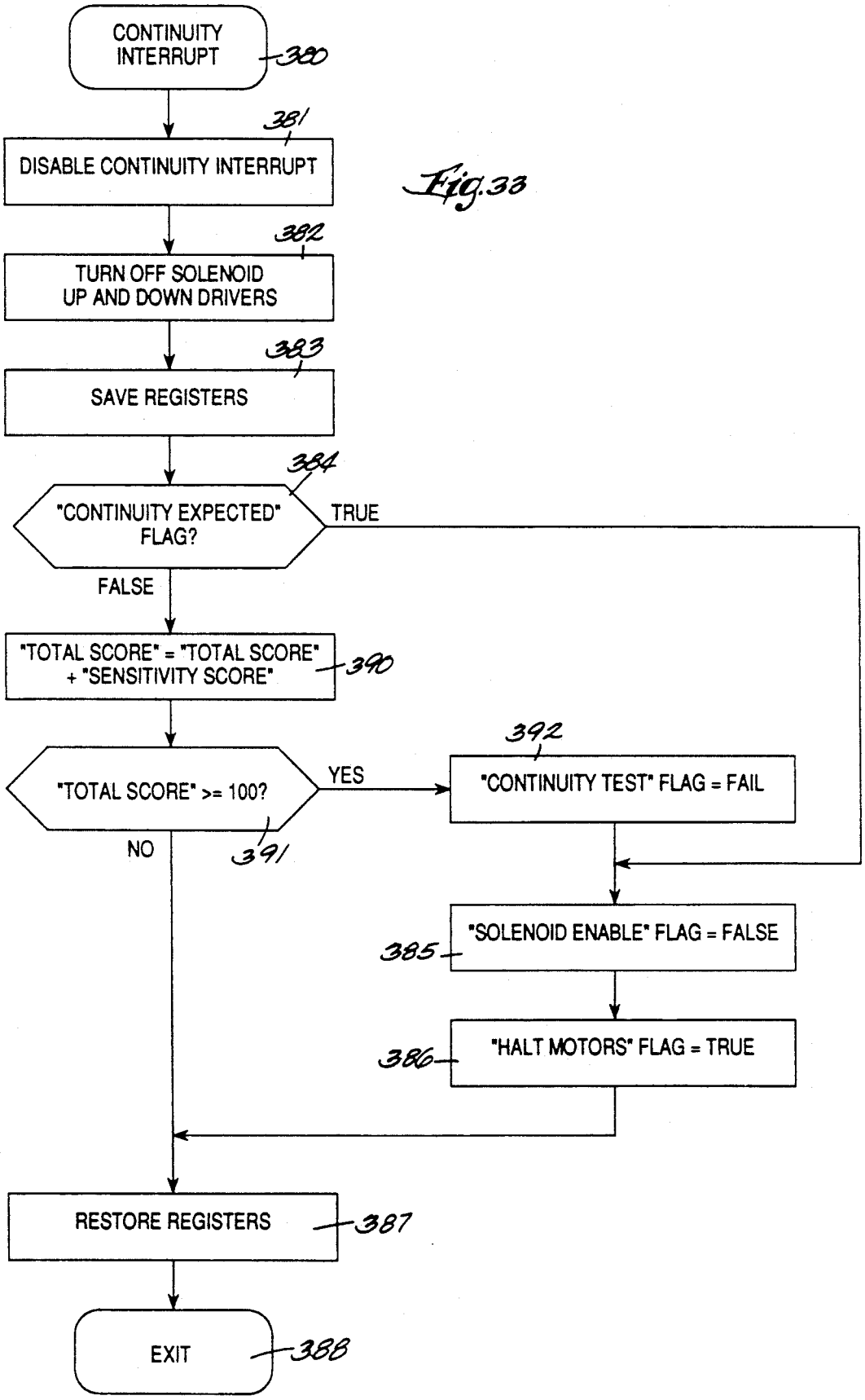
FIG. 33 is a flow chart of a "continuity interrupt" routine.

Referring to FIG. 33, the CONTINUITY INTERRUPT routine is entered at block 380 whenever the continuity interrupt is enabled and the plunger 201 makes electrical contact with the anvil 160 (as detected by the continuity sensing circuit 273). The first action taken at block 381 is to disable the continuity interrupt so that continued or repeated contact between the plunger 201 and anvil 160 does not result in repeated entry to the CONTINUITY INTERRUPT routine. The continuity interrupt is re-enabled by the SOLENOID TIMER INTERRUPT routine of FIG. 34 each time the plunger 201 begins a down stroke, so that each plunger down stroke is tested for continuity. At block 382, the solenoid "down" coil 217 is turned off to terminate as quickly as possible any continued down force of the plunger 201 against the anvil 160. The "up" coil 220 is also turned off, so that if subsequent error processing is found to be necessary, the "up" coil 220 will not be left "hanging" in an energized condition. At block 383, the internal registers of the microprocessor 230 are saved so that they may be used in the subsequent interrupt processing and later restored upon returning from the interrupt. Then at block 384, the CONTINUITY EXPECTED flag is tested to determine which of two modes are to be used for handling the continuity event. In one mode, continuity may be routinely expected (CONTINUITY EXPECTED flag "true"), as for example in the above described plunger depth test. In that case, any one single continuity event results in a branch to block 385, where the SOLENOID ENABLE flag is set "false" to inhibit further solenoid operation and to signal the continuity fault to other routines. Then at block 386, the HALT MOTORS flag is set "true" to stop any possible motion in progress, and further signal that a continuity event was detected. From block 386, a branch is taken to restore the registers at block 386 and exit at block 387. Alternately, if the CONTINUITY EXPECTED flag is "false" at block 384, then the other mode of handling the continuity event is executed beginning with block 390. This case is referred to herein as a "smart" continuity test because each continuity event is evaluated on an average basis rather than producing a pass/fail result based on a single continuity event. A predetermined number is assigned as a SENSITIVITY SCORE, which represents "bad" points. The normal SENSITIVITY SCORE used in this embodiment is twelve. The SENSITIVITY SCORE is added to a running TOTAL SCORE in block 390. At block 391, the TOTAL SCORE is compared to a predetermined limit, which in this case is a value of one hundred. If the TOTAL SCORE is under the limit, the continuity "smart" test remains in a "pass" condition to allow further operation of the solenoid 200. The TOTAL SCORE is automatically decremented by one "good" point by the SOLENOID TIMER INTERRUPT routine each time the "down" coil 217 for plunger 201 is energized. The TOTAL SCORE is therefore a running average of the number of plunger down strokes which result in a continuity event as compared to the down strokes which do not result in continuity. For example, with the normal values given above of 12 for the SENSITIVITY SCORE and 100 for the TOTAL SCORE limit, ten consecutive continuity events will be sufficient to cause the TOTAL SCORE to exceed the limit (the +12 score for the continuity event plus the −1 score for the down stroke is a net change of +11 in the TOTAL SCORE per down stroke which results in a continuity event). If some non-continuity producing down strokes of plunger 201 occur between the continuity events, then more than ten continuity events may be required to cause the TOTAL SCORE to equal or exceed the limit. As long as 11 or more non-continuity producing plunger down strokes occur for each down stroke which does result in continuity, on the average, then the TOTAL SCORE will remain at a relatively low, or zero value. In this way, occasional contact between the plunger 201 and anvil 160 is permitted, provided that such contact, on the average, does not become excessive. If too many continuity events occur, on the average, the TOTAL SCORE will exceed the limit, and appropriate error processing is performed. Specifically, if the TOTAL SCORE is found to exceed or equal the limit at block 391, a branch is taken to block 392 where a CONTINUITY TEST flag is set to FAIL as an indication of the failure of the continuity "smart" test. From block 392, processing proceeds to blocks 387 and 388 to restore the registers and exit the CONTINUITY INTERRUPT routine, respectively. If the TOTAL SCORE at block 391 is below the limit, then a branch is taken directly to block 387 for register restoration and then to exit block 388.

Referring to FIG. 34, the SOLENOID TIMER INTERRUPT routine 400 operates substantially as described above, and should be self-evident as illustrated to those skilled in the art. A SOLENOID STATE variable is used to keep track of and generate the phases of the plunger cycle shown in FIG. 26. State "1" is the "down" stroke of plunger 201, in which the "down" coil 217 is selectively energized based on the PLUNGER DOWN ENABLE flag, and the TOTAL SCORE is decremented (provided that it does not go below zero). State "3" is the "up" stroke of plunger 201, in which the "up" coil 220 of solenoid 200 is energized for either the normal value of 550 uS if the PLUNGER DOWN ENABLE flag is "true" (i.e. a normal solenoid/plunger cycle), or to a reduced value of 300 uS if the plunger 201 has not been fired "down" (i.e. holding the plunger 201 off the web 46 for movement without fracturing the web 46). States "2" and "4" are neutral, with both coils 217 and 220 "off" for 500 uS. State "4", being the end of the plunger cycle, includes a test of the PLUNGER FREERUN flag at block 401, which if true results in immediate initiation of another plunger cycle by loading the next timer value at block 402. If the PLUNGER FREERUN flag is not true at block 401, then the solenoid timer is reset and stopped at block 403.

Figure 35:
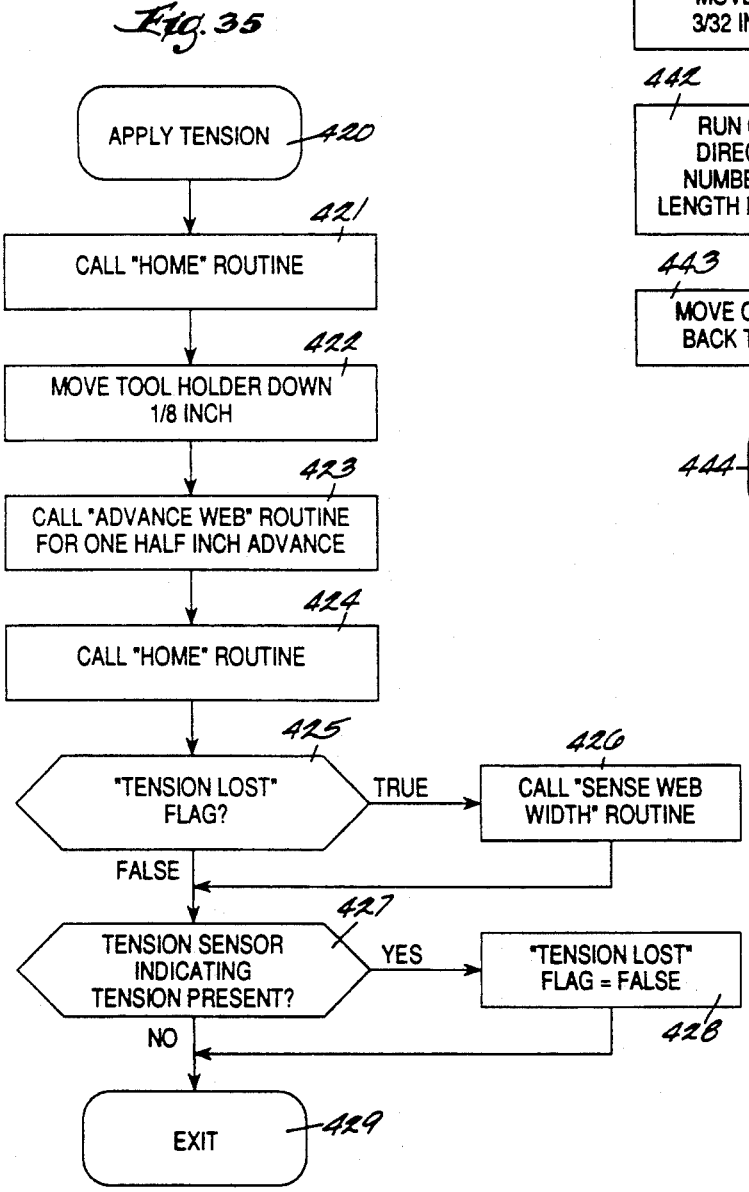
FIG. 35 is a flow chart of an "apply tension" routine.

Referring to FIG. 35, the APPLY TENSION routine is used to advance the web 46 a small predetermined amount in order to properly tension the web 46, and then to reset the parameters associated with web tension. Blocks 421–424 perform the appropriate motions to advance the web 46 for tensioning. The ADVANCE WEB routine called in block 423 is shown in detail in FIG. 36 and described below. Then at block 425, a TENSION LOST flag is tested. The tension sensor 192 is continuously polled at a one millisecond interval by an appropriate interrupt routine (not shown). If the tension sensor 192 is ever found to be indicating an absence of tension on the web 46, the TENSION LOST flag is set "true". Note that the TENSION LOST flag, once set true, remains true until explicitly reset to false, even if tension is subsequently restored to the web 46. This is done because it is assumed that each time tension has been lost, a web of different width may have been loaded into the machine 1, and therefore a new measurement of the web width may be required. If the TENSION LOST flag is found to be true at block 425, a branch is taken to block 426, where a call is made to a SENSE WEB WIDTH routine to measure the current web width. The SENSE WEB WIDTH routine is shown in FIG. 38, and is described in detail below. From either blocks 425 or 426, processing continues at block 427, where the tension sensor 192 is tested directly to determine if the web 46 is presently under tension. If it is, then a branch is taken to block 428 where the TENSION LOST flag is reset to false, indicating that currently measured web width is valid for as long as the TENSION LOST flag remains false. The APPLY TENSION routine then exits at block 429.

Figure 36:
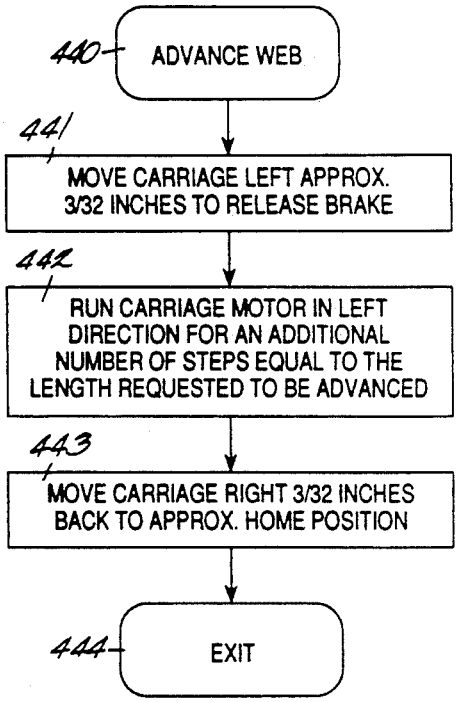
FIG. 36 is a flow chart of an "advance web" routine.
Figure 31:
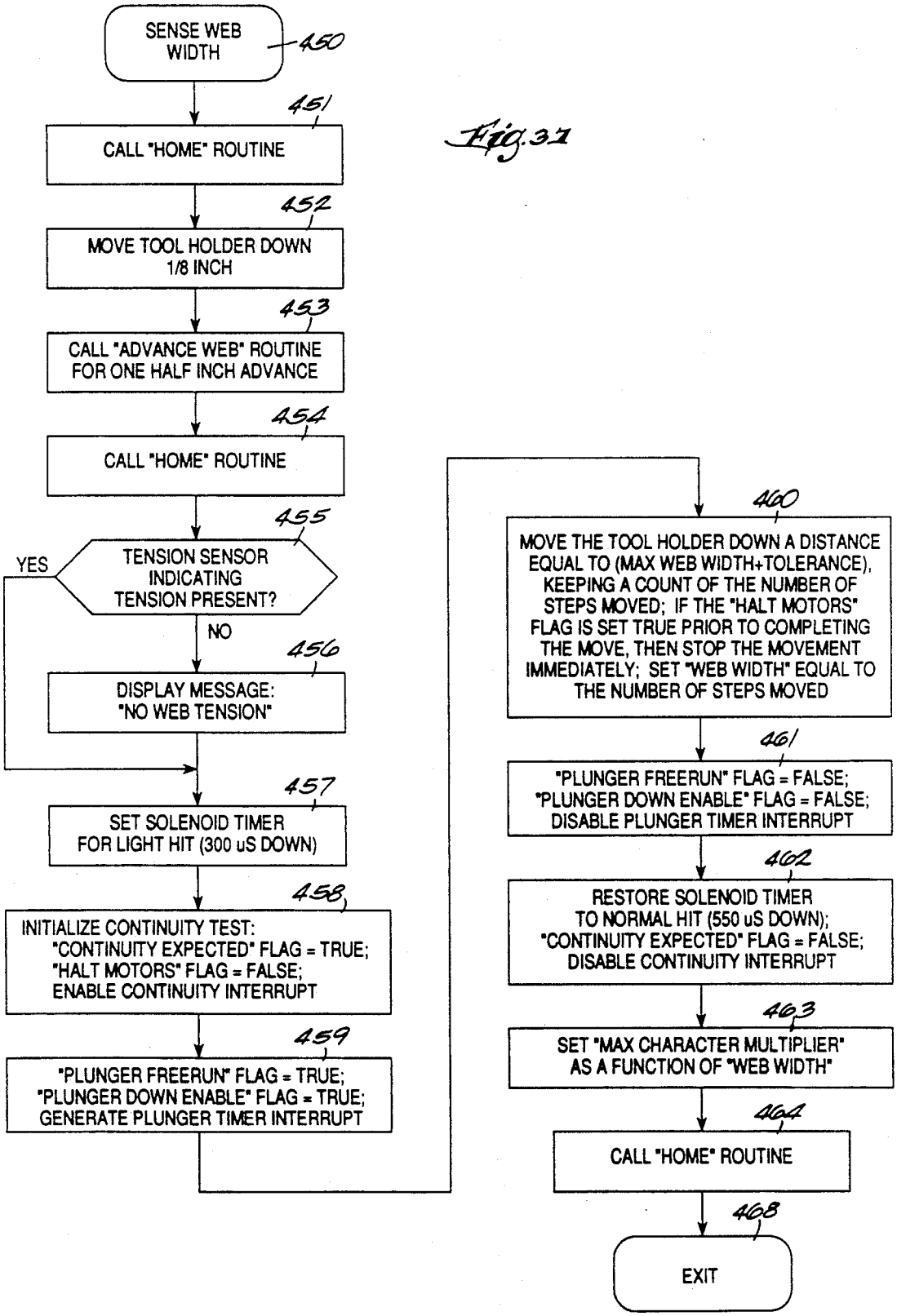

Referring to FIG. 36, the ADVANCE WEB routine is used as a utility by other routines described herein for performing small, programmed advances of the web 46. Calls to the ADVANCE WEB routine supply a parameter (not specifically shown) specifying the amount of advance required. The ADVANCE WEB routine is entered at block 440. At block 441, the carriage 110 is moved left approximately 3/32 inches (about 2 mm) to contact and, with a small amount of overtravel, release the brake mechanism 180 (it is assumed the tool holder 140 has previously been moved down to clear the flexible arm 178 before the ADVANCE WEB routine is called). Having released the brake mechanism 180, the stepper motor 119 is run an additional number of steps corresponding to the amount of advancement requested by the calling routine. Note that even though the stepper motor 119 continues to run during the advancement, apparently moving the carriage 110 to the left, the carriage 110 is in fact stopped up against the brake release 180, and the outfeed roller 30 is instead driven by belts 105 and 106, as described above, to advance the web 46 out of the machine 1. Then at block 443, the carriage 110 is moved back right about 3/32 inches (about 2 mm) to the approximate carriage home position, and the ADVANCE WEB routine exits at block 444.

Referring to FIG. 37, the SENSE WEB WIDTH routine is another utility routine called from other routines when it is desired to perform a measurement of the width of the web 46 currently loaded in the machine 1. Knowing the web width is important so that a check can be made that the characters requested to be formed on the web 46 will actually fit on the currently loaded web 46. It is understood that one function of the operator interface 303 is to provide for operator selection of size, or height of characters, with which to form the legends 307 and 308, through linear up-scaling of the character parameters in the font table 309. If the size of the characters requested to be formed is larger than will fit on the currently loaded web 46, then the tool holder 140 will run the plunger 201 off the edge of the web 46 and strike the anvil 160, which is an undesirable condition in itself due the increased wear on the plunger 201 and the potential for damage thereto, but which also results in wasting a portion of the web 46 on which only a portion of the characters were formed. The general approach taken to measure the web width is to move the tool holder 140 down, transversely across the web 46, while executing "light" downward strokes of the plunger 201. If an edge of the web 46 is encountered, continuity between the plunger 201 and the anvil 160 will be detected, and the position of the tool holder 140 (i.e. the number of steps moved downward) will represent the width of the web 46. Alternately, if the edge of web 46 is not encountered before moving the tool holder 140 a distance corresponding to the maximum allowable width for the web 46, then it is assumed that the width of the currently loaded web is equal to that maximum allowable width. Preparatory to performing the width measurement, a small amount of web 46 is advanced (approximately ½ inch or 13 mm) via the motion called for in blocks 451–454. At block 455, if the previous motion did not result in proper tensioning of the web 46, as indicated by the tension sensor 192, then it is assumed that the web supply has been exhausted, and an appropriate message is displayed at block 456. At block 457, the solenoid timer is set for reduced duration pulses on "down" coil 217 (i.e. "light" hits). Then in blocks 458 and 459, solenoid operation and the continuity test are initiated in a manner similar to that described above in relation to the PLUNGER DEPTH TEST routine of FIG. 32. At block 460, downward movement of the tool holder 140 is commanded for a distance equal to the maximum width of web 46 which can be loaded in the machine 1, plus a small additional tolerance value. If the movement of tool holder 140 is accomplished without sensing contact between the plunger 201 and anvil 160, then it is assumed that a web 46 of maximum width is presently loaded in the machine 1. Otherwise, if continuity between the plunger 201 and anvil 160 is detected, the motion is stopped immediately in response to the HALT MOTORS flag being set "true" by the CONTINUITY INTERRUPT routine, and the number of steps moved before the continuity was detected is stored as the current WEB WIDTH. Processing then proceeds at blocks 461 and 462, where the plunger and continuity variables are restored to their normal values. In block 463, a MAX CHARACTER MULTIPLIER variable is computed and stored based on the current web width as just measured. The MAX CHARACTER MULTIPLIER represents the maximum size of characters which can be formed on the currently loaded web 46, in terms of the largest multiplier which can be used for linear up-scaling of the characters in the font table 309. The MAX CHARACTER MULTIPLIER is examined in the FORM LEGEND routine to be described next to determine if the user specified character size is within the appropriate range. Finally, the SENSE WEB WIDTH routine returns the tool holder 140 and carriage 110 to the home position at block 464, and then exits at block 468.

Referring to FIG. 38, the FORM LEGEND routine is now described which actually forms the individual characters specified by one of the legends 307 or 308 onto the web 46 to thereby produce a sign 48. The FORM LEGEND routine enters at block 500 and proceeds to block 501. At block 501, the MAX CHARACTER MULTIPLIER is compared to a character multiplier corresponding to the user requested character size. If the current character multiplier exceeds the MAX CHARACTER MULTIPLIER, then the requested character size will not fit on the currently loaded web 46. In that case, a branch is taken to block 502, where the SENSE WEB WIDTH routine is called to verify the web width for the currently loaded web 46. After verifying the current web width, the test of the currently selected character multiplier is repeated at block 503. If the character multiplier is still too big, then an appropriate error message is displayed at block 504 before branching directly to exit block 505, terminating the FORM LEGEND routine. It is then expected that the operator will take corrective action, e.g. change the web 46 to a larger size, or request a smaller character size through the operator interface 303, and then repeat the request for formation of the legend.

Figure 39:
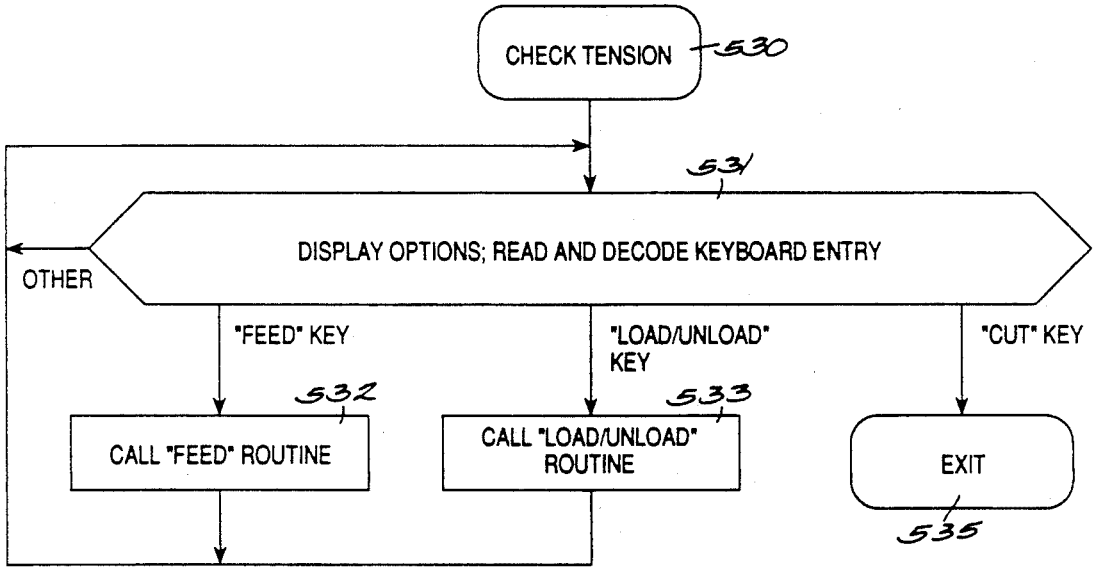
FIG. 39 is a flow chart of a "check tension" routine.

If the character multiplier is within the acceptable range at either block 501 or block 503, processing proceeds at block 510, where a test of the TENSION LOST flag is performed. If web tension has been lost at any time, the TENSION LOST flag will be "true", and the web width and current state of tension are considered unreliable. In that case, a branch is taken to block 511. At block 511, a CHECK TENSION routine is called as illustrated in FIG. 39. Referring briefly to FIG. 39, the CHECK TENSION routine suspends execution of the FORM LEGEND routine to afford the operator an opportunity to properly tension the web 46 for the pending legend formation. A command processor at block 531 allows the use of the FEED and LOAD/UNLOAD operations, as described above, for manipulation, reloading, etc., of the web 46. After the operator is satisfied with the web condition, the CHECK TENSION routine exits at block 535 back to the FORM LEGEND routine in response to depression of the CUT key.

Referring again to FIG. 38, upon returning from the CHECK TENSION routine at block 511, the SENSE WEB WIDTH routine is called at block 512 to measure the current web width. Then at block 513, the TENSION LOST flag is set "false" before branching back to block 510. At block 510, when the TENSION LOST flag is found to be false, then the web tension and current web width are assumed to be good, and processing proceeds at block 520. At block 520, the tool holder 140 is moved down ¼ inch (about 6 mm) from the home position, to a position which is defined as the "character reference point". All of the characters defined in the font table 309 are based on the character reference point as the starting position, so that the tool holder 140 and carriage 110 are now in position to begin formation of a character. Then at block 521, a CURRENT CHARACTER pointer is set to point to the first character in the legend to be formed. Proceeding to block 522, a PREVIOUS CHARACTER pointer is set to zero, indicating that there was no previous character, i.e. the current character is the first character in the legend currently being formed. The PREVIOUS CHARACTER variable is used in a FORM CHARACTER routine described below to control advancement of the web 46 based on the previously formed character (i.e. other than the first character).

At block 523, a call is made to the FORM CHARACTER routine, which then executes the actual formation of the character pointed to by the CURRENT CHARACTER pointer. The FORM CHARACTER routine is described in detail below, and returns a TERMINATION CODE indicating the outcome of the character formation just performed. A TERMINATION CODE of "A", tested for at block 524, indicates that the FORM CHARACTER routine was aborted by the operator. In that case, a branch is taken to block 525 to advance whatever portion of the character that did get formed out of the machine 1. Then at block 526, a WEB SERARATION SCORING routine, also described in detail below, is called to form a scoring pattern, as described in detail below, across the web 46 so that the sign 48 just formed may be easily separated from the remainder of the web 46 left in the machine 1. Back at block 524, if the TERMINATION CODE is not found to be "A", a similar test is made at block 527 to determine if the TERMINATION CODE is instead set to "C", which indicates that the FORM CHARACTER routine aborted due to a failure of the continuity "smart" test, i.e. excessive contacts between the plunger 201 and anvil 160. If the TERMINATION CODE is in fact set to "C", then a branch is taken back to block 523, without updating the CURRENT CHARACTER pointer, to repeat the formation of the same character. It will be clear from the description below that appropriate error processing is performed prior to returning with the continuity abort code "C", such that the machine 1 should now be in a condition to resume formation of the legend, beginning with the character which just aborted. Alternately, if the TERMINATION CODE is not equal to "C" at block 527, the character formation was completed normally, and processing continues at block 528. At block 528, a test is made to determine if the entire legend has been formed, i.e. all characters completed. If not, then a branch is taken to block 529, where the CURRENT CHARACTER pointer is updated to point to the next character to be formed. From block 529, processing loops back to block 523 to again call the FORM CHARACTER routine for the next characters to be formed. Eventually, all of the characters in the legend will be found to have been completed at block 528, and a branch is then taken, in sequence, to block 525 to advance the last character out of the machine 1, to block 526 for executing the WEB CUTOFF routine, and finally to exit the FORM LEGEND routine at block 505.

Figure 41:
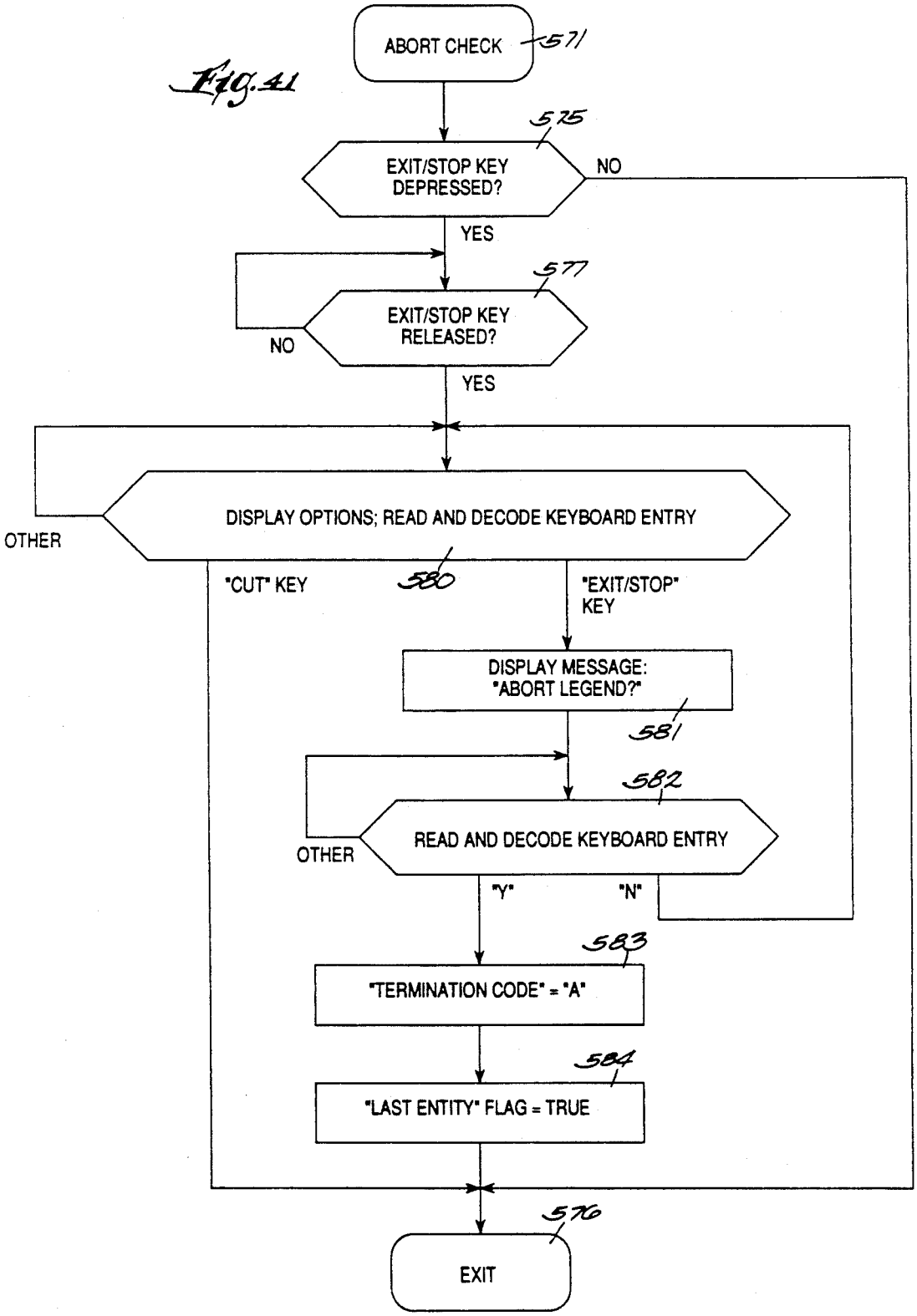
FIG. 41 is a flow chart of an "abort check" routine.
Figure 44:
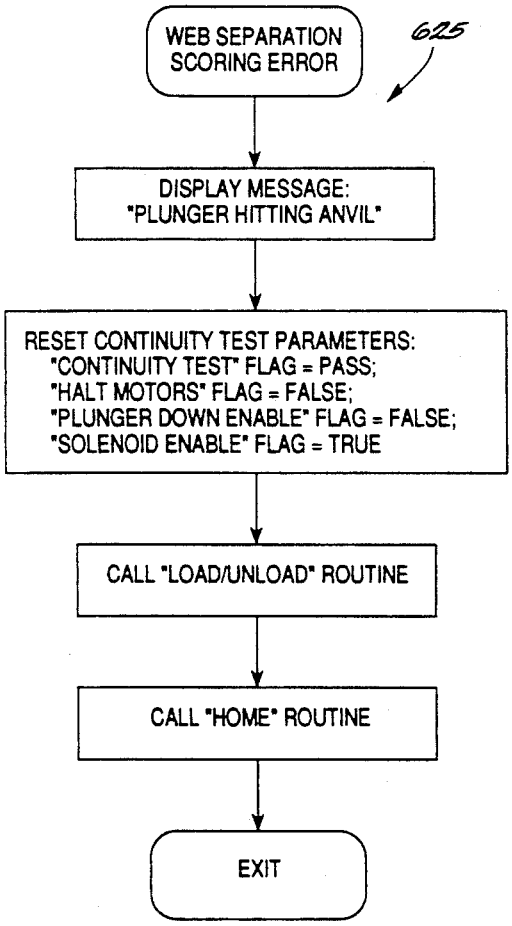
FIG. 44 is a flow chart for the WEB SEPARATION SCORING ERROR routine which is called by the WEB SEPARATION SCORING routine of FIG. 43*a;*

Referring to FIG. 40*a*, the FORM CHARACTER routine enters at block 550. At block 551, the TERMINATION CODE is set to a default value of "null". Unless changed to one of the abort codes as described below, the null value will be returned indicating normal completion of the FORM CHARACTER routine. Then at block 552, an ENTITY pointer is initialized to point to the first entity 311 in the font table 309 for the current character, i.e. the character pointed to by the CURRENT CHARACTER pointer. Following these initializations, a test is made at block 553 to determine if the tension sensor 192 is currently indicating that the web 46 is under tension. If it is not, a call is made to the CHECK TENSION routine at block 554, enabling the operator to rectify the situation as described above. After block 554, the test of tension sensor 192 is repeated at block 555 to verify that proper tension was applied during the CHECK TENSION routine. If the tension sensor 192 still indicates an absence of tension, the CHECK TENSION routine is reentered via a branch from block 555. The loop thus formed prohibits proceeding with character formation until tension has been applied to the web 46. If character formation were to be attempted without tension on the web 46, a serious and potentially damaging jam up would inevitably result. Once tension is found to have been restored at block 555, the tool holder 140, assumed to have been homed during the CHECK TENSION routine, is returned to the character reference point (¼ inch or about 6 mm down from the home position). From either block 553 or block 556, processing proceeds to block 559, where a test is made to determine if the current character is the first character in the legend, as indicated by the PREVIOUS CHARACTER pointer being equal to zero. If that is not the case, the spacing required between the previous character and the character about to be formed is computed in block 560. Then an advance of the previously formed character out of the machine 1 is performed in block 561, followed by movement back to the home position in block 562 and thence to the character reference point in block 563. If the PREVIOUS CHARACTER pointer is equal to zero in block 559, then there is no previous character to advance and the tool holder 140 is already at the character reference point, so blocks 560–563 are bypassed, with processing in either case continuing at block 564. At block 564, a LAST ENTITY flag is initialized to "false". As will be seen from the description below, the LAST ENTITY flag may be set "true" to force termination of the FORM CHARACTER routine upon an operator request to abort the legend formation. Continuing at block 565, the PLUNGER DOWN ENABLE flag is initialized to "false". It is assumed that the first entity in each character is a non-fracturing movement from the character reference point to the actual starting point for the character. If a certain character is in fact supposed to start at the character reference point, then a first entity is included which is a zero length movement. After the first entity, a state of "true" is assumed for the PLUNGER DOWN ENABLE flag (i.e. movement with fracturing) unless an entity includes a specific code to temporarily command a non-fracturing movement, for example, for movement to an interior portion of a letter. Then at block 566, the PREVIOUS CHARACTER pointer is set equal to the CURRENT CHARACTER pointer, preparatory to subsequent calls to the FORM CHARACTER routine for the current legend. The FORM CHARACTER routine continues on FIG. 40*b*, as indicated by blocks 570*a* and 570*b*, with a call to an ABORT CHECK routine at block 571. Referring for the moment to FIG. 41, the ABORT CHECK routine performs a scan of the keyboard 12 to determine if the EXIT/STOP key is currently depressed. If the EXIT/STOP key is not found to be depressed in block 575, then a branch is taken directly to block 576 to exit the ABORT CHECK routine. If, however, the EXIT/STOP key is found to be depressed at block 575, then formation of the current character is paused, pending further operator commands. Operator commands are processed in block 580, with the only recognized commands being the CUT key and a second depression of the EXIT/STOP key. A wait loop is performed at block 577 to insure that the first depression of the EXIT/STOP key has been released so that a second depression thereof can be detected. The CUT key is used to command exit from the ABORT CHECK routine for the resumption of character formation, while a second depression of the EXIT/STOP key is used to indicate a desire to abort formation of the current legend. An abort may be appropriate, for example, if the operator notices that the legend has been entered incorrectly, or otherwise is not desired, so as to prevent unnecessary waste of the web 46. If an abort is requested by a second depression of the EXIT/STOP key, a message is displayed at block 581 requesting the operator to verify the abort order. At block 582, the operator may then press either the "Y" key to confirm the abort, or the "N" key to return to the "paused" condition at block 580. If the "Y" key is pressed, then the TERMINATION CODE is set to "A" at block 583, to indicate the abort condition to the FORM LEGEND routine as described above. Then at block 584, a LAST ENTITY flag is set to "true", which forces a termination of the subsequent processing in the FORM CHARACTER routine, as described further below. From block 584, the ABORT CHECK routine exits at block 576.

Figure 42:
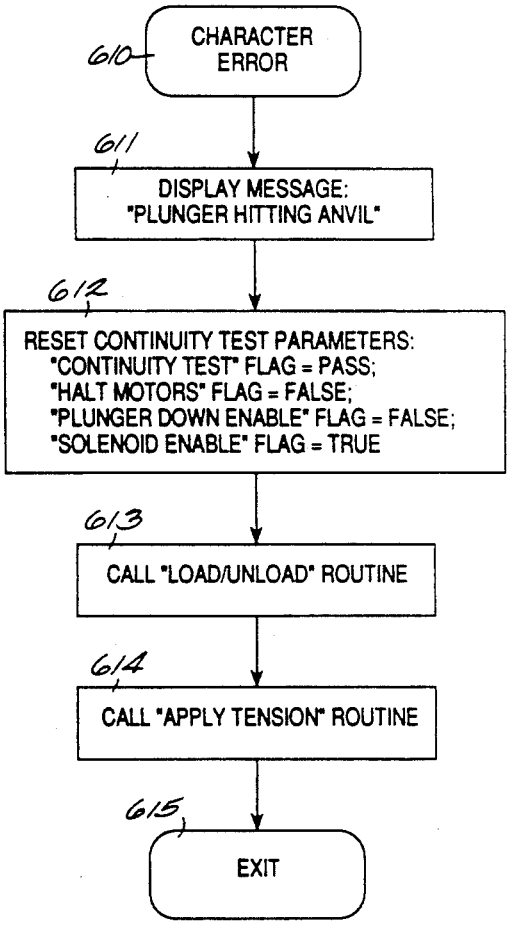
FIG. 42 is a flow chart of a "character error" routine.

Referring again to FIG. 40*b*, upon return from the ABORT CHECK routine, block 590 is executed, where the next entity to be formed, as pointed to by the ENTITY pointer, is retrieved from the font table 309. Then at block 591, the current entity is examined to determine if it is an END OF CHARACTER marker 312. If it is, formation of the current character is complete, and a branch is taken to block 592, where the PLUNGER DOWN ENABLE flag is set "false" before exiting the FORM CHARACTER routine at block 593. Back at block 591, if the entity 311 is not an END OF CHARACTER marker 312, then processing proceeds to block 594, where a similar test is made to determine if the entity 311 includes a PLUNGER UP code. Normally, it is assumed that all entity movements are to be made with the plunger 201 vibrating, thereby fracturing the web 46 during the movement. However, it is sometimes necessary, as mentioned above, to perform a movement without fracturing the web 46. In that case, an entity may include the PLUNGER UP code in addition to the other entity parameters, to specify that the current entity specifies a non-fracturing movement. If a PLUNGER UP code is specified in the current entity (block 594), a branch is taken to block 595, where the PLUNGER DOWN ENABLE flag is set "false". If the current entity does not include a PLUNGER UP code, then block 595 is bypassed, leaving the PLUNGER DOWN ENABLE flag "true". Note that the PLUNGER DOWN ENABLE flag was preset to "false" prior to processing the first entity 311 of the current character and, as will be noted later, is reset to "true" upon completion of the processing for each entity 311, so that all movements after the first entity default to a "plunger down" movement, unless the entity specifically contains the PLUNGER UP code. From either block 594 or 595, processing continues at block 596, where the ENTITY pointer is updated to point to the next entity 311 for the current character. Then at block 597, the LAST ENTITY flag is tested. If the LAST ENTITY flag has been set "true" by the ABORT CHECK routine as described above, then formation of the current character is terminated by exiting via blocks 592 and 593. Otherwise, processing continues at block 598 by enabling the continuity interrupt. The continuity test parameters are always returned to specify CONTINUITY EXPECTED =false and a SENSITIVITY SCORE of 12 points per contact, so that these values are assumed to be valid at this point without explicitly defining them. Therefore, the normal continuity "smart" test is enabled for the subsequent entity formation. At block 599, the motion defined by the current entity is pre-processed to compute basic incremental motion parameters for the carriage and tool holder drive motors 119 and 142, respectively. Proceeding to block 600, the plunger 201 is started vibrating by appropriate setting of the plunger control flags, and the HALT MOTORS flag is set "false" to enable motor operation. Now at block 601, the carriage and tool holder drive motors 119 and 142, respectively, are moved according to the motions computed in block 599. During the entity motion, the continuity "smart" test is active, and if it reaches the FAIL condition, the HALT MOTORS flag is set to terminate the entity motion. Once the entity motion is completed, or terminated by failure of the continuity "smart" test, the plunger 201 is stopped from vibrating at block 602. Then at block 603, the CONTINUITY TEST flag is examined. If the CONTINUITY TEST flag is in the PASS condition, the entity was formed normally, and a branch is taken to block 604, resetting the PLUNGER DOWN ENABLE flag to "true", prior to looping back to block 571 to repeat the process for the next entity. Otherwise, if the CONTINUITY TEST flag indicates the FAIL condition at block 603, a call is made to a CHARACTER ERROR routine at block 605. Referring briefly to FIG. 42, the CHARACTER ERROR routine deals with the error condition by first displaying an appropriate error message to the operator at block 611, and then resetting the continuity test flags as shown in block 612. Then at block 613, the LOAD/UNLOAD routine is called automatically to facilitate adjustment of the plunger depth. Upon return from the LOAD/UNLOAD routine, the APPLY TENSION routine is then called at block 614, followed by exiting from the CHARACTER ERROR routine at block 615. Referring again to FIG. 40*b*, upon returning from the CHARACTER ERROR routine at block 605, the TERMINATION CODE is set to "C" (for Continuity error) at block 606. The FORM CHARACTER routine is then completed by setting the PLUNGER DOWN ENABLE flag "false" at block 592 and exiting at block 593.

Figure 43C:
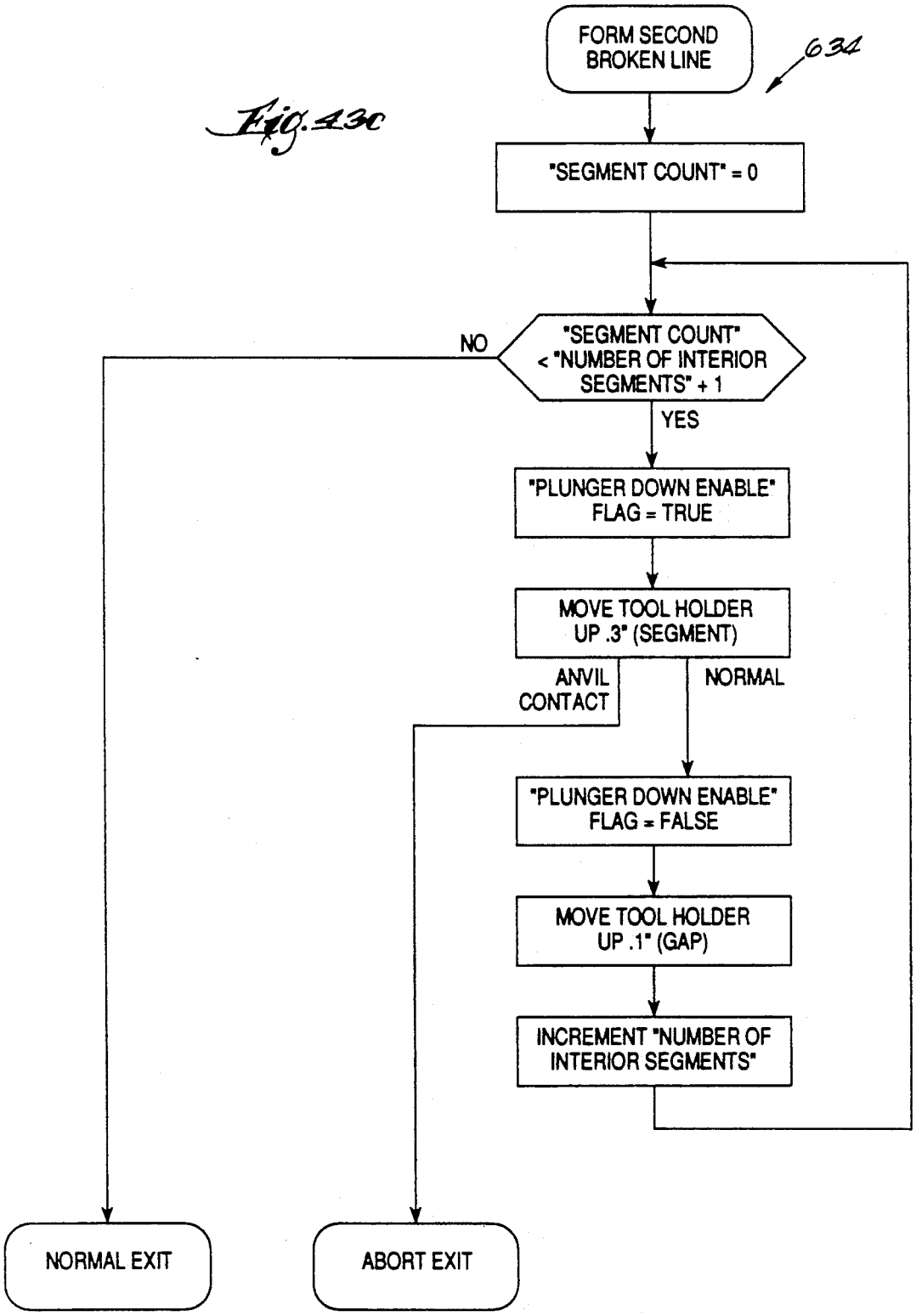
FIG. 43*c* is a flow chart for the FORM SECOND BROKEN LINE routine which forms a part of the WEB SEPARATION SCORING routine of FIGS. 43*a;*
Figure 50:
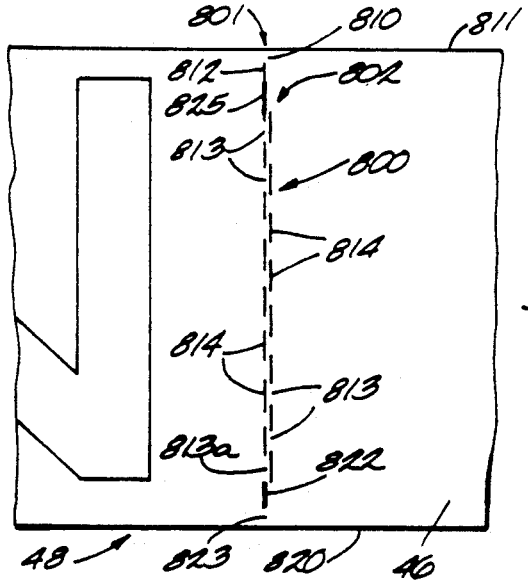
FIG. 50 is a plan view, with portions broken away, of the web separation scoring produced by the software routines of FIGS. 43*a*–43*c* prior to actual separation of the sign from the web.

Referring to FIGS. 43*a*–43*c*, the WEB SEPARATION SCORING routine is called from the FORM LEGEND routine after a sign 48 has been formed and advanced out of the machine 1. The function performed by the WEB SEPARATION SCORING routine is to form a transverse tear line means across the web so as to facilitate separation of the sign 48 from the sheet material 46 remaining in the machine 1. The transverse tear line means can be of various constructions; a presently-preferred form is illustrated comprising two closely spaced and staggered tear lines so that separation of the sign 48 from the remaining sheet material 46 involves some degree of tearing so that the resulting edge is rough and jagged. This tends to expose and partially separate the individual layers of the web 46 near the edge, thereby greatly facilitating delamination of the layers for subsequent application of the sign 48. In this software section (g), FIGS. 43*a*–43*c* describe the routines which perform the web separation scoring, while in FIGS. 50 and 51 to be described later, the scoring pattern produced and the delamination process are described and illustrated in detail. Referring briefly now to FIG. 50, the illustrative tear line means 800 in general comprises two tear lines 801 and 802 offset by 0.05 inches (about 1.3 mm). Each tear line 801 and 802 includes a plurality of segments 812, 814 and 822 (portions of the web 46 fractured by vibration of the plunger 201) separated by gaps 813 (unfractured portions). The segments 812, 814 and 822 of the two respective tear lines 801 and 802 are arranged to be staggered with respect to each other, i.e. each segment 814 on one of the tear lines 801 or 802 is across from a gap 813 on the other broken line. In addition, some portions 825 and 822 of at least one tear line 801 are double fractured (i.e. passed over twice with the plunger 201 vibrating) near an edge portion 810 and 823, respectively, of the web 46 to facilitate starting the separation tear. The operation of the routines of FIGS. 43*a*–43*c* should be readily understood by those skilled in the art in view of the following general comments. In FIG. 43*a*, the carriage 110 and tool holder 140 are moved clear of the corner post 23 in blocks 621–623 preparatory to forming the tear line means 800. At block 624, the plunger 201 is started vibrating, or reciprocating, and the "smart" continuity test is enabled. If the "smart" continuity test fails, an ABORT branch is taken to block 625, where a call is made to a WEB SEPARATION SCORING ERROR routine. The WEB SEPARATION SCORING ERROR routine is shown in detail in detail in FIG. 44, and operates in a manner similar to the CHARACTER ERROR routine of FIG. 42. After the error processing in block 625, the WEB SEPARATION SCORING routine proceeds to block 626 to move the tool holder 140 back to the character reference point, and a branch is then taken back to block 621 to repeat the web separation scoring process. Note that the WEB SEPARATION SCORING routine is repeated until successful, i.e. without contact between the plunger 201 and anvil 160.

Still referring to FIGS. 43*a*–43*c*, at block 630 of FIG. 43*a*, the first of the two tear lines is formed as shown in detail in FIG. 43*b*. In forming the first tear line 801, the segments 812, 814 and 822 of the line are formed sequentially down the web 46, maintaining a count of the segments 814 formed between an initial segment 812 and a terminal segment 822 (the count being referred to as NUMBER OF INTERIOR SEGMENTS). The NUMBER OF INTERIOR SEGMENTS count is then used later (FIG. 43*c*) as a reference in forming the segments 814 of the second tear line 802. Specifically, the second tear line 802 includes a number of segments 814 equal to "NUMBER OF INTERIOR SEGMENTS +1", with the segments 814 in the second tear line 802 being staggered with respect to the segments 814 in the first tear line 801. After forming the first tear line 801 at block 630 of FIG. 43*a*, processing proceeds to block 631 where the last, or terminal segment 822 of the first tear line 801 is retraced upwards with the plunger 201 still vibrating (i.e. "double fractured"). Then the plunger vibration is suspended at block 632 to move the carriage 110 into position to form the second tear line 802, i.e. moved rightwardly by a distance of 0.05 inches (about 1.3 mm), at block 633. The second tear line 802 is then formed at block 634, which is shown in detail in FIG. 43*c*. Upon completing the second tear line 802, carriage 110 is moved back left 0.05 inches (about 1.3 mm) at block 635 to place the tool holder 140 over an interior portion of the initial segment of the first tear line. Then at block 636, a 0.2 inch portion 825 (approximately 5 mm) of the initial segment 812 is retraced, i.e. double fractured, to complete the scoring process. At block 638, the plunger vibration is halted. The tool holder 140 is then moved down ¼ inch (about 6 mm) at block 639 before calling the ADVANCE WEB routine at block 640 to advance the tear line means 800 out of the machine 1. Finally, the HOME routine is called at block 641 to place the carriage 110 and tool holder 140 at their respective home positions before exiting at block 642.

(h) Sign Formation, FIGS. 45–49

A singular advantage of signmaking machine 1 as described above is its versatility with respect to being useful to form signs from a variety of adhesive sheet materials. Further, the machine can form a sign by directly contacting a layer of adhesive sheet material that is to be formed into a sign or by indirectly contacting the layer that is to be formed into a sign. Several useful sheet material constructions are illustrated in FIGS. 45–49.

Figure 45:
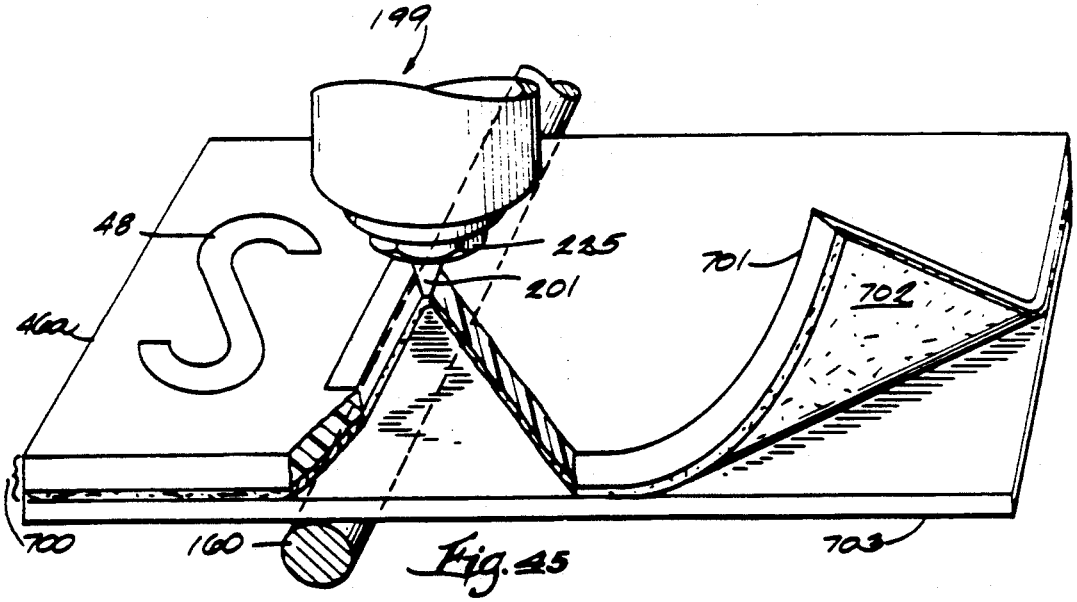
FIG. 45 is a perspective view of the machine of FIG. 1 forming a sign in a two element adhesive sheet material.
Figure 46:
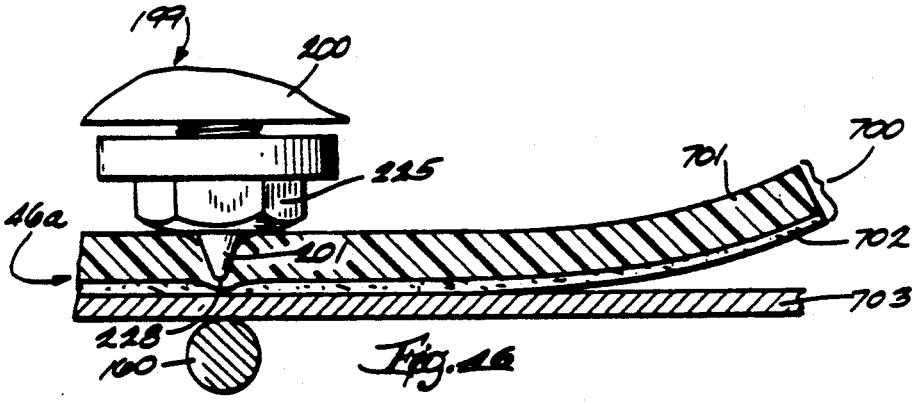
FIG. 46 is a sectional view of the sign formation of FIG. 45.

Turning first to FIGS. 45 and 46, adhesive sheet material 46*a* is a two element composite structure including sign tape 700 consisting of a plastic film layer 701 with a layer of pressure sensitive adhesive 702 on its bottom surface; the second element is a liner 703 releasably adhered to the pressure sensitive adhesive layer 702. Plunger 201 of the character forming mechanism 199 of the machine contacts sign tape 700 along anvil 160 and is reciprocatingly driven by solenoid 200 to impact film layer 701 with sufficient force, turning now to FIG. 46, to compress layer 701 a predetermined degree as selected by adjustment of nut 225 and thereby cause slight linear fracturing of sign tape 700 under the end 228 of plunger 201. Film layer 701 of adhesive sheet material 46*a* is selected to have a sufficiently low degree of elongation to enable character formation in this manner. Sign 48 is formed in sign tape 700 in this fashion under control of the programmed instructions of the software previously described. After the selected sign has been completely formed, a section of the web of sheet material 46*a* containing the sign is severed from the balance of the web as described above, the waste material of sign tape 700 is stripped from around the sign, and liner 703 is removed to expose the adhesive on the under surface of the sign characters so that the sign can be applied to the surface of an object. Also, if desired, a separate carrier tape having a layer of low tack adhesive on its bottom surface can be applied over the exposed outer surface of the sign characters and then employed to lift the characters from the liner so as to expose the adhesive 702 on the bottom surface of the characters for application of the sign to a surface. The signmaking operation illustrated in FIGS. 45 and 46 is an example of direct contact of the plunger 201 with the sign tape element of adhesive sheet material.

Figure 47:
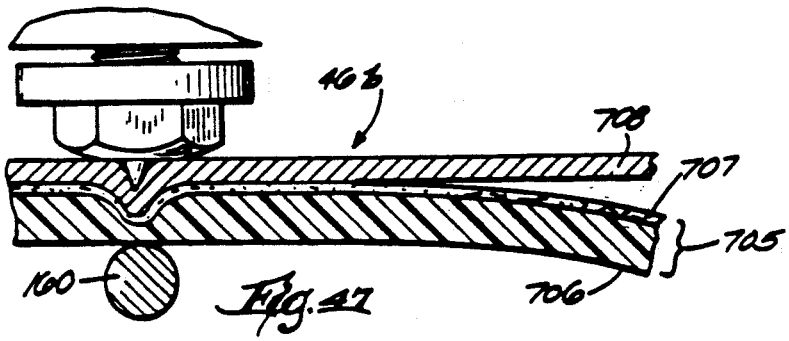
FIG. 47 is a sectional view of the machine forming a sign in another two element adhesive sheet material.

FIG. 47 illustrates the use of signmaking machine 1 for forming signs by indirect contact with the sign tape element of a two element adhesive sheet material 46*b*. The sign tape 705 of sheet material 46*b* consists of plastic film layer 706 with a layer of pressure sensitive adhesive 707 along one of its surfaces. The other element of sheet material 46*b* is a release liner 708 which is releasably adhered over adhesive layer 707 of the sign tape. Liner 708 of adhesive sheet material 46*b* is to have a high degree of elongation, such as in the range of about 300% to 600%, preferably about 500% elongation. When plunger 201 is driven by the character forming mechanism of the machine, rounded end 228 of the plunger contacts stretchable liner 708 along anvil 160 so as to stretch and compress the liner to transmit the impact force against the sign tape 705 and cause linear fracturing thereof under the end of the plunger. Stretchable liner 708 is not cut through by plunger 201 but, instead, is embossed by the plunger during this type of sign formation. Waste material surrounding the sign formed in sign tape 705 and application of the formed sign to the surface of an object can be the same as described above in connection with sheet material 46*a*.

Figure 48:
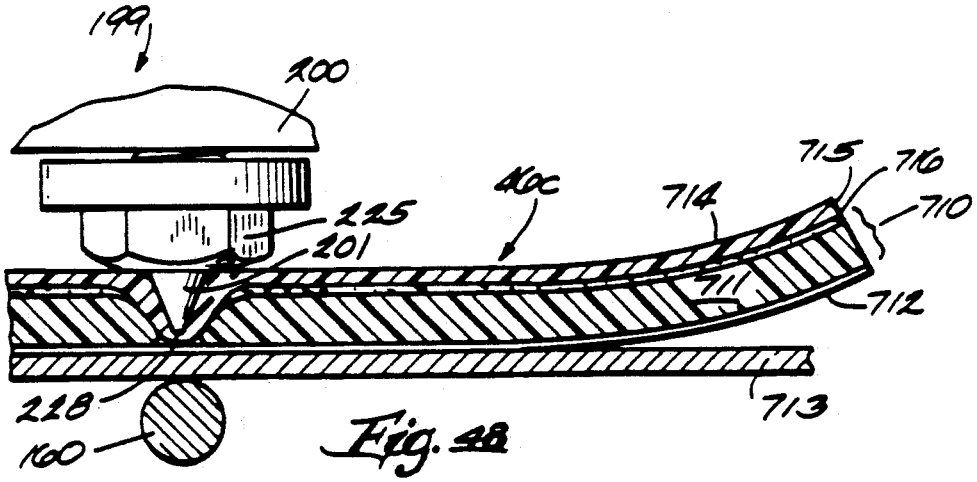
FIG. 48 is a sectional view of the machine of FIG. 1 forming a sign in a three element adhesive sheet material.

FIG. 48 illustrates the use of signmaking machine 1 to form a sign from a three element adhesive sheet material 46*c*. The sheet material 46*c* includes sign tape 710 consisting of plastic film layer 711 with a layer of pressure sensitive adhesive 712 bonded to one of its surfaces. A release liner 713 covers adhesive layer 712. The third element of the construction is a carrier tape 714 that is applied over the opposite surface of sign tape 710 and consists of a layer 715 of plastic film having a layer 716 of low tack adhesive on one of its surfaces. The low tack adhesive 716 is releasably adhered to the exposed upper surface of film layer 711 of the sign tape element of the sheet construction. Layer 715 of carrier tape 714 is selected to have a high degree of elongation, preferably in the range of about 300% to 600%, most preferably about 500%, elongation.

Plunger 201 of character forming mechanism 199 of the machine impacts upon the carrier tape 714 of sheet material 46*c* along anvil 160 and stretches and/or compresses the carrier tape a sufficient degree to cause fracturing of sign tape 710 of the sheet material under rounded end 228 of the plunger. Using the programs described in section (g) above, the machine is controlled to form a sign in the sign tape of the sheet material as selected by the operator. The signmaking operation shown in FIG. 48 is an example of indirect sign formation inasmuch as the plunger 201 does not directly contact the sign tape element 710 of sheet material 46*c*. After a selected sign has been formed in a section of the sheet material, the section with the sign is severed from the web, such as along the web separation scoring described in section (g). To apply the sign to the surface of an object, carrier tape 714 is peeled from the section of sheet material and carries with it the characters formed in sign tape 710, following which the exposed adhesive 712 on the underside of each character of the sign is pressed against the surface of an object to adhere the sign in the selected position. The carrier tape is then removed and releases readily from the sign characters since the bond of low tack adhesive layer 716 of the carrier tape to the characters is substantially less than the bond of adhesive layer 712 to the surface of the object.

Figure 49:
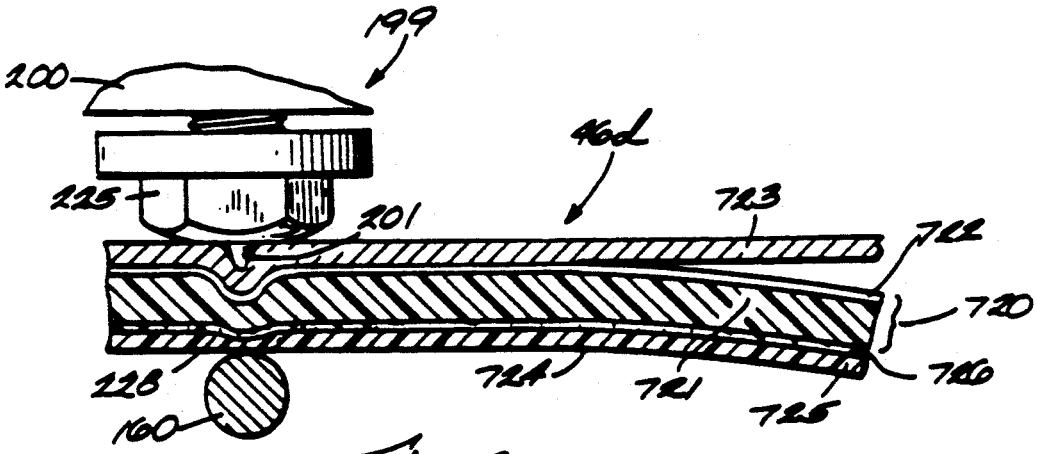
FIG. 49 is a sectional view of the machine forming a sign on another three element adhesive sheet material.

FIG. 49 illustrates signmaking machine 1 used to form a sign from adhesive sheet material 46*d*, which is another form of a three element sheet construction. Sign tape 720 of sheet material 46*d* is of the same construction as sign tape 710 of sheet material 46*c* of FIG. 48 and consists of a layer 721 of plastic film having a layer 722 of pressure sensitive adhesive along one of its surfaces. Release liner 723 is releasably adhered over the layer 722 of adhesive. The third element of the construction consists of carrier tape 724 comprising a layer 725 of paper or plastic film having a layer 726 of low tack pressure sensitive adhesive along one of its surfaces. Low tack adhesive layer 726 of the carrier tape is releasably adhered over the surface of the sign tape opposite from liner 723. In this construction, liner 723 is selected to have a high degree of elongation, such as in the range of about 300% to 600% elongation, preferably about 500% elongation. Plunger 201 of the character forming mechanism 199 is reciprocatingly driven by solenoid 200 so as to impact against the stretchable liner 723 of the construction along anvil 160 and stretch and/or compress it a sufficient amount to cause fracturing of the sign tape 720 under end 228 of the plunger. The sign formation operation with sheet material 46*d* is the same as that described above in connection with sheet material 46*c*, but the plunger operates against the stretchable liner of the construction instead of the carrier tape of the construction as in sheet material 46*c*. Removal of the sign formed in the sign tape 720 and its application to the surface of the object is the same as described in connection with sheet material 46*c*. Particularly useful three element adhesive sheet materials 46*c* and 46*d* are described and claimed in copending commonly-assigned U. S. patent application Ser. No. 07/595,079, filed Oct. 10, 1990, entitled "Adhesive Sheet Materials for Signmaking Machines," Aeschbacher et al, the disclosure of which is incorporated herein by reference.

Adhesive sheet materials 46*a*–46*d* described above each include a sign tape comprising a single layer of plastic film. However, the sign tape can include two or more layers of plastic film and each layer can be of a different color so that the machine can be employed to form signs having characters of one color against a background of a different and contrasting color.

Another useful aspect of the sign formation operation of machine 1 is that the machine can be programmed to make a double pass around sections of some letters that may be difficult to weed or separate from waste material of the signage element. For example, the center sections of the letters "A", "O", or "P" can be formed by a double pass of the character forming mechanism 199 for this purpose.

As described above, the character forming mechanism of the signmaking machine 1 is reciprocally driven so as to impact adhesive sheet material to define characters along the sign tape element of adhesive sheet material. Further, the characters defined by the character forming mechanism are to be separable from the balance of the sign tape element of the sheet material so that they can be separated therefrom and applied as a sign to the surface of an object. The plunger, driven to reciprocate or vibrate at a high cyclic rate and transported to form overlapping impacts along the adhesive sheet material during character formation, produces successive connected fractures along the sign tape in order to define the characters. In two layer sheet materials such as 46*a* and 46*b*, the sign tape element is fractured in this manner to form separable characters, and the liner may be slightly embossed by the impacting action of the plunger. In the three layer adhesive sheet materials 46*c* and 46*d*, the sign tape element also is fractured in the foregoing manner, in addition to which either the liner or the carrier tape, or both, may also be slightly embossed in the outline or configuration of a character.

Figure 51:
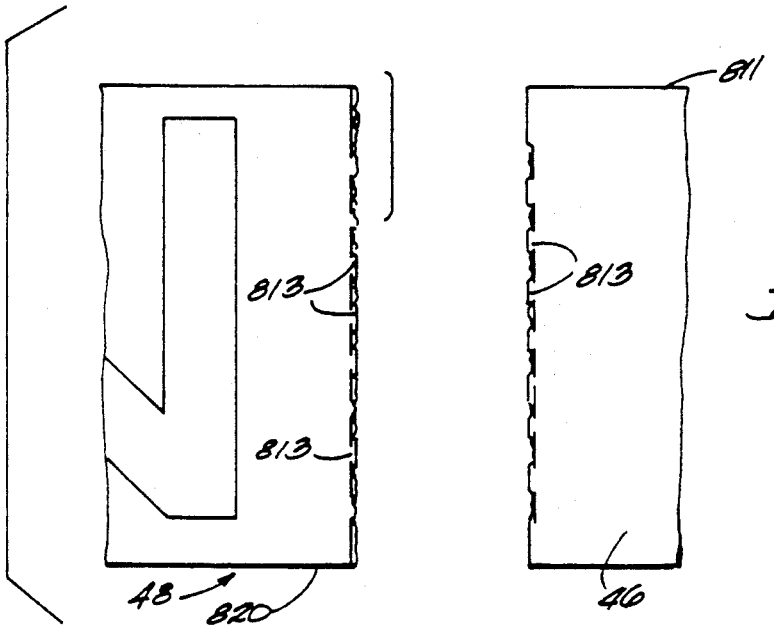
FIG. 51 is a plan view, with portions broken away, of the web separation scoring of FIG. 50 after separation of the sign from the web.
Figure 52:
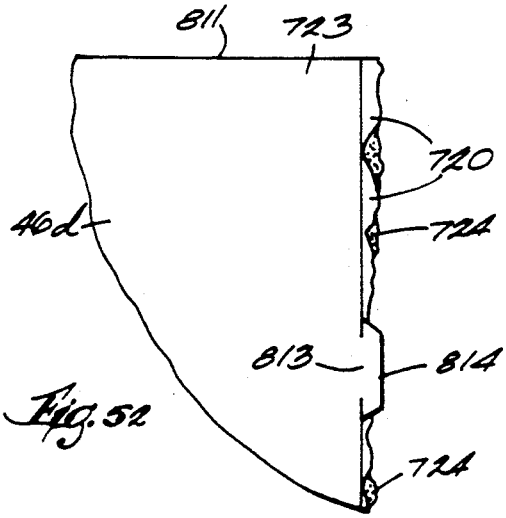
FIG. 52 is an enlarged plan view of part of the separated sign of FIG. 51.

(i) Separation of the Sign Assembly from the Web, FIGS. 50–52

A preferred scoring pattern for facilitating separation of the sign 48 from the remainder of the web of sheet material 46 is shown in FIG. 50. The scoring is produced by reciprocating plunger 201 to fracture the sign tape of the web in the same manner in which letters are formed, except that the scoring is performed transversely across essentially the entire web width. The routines responsible for actually forming the scoring are described above in the software section (g) relating to FIGS. 43*a*–43*c*. It should be noted that the fracturing used in the scoring process does not necessarily penetrate all layers of the web 46, but instead fractures the sign tape and may introduce a pronounced embossing or weakness of other layers of the web 46, along which the web 46 may be easily torn by the manual application of a shearing force. Referring to FIG. 50, the preferred transverse tear line means 800 includes first and second transverse tear lines 801 and 802. The tear lines 801 and 802 are offset from each other by a small distance along the longitudinal axis of the web, with an offset of 0.05 inches (about 1.3 mm) being preferred in this embodiment. Each tear line 801 and 802 includes a plurality of co-linear spaced line segments 812, 814 and 822 defined along web 46 along which the sign tape has been fractured, with the segments 812, 814 and 822 being separated by gaps 813 and 821 along which the sign tape 46 has not been fractured. The specific preferred pattern of tear line means 800 is as follows. The first tear line 801 begins with an unfractured first edge portion 810 which extends approximately ⅛ inch (about 3 mm) down from a first edge 811 of the web 46 to the beginning of an initial segment 812 formed in the sign tape. The initial segment 812 is approximately 0.5 inches long (about 13 mm). The initial segment 812 is followed by a gap 813 of approximately 0.1 inches (about 2.5 mm). Then, a series of segments 814 are formed in the sign tape, each of which is approximately 0.3 inches long (about 8 mm), with each segment 814 being separated by a non-fractured gap 813 of 0.1 inches (about 2.5 mm). The gap 813 and segment 814 pattern is repeated until the last such segment 814 is within approximately 0.55 inches (about 13 mm) from a second edge 820 of the web 46 (see FIG. 43*b*). At that point, a terminal gap 813*a* of approximately 0.2 inches (about 5 mm) is skipped (i.e. not fractured) and a terminal segment 822 is fractured. The terminal segment 822 has a variable length, extending from the end of the terminal gap 813*a* to approximately 0.2 inches (about 5 mm) from the second web edge 820, thereby leaving an unfractured second edge portion 823 of 0.2 inches (about 5 mm) between the terminal segment 822 and the second web edge 820. It should be noted that the tear line means 800 thus automatically adapts to webs 46 of different widths by varying the number of segments 814 formed and the length of the terminal segment 822. The terminal segment 822 is first fractured in a downward direction, i.e. moving towards the second web edge 820, and is then retraced, i.e. double fractured, moving upward, back toward the first edge 811 of the web. After double fracturing the terminal segment 822, the carriage 110 is moved 0.05 inches (about 1.3 mm) to the right to begin formation of the second tear line 802. The second tear line 802 begins with a 0.3 inch (about 8 mm) segment 814 formed in the sign tape which extends upwards, i.e. towards the first web edge 811, starting from a point across from the junction between the terminal gap 813*a* and terminal segment 822, and extending to a point approximately 0.1 inches (about 2.5 mm) up from the end of the last segment 814 in the first tear line 801. In other words, the bottom segment 814 in the second tear line 802 "covers" all of the terminal gap 813*a* and the first 0.1 inches (about 2.5 mm) of the bottom segment 814 in the first broken line 801. The second tear line 802 then continues with a 0.1 inch gap (about 2.5 mm), followed by another segment 814. The gap 813 and segment 814 pattern is then repeated until the second tear line 802 has a number of segments 814 which is one greater than the number of segments 814 in the first tear line 801. It should therefore be evident that each segment 814 in the second tear line 802 "covers" or spans a gap 813 in the first tear line 801, and vice versa. In effect, the respective segments 814 in the first and second tear lines 801 and 802 are staggered with respect to each other, with the gaps 813 between co-linear segments being longer than the separation between the tear lines 801 and 802. In that way, when a shear force is applied, the resultant tearing will tend to "jump" between the first and second tear lines 801 and 802 in an irregular pattern, producing the desired jagged edge. Upon completion of the second broken line, the carriage 110 is moved back left 0.05 inches (about 1.3 mm) to again place the plunger 201 over the first tear line 801, specifically at a point about 0.1 inches (about 2.5 mm) up from the bottom end of the initial segment 812. From that point, a 0.2 inch portion 825 of the initial segment 812 is retraced upwards, i.e. towards the first web edge 811, to produce a double fracture along that portion 825. The tear line means 800 is then complete, and has resulted in double fractured portions 825 and 822 near each web edge 811 and 820, respectively. The double fractured portions 825 and 822 are preferred to provide an additional weakness in the web 46 near the edges, where the tearing can then be easily started.

The overall purpose of utilizing the preferred offset, staggered tear lines 801 and 802 is to not only facilitate separation of the sign 48, but in addition to produce a "tearing" effect which leaves a rough, jagged edge on the separated sign 48. Referring now to FIGS. 51 and 52, the tearing operation inherently produces irregular, random tears between the first and second tear lines 801 and 802, but more importantly, the various layers comprising the web 46 tend to tear differently instead of in exactly the same pattern. As a result, portions of each layer will be exposed or separated from adjacent layers. Also, because a shear force is used in the tearing operation, as the web tears the jagged fringes of the outer layers may partially delaminate in some places. Both of these effects have the beneficial result of greatly facilitating subsequent separation of the sign 48 from the sheet material, specifically by exposing enough area of the outer layers of the sheet material to be easily grasped. An example of a typical tear pattern for the three layer web construction 46*d* is shown by the enlarged view of FIG. 52. Of course, each tear will be somewhat different, but usually the outer layers, either the release liner 723 or the carrier tape 724 will be torn away to expose the sign tape 720. Exposed portions of liner 723 and/or carrier tape 724 may then be grasped with the fingers to peel the layers apart for application of the sign tape 720.

The machine 1 also can be programmed to define constructions of the transverse tear line means other than offset tear lines 801 and 802 described above. A single tear line comprising a plurality of spaced fractured segments 814 can be defined in the sign tape by the character forming mechanism of the machine to provide a transverse tear line means. Also, a single continuous tear line can be defined in the sign tape, extending from one edge to the other edge of the sheet material, to provide a transverse tear line means. Still other constructions can be designed and appropriately programmed for defining a transverse tear line means along the web of adhesive sheet material along which a completed sign 48 can be manually torn from the balance of the web 46 after all of its characters have been formed.

(j) Discussion

The reciprocally driven plunger as a character forming element is a unique element for producing signs from adhesive sheet material, which, it is believed, has not heretofore been employed in signmaking machines. Many prior art signmaking machines use a knife as a cutting mechanism that shears or slits sheet material in order to define characters. The reciprocating plunger of machine 1 has several advantages as compared to a machine with a knife mechanism. The plunger system does not require a third axis of control as is the case with most knife cutting mechanisms wherein the knife must be rotated about a vertical axis in addition to being transported in the X and Y directions in order to produce curved cut lines in the sheet material such as around a letter or number. Providing for rotating a knife cutting mechanism about a third axis requires additional equipment, such as an additional stepper motor for example, electronics and software in order to obtain appropriate control. Knife cutting signmaking machines require a castoring mechanism or similar technique when a sign with large enough characters is to be formed in the sheet material. Second, the plunger character forming element described above is capable of forming signs in a wider range of adhesive sheet materials than can be processed by a signmaking machine with a knife cutting mechanism. As described in section (h), the reciprocating plunger can be used to form signs from adhesive sheet material that has a two element construction comprising a sign tape and a release liner, a three element construction in which characters are to be formed in the middle sign tape element of the construction, or sheet material of four or more layers; that is, the reciprocating plunger character forming element enables forming characters in a selected layer or selected layers of two layer and multiple layer adhesive sheet material constructions. By contrast, however, a signmaking machine utilizing a knife cutting mechanism cannot be used with as broad a range of sheet materials because the knife must penetrate into and through the layer in which characters are to be cut and any layers above or below it in the construction; for example, a knife cutting mechanism cannot cut characters in only the middle layer of a three layer construction. Some signmaking machines also are known in the prior art that employ a heated pin that punctures the adhesive sheet material and forms characters by thermal cutting. The reciprocating plunger element of the present invention is also advantageous as compared to a thermal pin cutting mechanism in that it can be used with a broad range of adhesive sheet materials instead of being limited to materials that can be cut with thermal cutting. A signmaking machine with the reciprocating plunge character forming element also is capable of forming a sign with small characters, such as one-half inch or even smaller, since it can be readily controlled without requiring complicated mechanisms or electronics.

Other novel features of the signmaking machine described above are especially useful and effective for a portable signmaking machine that can be made available at a reasonable cost to an end user. For example, another novel feature of a signmaking machine of the invention set out above is the use of a single stepper motor both to transport a carriage along the X-axis and, alternatively, to advance a web of sheet material through the machine. Advancement of sheet material is accomplished when the carriage is in a stopped position to disengage a brake mechanism, and transport of the carriage takes place when the brake is engaged to halt rotation of an outfeed roller. A further novel feature presented in section (d) are the two different operational functionalities of toothed belts which act as movable drive belts for sheet material advancement when the brake mechanism is disengaged and act as stationary racks for carriage advancement when the brake mechanism is engaged.

We claim:

1. A signmaking machine for forming characters from adhesive sheet material, the signmaking machine comprising:

a character forming mechanism, a tool holder supporting the character forming mechanism, means for moving the tool holder in an X-Y plane, means for advancing sheet material through the machine, input means for designating characters to be formed in the adhesive sheet material, memory means for storing instructions for controlling operation of the signmaking machine, and microprocessor means responsive to the instructions in the memory means and responsive to the input means and interfaced to control the means for moving the tool holder and the character forming mechanism, wherein the character forming mechanism comprises a plunger and means for reciprocally driving the plunger to generate impacts on the adhesive sheet material;

wherein the instructions stored in the memory means includes instructions for controlling the means for moving the tool holder in the X-Y plane and the means for reciprocally driving the plunger to generate overlapping impacts along the adhesive sheet material, wherein the overlapping impacts form continuous cut edges separating the designated characters from the sheet material; and wherein the character forming mechanism is limited to a single element with a rounded end portion that impacts the adhesive sheet material to form the continuous cut edges of the characters.

2. A signmaking machine according to claim 1, wherein the instructions stored in the memory means include instructions for controlling the means for moving the tool holder to generate impacts which overlap in a range for 50% to 80% inclusive.

3. A signmaking machine according to claim 1, wherein the means for reciprocally driving the plunger comprises a dual-acting solenoid and circuit means for reciprocating the plunger at a rate in the range of about 400 to 1,000 cycles per second.

4. A signmaking machine according to any one of claims 1-3, wherein the signmaking machine is enclosed in a housing, the housing includes an exit slot through which the adhesive sheet material is advanced after formation of a sign therein, and the housing includes a handle, and wherein the signmaking machine is portable.

5. A signmaking machine for forming characters from adhesive sheet material, the signmaking machine comprising:

a character forming mechanism, a tool holder supporting the character forming mechanism, means for moving the tool holder in an X-Y plane, means for advancing sheet material through the machine, input means for designating characters to be formed in the adhesive sheet material, memory means for storing instructions for controlling operation of the signmaking machine, and microprocessor means responsive to the instructions in the memory means and responsive to the input means and interfaced to control the means for moving the tool holder and the character forming mechanism, wherein the character forming mechanism comprises a plunger and means for reciprocally driving the plunger to impact the adhesive sheet material to form designated characters;

wherein the machine includes a frame and a carriage supported on the frame, and the tool holder is mounted on the carriage;

wherein an anvil is supported on the carriage, the adhesive sheet material extends across the anvil, and the character forming mechanism impacts the adhesive sheet material along the anvil during character formation; and wherein the means for moving the tool holder comprises first motor means and first drive means for moving the carriage including the anvil back and forth along the frame and the sheet material.

6. A signmaking machine according to claim 5 further characterized in that:

the frame comprises four corner posts, a first slide shaft secured between two of the corner posts and a second slide shaft secured between the other two corner posts and arranged parallel to and spaced from the first slide shaft, and the carriage is supported on the first and second slide shafts.

7. A signmaking machine according to claim 6 further characterized in that:

an infeed roller is journaled between two corner posts and arranged perpendicular to the slide shafts, an outfeed roller is journaled between two corner posts and arranged parallel to and spaced from the infeed roller, and the adhesive sheet material extends between the infeed roller and outfeed roller during character formation.

8. A signmaking machine according to claim 7 further characterized in that:

each of the two corner posts between which the infeed roller is journaled includes a slider element movable between a first position and a second position and operably connected to an infeed nip roller that is journaled between the two slider elements to form a nip with the infeed roller, wherein the slider elements are operable to move the infeed nip roller from a first position in which the infeed nip roller forms the nip and a second position in which the infeed nip roller is spaced from the infeed roller.

9. A signmaking machine according to claim 8 further characterized in that:

the slider elements include spring means adapted to bias the infeed nip roller towards the infeed roller with the slider elements in their first position and to hold the nip roller spaced from the infeed roller with the slider elements in their second position.

10. A signmaking machine according to claim 7 further characterized in that:

each of the two corner posts between which the outfeed roller is journaled includes a slider element movable between a first position and a second position, and an outfeed nip roller is journaled between the two slider elements to form a nip with the outfeed roller with the slider elements in their first position and spaced from the outfeed roller with the slider elements in their second position.

11. A signmaking machine according to claim 10 further characterized in that:

said slider elements include spring means adapted to bias the outfeed nip roller towards the outfeed roller with the slider elements in their first position and to hold the nip roller spaced from the outfeed roller with the slider elements in their second position.

12. A signmaking machine according to any one of claims 5–11 further characterized in that:

the program of instructions stored in the memory means includes instructions for actuating the first motor means for moving the carriage.

13. A signmaking machine for forming characters from adhesive sheet material, the signmaking machine comprising:

a character forming mechanism, a tool holder supporting the character forming mechanism, means for moving the tool holder in an X-Y plane, means for advancing sheet material through the machine, input means for designating characters to be formed in the adhesive sheet material, memory means for storing instructions for controlling operation of the signmaking machine, and microprocessor means responsive to the instructions in the memory means and responsive to the input means and interfaced to control the means for moving the tool holder and the character forming mechanism, wherein the character forming mechanism comprises a plunger and means for reciprocally driving the plunger to impact the adhesive sheet material to form designated characters;

wherein the machine includes a frame and a carriage supported on the frame, and the tool holder is mounted on the carriage; and further comprising first motor means and first drive means for moving the carriage back and forth in a longitudinal direction along the frame, while the sheet remains stationary and for moving the sheet material longitudinally along the frame while the carriage remains stationary in the longitudinal direction; and further comprising second motor means and second drive means for moving the tool holder back and forth in a transverse direction across the frame and the sheet material.

14. A signmaking machine according to claim 13 further characterized in that:

the first drive means comprises a pair of toothed belts supported along opposite sides of the frame, a drive shaft journaled on the carriage and gear means connecting the drive shaft to each toothed belt.

15. A signmaking machine according to claim 14 further characterized in that:

the gear means includes a pair of drive pinions on the drive shaft, each drive pinion is meshed with one of the toothed belts, and the first motor means rotates the pinions for movement of the carriage along the toothed belts.

16. A signmaking machine according to claim 14 further characterized in that:

the machine includes tension means supported on the carriage and arranged to contact the toothed belts to maintain tension therein.

17. A signmaking machine according to claim 16 further characterized in that:

the tension means includes spaced ramps on the carriage, a cross shaft supported on the ramps, and spring means biasing the ramps to urge the cross shaft into contact with the toothed belts.

18. A signmaking machine according to claim 13 further characterized in that:

the second drive means comprises a drive belt drivingly engaged with the tool holder and gear means connecting the second motor means to the drive belt for transporting the tool holder bidirectionally along the carriage, and the tool holder is pivotally mounted on the carriage.

19. A signmaking machine for forming characters from adhesive sheet material, the signmaking machine comprising:

a character forming mechanism, a tool holder supporting the character forming mechanism, means for moving the tool holder in an X-Y plane, means for advancing sheet material through the machine, input means for designating characters to be formed in the adhesive sheet material, memory means for storing instructions for controlling operation of the signmaking machine, and microprocessor means responsive to the instructions in the memory means and responsive to the input means and interfaced to control the means for moving the tool holder and the character forming mechanism, wherein the character forming mechanism comprises a plunger and means for reciprocally driving the plunger to impact the adhesive sheet material to form designated characters;

wherein the machine includes a frame and a carriage supported on the frame, and the tool holder is mounted on the carriage; and further comprising first motor means and first drive means for moving the carriage back and forth in a longitudinal direction along the frame, and for moving the sheet material longitudinally along the frame; and the machine includes selectable means having (i) a first position halting actuation of the means for advancing sheet material and enabling the carriage to move and (ii) a second position enabling actuation of the means for advancing sheet material and disenabling the carriage from moving in the longitudinal direction; and the instructions stored in the memory means includes instructions for forming the designated characters and instructions for actuation of the means for advancing sheet material subsequent to formation of one or more characters in the sheet material.

20. A signmaking machine according to claim 19 further characterized in that:

the selectable means includes brake means having (i) a first position halting actuation of the means for advancing sheet material and (ii) a second position enabling actuation of the means for advancing sheet material.

21. A signmaking machine according to claim 20 further characterized in that:

the first drive means includes a pair of parallel, spaced apart toothed belts; and the brake means holds the toothed belts stationary in their first position, in which condition the toothed belts provide stationary racks for movement of the carriage, and the brake means enables rotation of the toothed belts in their second position, in which condition the toothed belts provide drive belts for the means for advancing sheet material.

22. A signmaking machine according to claim 21 further characterized in that:

the means for advancing sheet material includes a rotatable roller journaled in the frame and a one-way clutch for enabling rotation of the roller in one direction only; and the brake means is engaged to halt rotation of the roller in said one direction when in its first position and is disengaged when in its second position whereby the one-way clutch enables rotation of the roller in said one direction.

23. A signmaking machine according to claim 21 further characterized in that:

the first motor means is actuated to drive the carriage when the brake means is in its first position and actuated to drive the means for advancing sheet material when the brake means is in its second position; and the instructions include instructions for actuating the first motor means to drive the carriage to a stopped position to change the brake means from its first position to its second position and thereafter continue actuation of the first motor means to advance sheet material.

24. A signmaking machine for producing a sign from a web of adhesive sheet material, which machine is of the type including operating elements comprising a character forming mechanism, (b) a tool holder supporting the character forming mechanism, (c) means for transporting the tool holder along an X-axis, (d) means for transporting the tool holder along a Y-axis, (e) means for advancing sheet material through the machine, (f) input means for designating characters to be formed in the adhesive sheet material, (g) memory means storing a program of instructions for reading the designated characters and instructions for controlling the means for transporting the tool holder and the means for advancing adhesive sheet material, and (h) microprocessor means responsive to the program of instructions in the memory means and interfaced to control operating elements (a)–(f), characterized in that:

the character forming mechanism comprises a plunger and means for reciprocally driving the plunger to impact the adhesive sheet material; and the program of instructions stored in the memory means includes (1) a first set of instructions for controlling the means for transporting the tool holder along the X-axis and the means for transporting the tool holder along the Y-axis to move the plunger to form overlapping impacts along the adhesive sheet material defining the designated characters, (2) a second set of instructions for controlling the means for advancing the web of adhesive sheet material alternately with execution of the first set of instructions, and (3) a third set of instructions for controlling the means for transporting the tool holder along the Y-axis to form a pair of spaced parallel tear lines orientated transversely across the web of adhesive sheet material, the tear lines each including a plurality of spaced segments, with the segments of one tear line spanning spaces between segments of the other tear lines along which a completed sign is separable from the web of adhesive sheet material.

25. A signmaking machine according to claim 24 further characterized in that:

the machine includes a frame and a carriage supported on the frame, and the tool holder is mounted on the carriage;

the means for transporting the tool holder along the X-axis includes a first motor means mounted on the carriage connected to first drive means for transporting the carriage bidirectionally along the frame;

the means for transporting the tool holder along the Y-axis includes a second motor means mounted on the carriage connected to second drive means for transporting the tool holder bidirectionally along the carriage; and the first, second and third sets of instructions include instructions for controlling the first and second motor means during, respectively, character formation, advancement of the web and formation of the transverse scoring.

26. A signmaking machine according to claim 24 further characterized in that:

the input means for designating characters to be formed in the adhesive sheet material comprises a keyboard and display for operator input designating signs to be formed in the sheet material.

27. A signmaking machine according to claim 24 further characterized in that:

a stationary anvil is supported on the carriage, the adhesive sheet material extends across the stationary anvil, and the character forming mechanism impacts the adhesive sheet material along the anvil during character formation.

28. A signmaking machine according to claim 24 further characterized in that:

the means for reciprocally driving the plunger comprises a dual-acting solenoid and circuit means for bidirectionally actuating the solenoid; and the program of instructions stored in the memory means includes a fourth set of instructions for actuating the circuit means to reciprocate the plunger.

29. A signmaking machine according to any one of claims 24–28 further characterized in that:

the operating elements of the signmaking machine are enclosed in a housing, the housing includes an exit slot through which the adhesive sheet material is advanced after formation of a sign therein, and the housing includes a handle, and wherein the signmaking machine is portable.

30. A signmaking machine according to any one of claims 1, 5, 13, 19 and 24 further characterized in that:

the machine includes first sensor means and second sensor means; and the program of instructions stored in the memory means includes instructions advancing the means for transporting the tool holder along the X-axis to the first sensor means and instructions for advancing the means transporting the tool holder along the Y-axis to the second sensor means, thereby establishing a home reference position for both said means.

* * * * *